US010639906B1

(12) United States Patent
Aoki et al.

(10) Patent No.: US 10,639,906 B1
(45) Date of Patent: May 5, 2020

(54) THERMAL PRINT HEAD

(71) Applicant: Rohm Co., Ltd., Kyoto-shi, Kyoto (JP)

(72) Inventors: Yoichi Aoki, Kyoto (JP); Tadashi Yamamoto, Kyoto (JP); Masatoshi Nakanishi, Kyoto (JP)

(73) Assignee: ROHM CO., LTD., Kyoto (JP)

( * ) Notice: Subject to any disclaimer, the term of this patent is extended or adjusted under 35 U.S.C. 154(b) by 0 days.

(21) Appl. No.: 16/712,133

(22) Filed: Dec. 12, 2019

Related U.S. Application Data

(63) Continuation of application No. 15/994,391, filed on May 31, 2018, now Pat. No. 10,543,696.

(30) Foreign Application Priority Data

Jun. 8, 2017 (JP) ..... 2017-113501
Jul. 18, 2017 (JP) ..... 2017-138906

(51) Int. Cl.
*B41J 2/335* (2006.01)

(52) U.S. Cl.
CPC ..... *B41J 2/33515* (2013.01); *B41J 2/3351* (2013.01); *B41J 2/3352* (2013.01); *B41J 2/3353* (2013.01); *B41J 2/3354* (2013.01); *B41J 2/3357* (2013.01); *B41J 2/33525* (2013.01); *B41J 2/33535* (2013.01)

(58) Field of Classification Search
CPC ..... B41J 2/33515; B41J 2/33535; B41J 2/33525; B41J 2/3353; B41J 2/3354; B41J 2/3357; B41J 2/3351; B41J 2/3352
See application file for complete search history.

(56) References Cited

U.S. PATENT DOCUMENTS 5,635,975 A 6/1997 Shirakawa et al.
2002/0041320 A1* 4/2002 Takizawa ..... B41J 2/335 347/171
2010/0321459 A1* 12/2010 Yamaguchi ..... B41J 2/335 347/211
2014/0132696 A1* 5/2014 Moto ..... B41J 2/3351 347/211
2017/0182794 A1 6/2017 Nishimura et al.

FOREIGN PATENT DOCUMENTS

JP 2017-65021 A 4/2017

* cited by examiner

*Primary Examiner* — Geoffrey S Mruk
(74) *Attorney, Agent, or Firm* — Hamre, Schumann. Mueller & Larson, P.C.

(57) ABSTRACT

A thermal print head includes: a substrate having an obverse surface; a plurality of heat generators arranged on the substrate in a main scanning direction; and a wiring layer provided on the substrate and constituting an energization path to the heat generators. The substrate has a protrusion protruding from the obverse surface and extending in the main scanning direction. The protrusion has a top portion having the largest distance from the obverse surface, and an inclined portion connected to the top portion in a sub-scanning direction. The inclined portion is inclined relative to the obverse surface at a predetermined angle. Each of the plurality of heat generators extends across a boundary between the top portion and the inclined portion. Each of the heat generators is formed on at least a part of the top portion and at least a part of the inclined portion in the sub-scanning direction.

19 Claims, 43 Drawing Sheets

THERMAL PRINT HEAD

FIELD

The present disclosure relates to a thermal print head.

BACKGROUND

One example of a conventional thermal print head is disclosed in JP2017-65021A. The thermal print head of the above document includes a main substrate on which a wiring layer and a resistor layer are formed, and a sub-substrate on which a plurality of driver ICs are mounted. The resistor layer includes a plurality of heat generators arranged in a main scanning direction.

In printing by the above thermal print head, a printing sheet is pressed against the heat generators by a platen roller. The relative position of the platen roller and the heat generators in a sub-scanning direction is appropriately set, for example, during the manufacturing process. However, if the platen roller deviates from the set position for some reason, problems may occur such as degradation in printing quality.

In the above thermal print head, the main substrate and the sub-substrate are adjacently arranged in the sub-scanning direction, and are connected to each other with a plurality of wires. These wires and the driver ICs are covered with a protective resin. In order to avoid interference between the platen roller and the protective resin during printing, the bonding portions of the wires at the main substrate need to be kept away from the heat generators. However, this leads to an increase of the length of the main substrate in the sub-scanning direction, hindering the downsizing of the main substrate (and thus the thermal print head as a whole).

SUMMARY

The technical features of the present disclosure are proposed in view of the foregoing circumstances. An object of the present disclosure is to provide a thermal print head capable of improving printing quality as compared to conventional thermal print heads. Another object of the present disclosure is to provide a thermal print head suitable for downsizing.

Objects of the present disclosure are not limited to the above, and other objects may be derived based on the disclosure of the present application. Each of the thermal print heads of the present disclosure may solve either a plurality of objects or only a single object.

A thermal print head provided by one aspect of the present disclosure includes: a first substrate made of a monocrystalline semiconductor and having a first obverse surface; a resistor layer supported by the first substrate and having a plurality of heat generators arranged in a main scanning direction; and a wiring layer supported by the first substrate and constituting an energization path to the plurality of heat generators. The first substrate has a protrusion that is made of the monocrystalline semiconductor, protrudes from the first obverse surface, and extends in the main scanning direction, The protrusion has a top portion and a first inclined portion. The top portion has the largest distance from the first obverse surface. The first inclined portion is connected to the top portion in a sub-scanning direction and inclined at a first inclination angle relative to the first obverse surface. Each of the heat generators extends across a boundary between the top portion and the first inclined portion and is formed on at least a part of the top portion in the sub-scanning direction and at least a part of the first inclined portion in the sub-scanning direction.

A thermal print head provided by a second aspect of the present disclosure includes: a main substrate having an obverse surface; a resistor layer supported by the main substrate and having a plurality of heat generators arranged in a main scanning direction; a first wiring layer supported by the main substrate and constituting an energization path to the plurality of heat generators; at least one driver IC that performs energization control on the plurality of heat generators; and a flexible wiring substrate having a second wiring layer joined to the first wiring layer via an anisotropic conductive joint material. The driver IC is mounted on the flexible wiring substrate.

Other features and advantages of the thermal print heads according to the present disclosure will become apparent from the detailed description given below with reference to the accompanying drawings.

EMBODIMENTS

Figure 1:
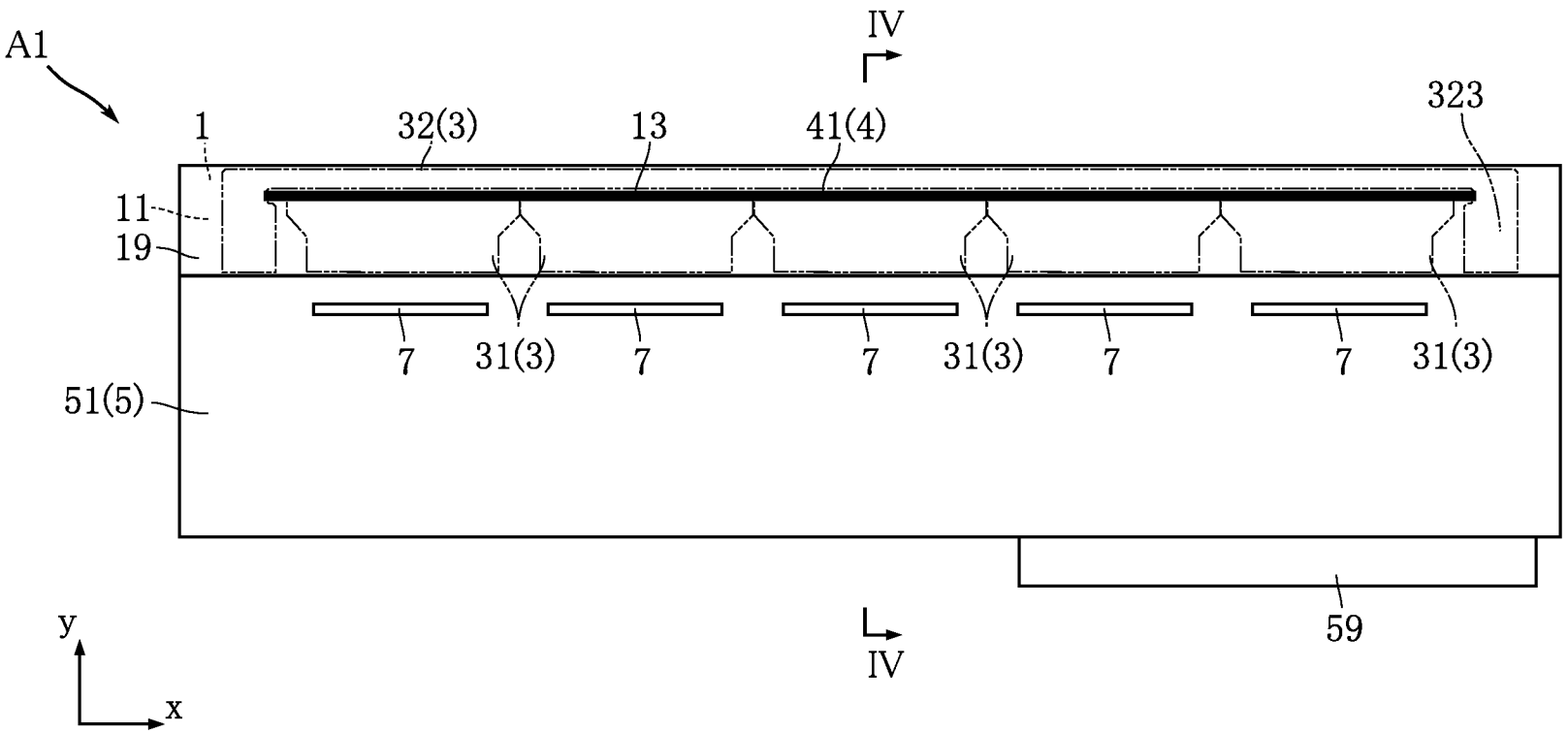
FIG. 1 is a plan view showing a thermal print head according to a first embodiment of a first aspect.

The following describes preferred embodiments in detail with reference to drawings. The following descriptions on various embodiments of two aspects are only given as examples, and the present disclosure is not limited to these embodiments.

Specifically, FIGS. 1 to 27 show thermal print heads A1 to A7 according to first to seventh embodiments of a first aspect. FIGS. 28 to 43 show thermal print heads B1 to B5 according to first to fifth embodiments of a second aspect.

Reference signs used in FIGS. 1 to 27 (first aspect) are basically irrelevant to reference signs used in FIGS. 28 to 43 (second aspect). Accordingly, when an element in the first aspect has the same reference sign as an element in the second aspect, these elements are not necessarily the same (or similar) in terms of structure, material, functions, and so on. Similarly, when an element in the first aspect has a different reference sign as an element in the second aspect, these elements are not necessarily different in terms of structure, material, functions, and so on.

First, a thermal print head A1 according to a first embodiment of a first aspect will be described with reference to FIGS. 1 to 6. The thermal print head A1 includes, for example, a first substrate 1, a protective layer 2, a wiring layer 3, a resistor layer 4, a second substrate 5, a plurality of driver ICs 7, and a heat dissipator 8. The thermal print head A1 is incorporated in a printer that performs printing on a printing medium (not shown) conveyed by a platen roller 91. Examples of the printing medium include thermal sheets which are used to create barcode sheets and receipts.

Figure 2:
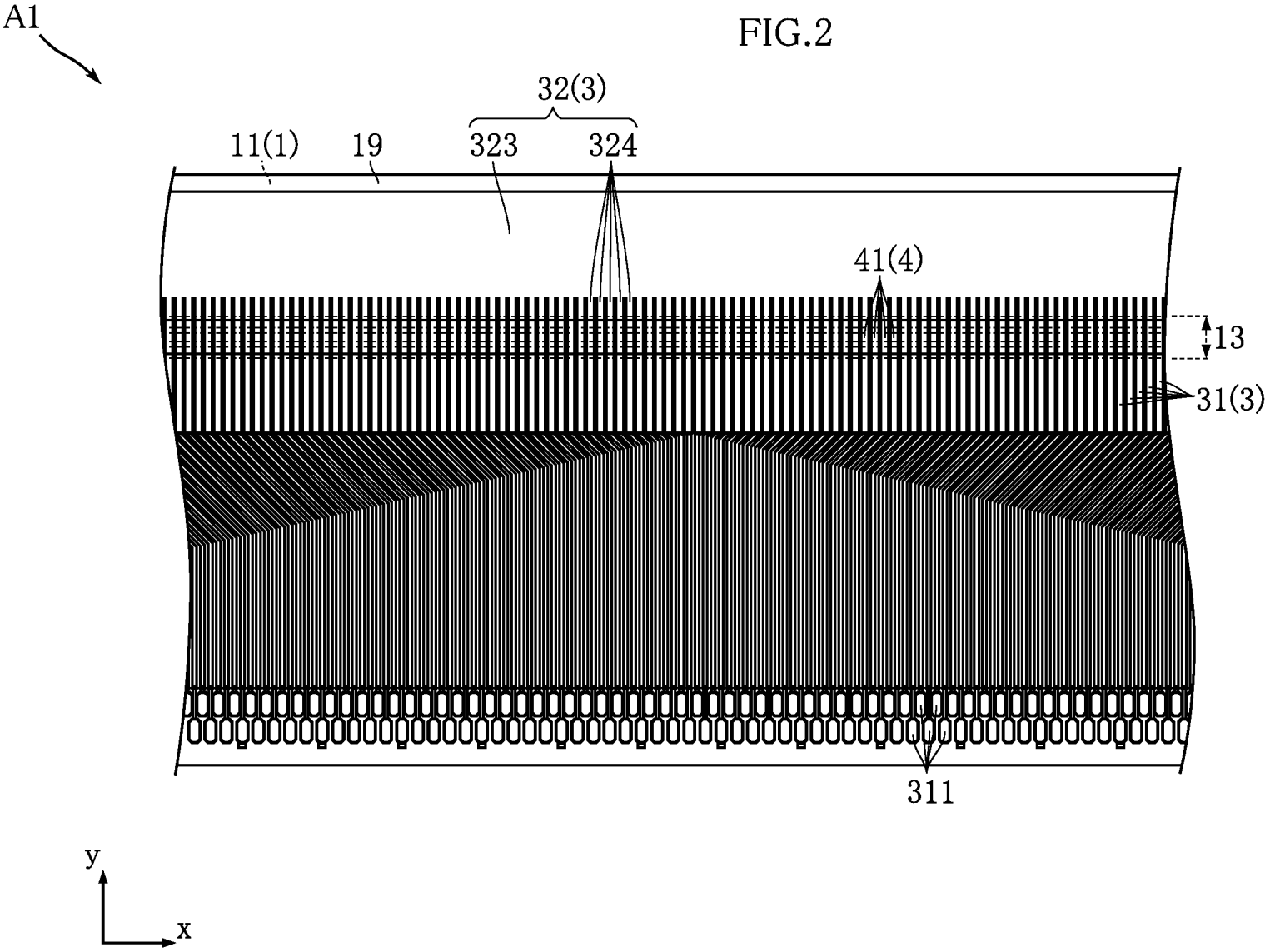
FIG. 2 is a plan view showing the thermal print head according to the first embodiment of the first aspect.
Figure 3:
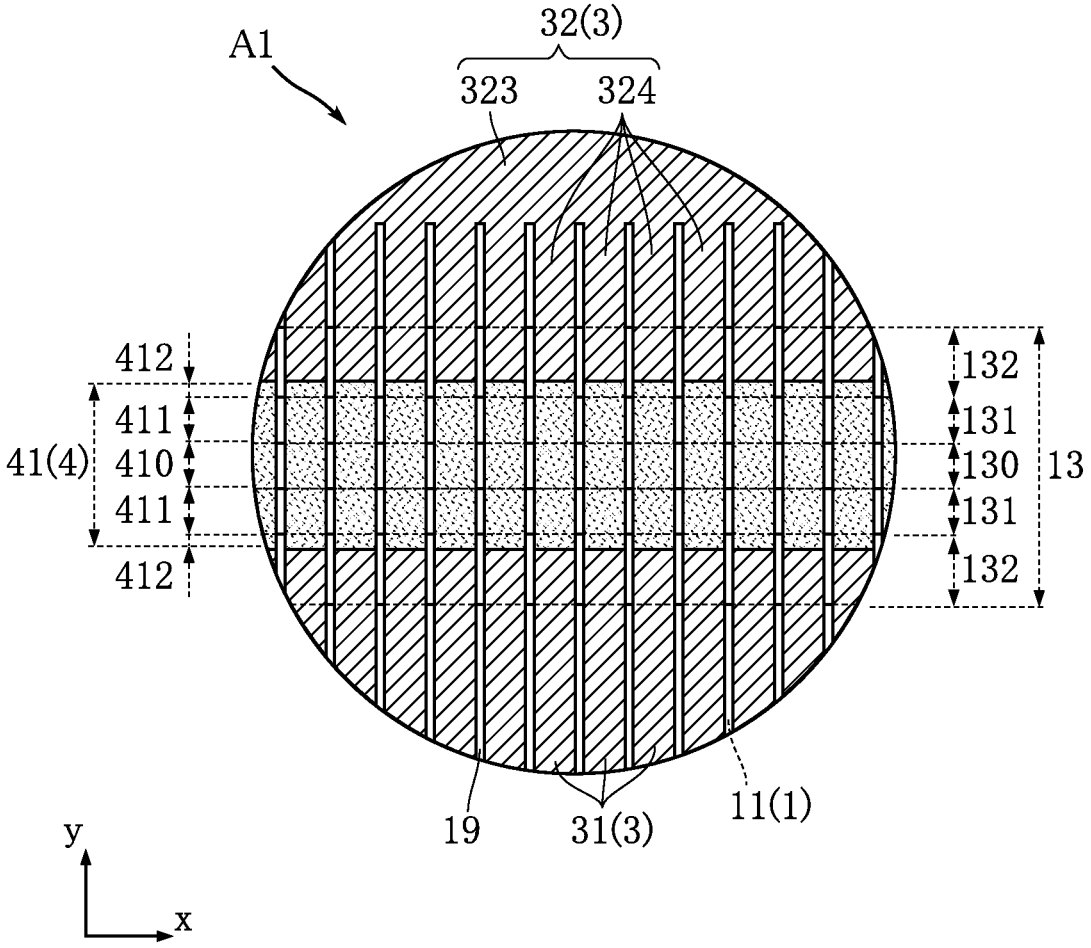
FIG. 3 is a plan view showing a part of the thermal print head according to the first embodiment of the first aspect.
Figure 4:
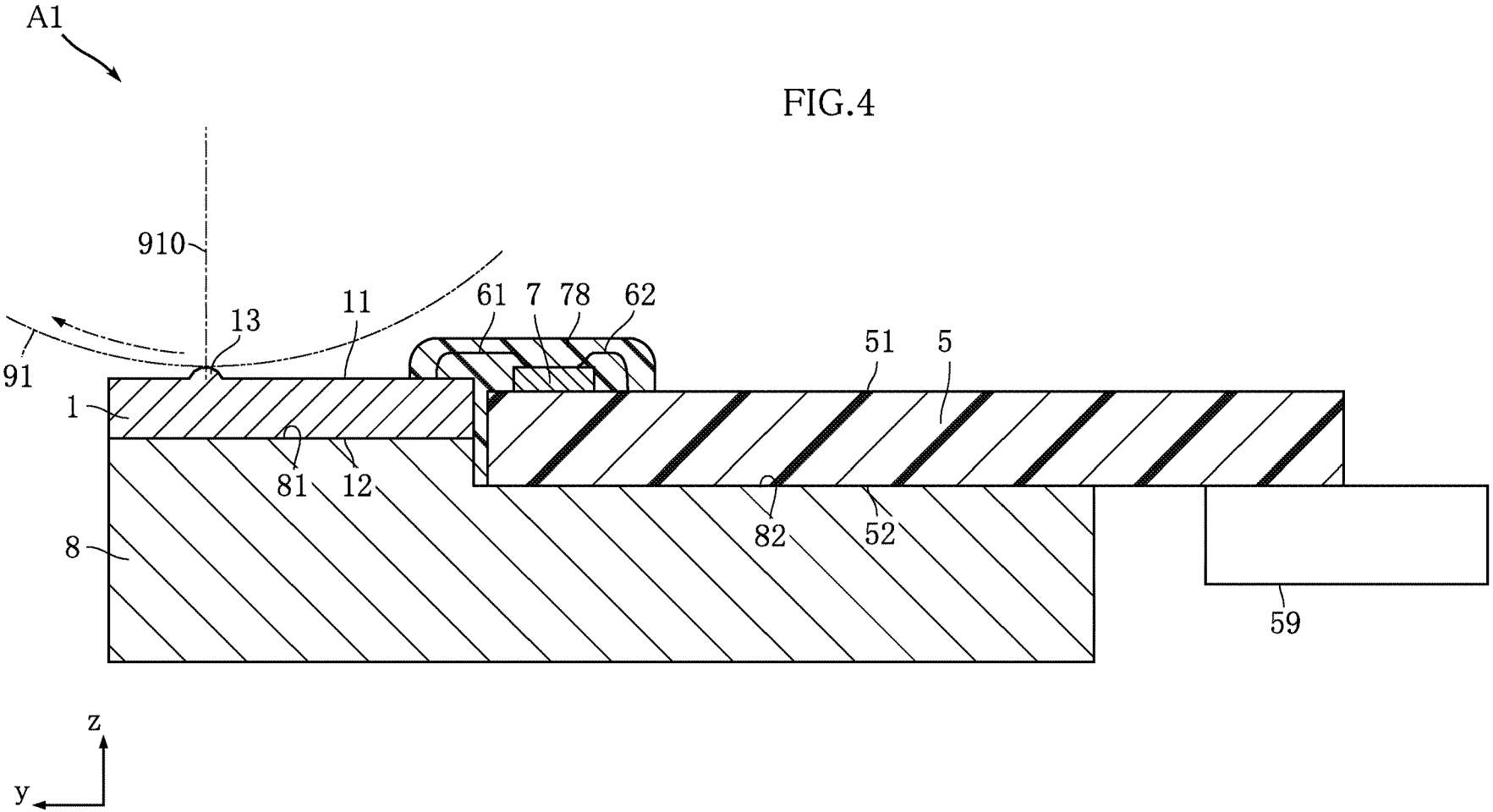
FIG. 4 is a cross-sectional view taken along line IV-IV in FIG. 1.
Figure 5:
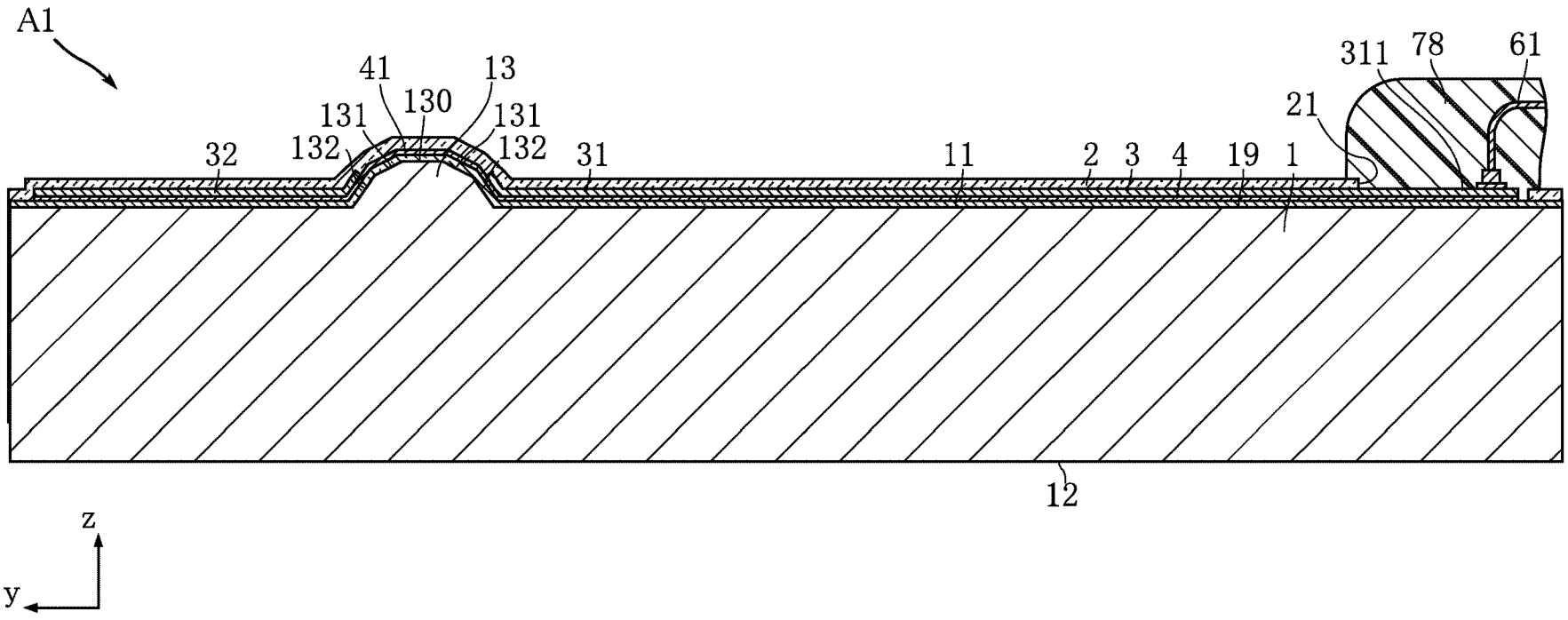
FIG. 5 is a cross-sectional view showing the thermal print head according to the first embodiment of the first aspect.
Figure 6:
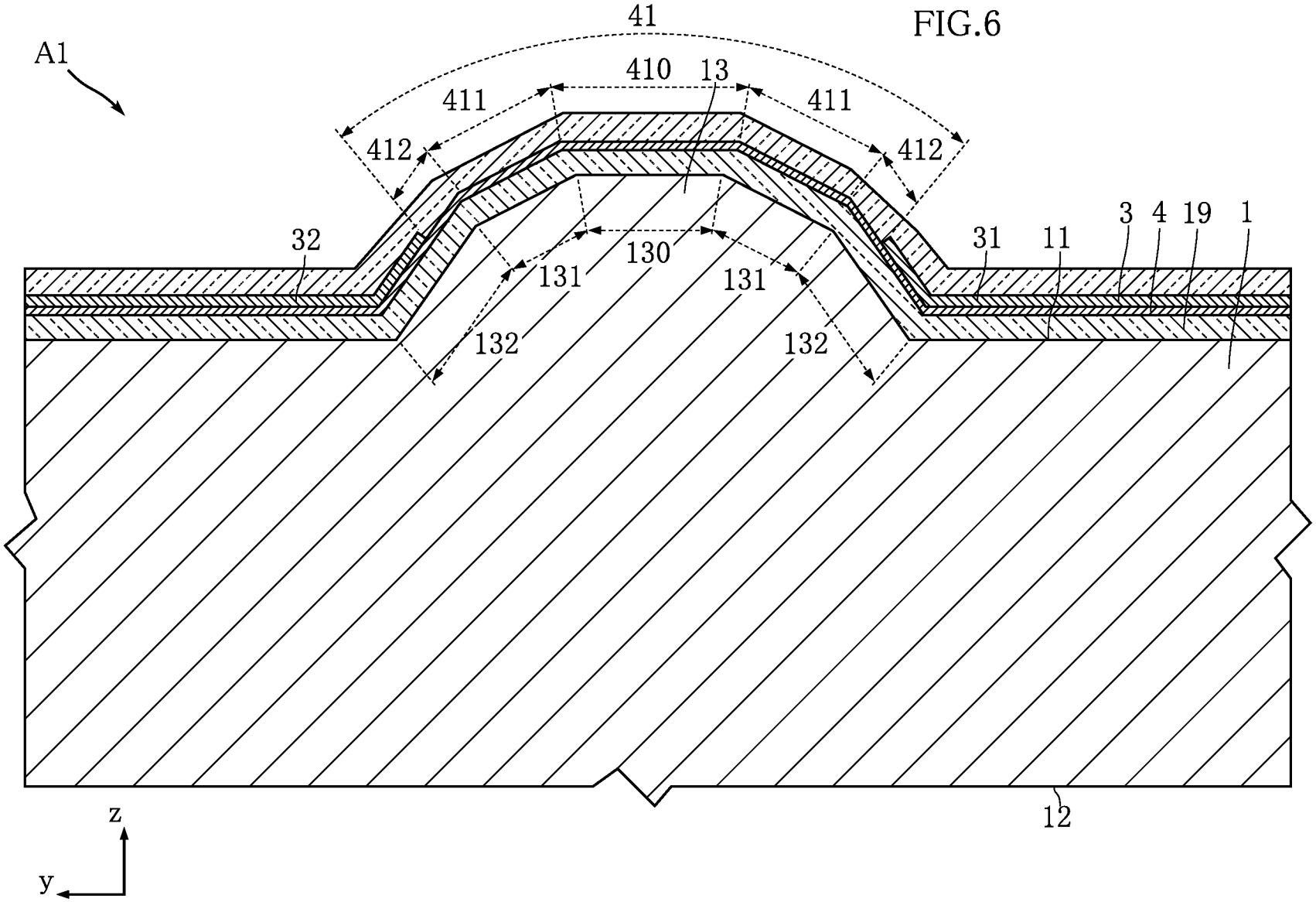
FIG. 6 is a cross-sectional view showing a part of the thermal print head according to the first embodiment of the first aspect.

FIG. 1 is a plan view showing the thermal print head A1. FIG. 2 is a main-part plan view showing the thermal print head A1. FIG. 3 is a main-part enlarged plan view showing the thermal print head A1. FIG. 4 is a cross-sectional view taken along line IV-IV in FIG. 1. FIG. 5 is a main-part cross-sectional view showing the thermal print head A1. FIG. 6 is a main-part enlarged cross-sectional view showing the thermal print head A1. FIGS. 1 to 3 do not show the protective layer 2 to facilitate understanding. FIGS. 1 and 2 do not show a protective resin 78, which is described below, to facilitate understanding. FIG. 2 does not show wires 61, which are described below, to facilitate understanding. For example, in FIG. 1, a sub-scanning direction is parallel to the direction y, and a printing medium is conveyed from upstream to downstream (in the direction of the arrow in the direction y) with respect to the thermal print head A1.

The first substrate 1 supports the wiring layer 3 and the resistor layer 4. The first substrate 1 has a narrow rectangular shape having a length along a main scanning direction x and a width along the sub-scanning direction y. In the following description, the thickness direction of the first substrate 1 is assumed to be a direction z. Although the dimensions of the first substrate are not particularly limited, one example of the thickness of the first substrate 1 is 725 μm. The first substrate 1 may have a dimension of 100 mm to 150 mm in the main scanning direction x and a dimension of 2.0 mm to 5.0 mm in the sub-scanning direction y.

The first substrate 1 is made of a monocrystalline semiconductor. In the present embodiment, the first substrate 1 is made of Si. As shown in FIGS. 4 and 5, the first substrate 1 has a first obverse surface 11 and a first reverse surface 12. The first obverse surface 11 and the first reverse surface 12 face away from each other in the thickness direction z. The wiring layer 3 and the resistor layer 4 are provided on the first obverse surface 11.

The first substrate 1 has a protrusion 13. The protrusion 13 protrudes from the first obverse surface 11 in the thickness direction z, and is elongated in the main scanning direction x. In the illustrated example, the protrusion 13 is formed at a downstream side of the first substrate 1 in the sub-scanning direction y. Since the protrusion 13 is a part of the first substrate 1, it is also made of Si which is a monocrystalline semiconductor.

In the present embodiment, the protrusion 13 has a top portion 130, a pair of first inclined portions 131, and a pair of second inclined portions 132.

The top portion 130 has the largest distance from the first obverse surface 11 among all portions of the protrusion 13. In the present embodiment, the top portion 130 is a plane parallel to the first obverse surface 11. The top portion 130 is a plane having a narrow rectangular shape that is elongated in the main scanning direction x as viewed in the thickness direction z.

The pair of first inclined portions 131 are connected to both sides of the top portion 130 in the sub-scanning direction y. Each of the first inclined portions 131 is inclined by an angle $\alpha 1$ relative to the first obverse surface 11 (and thus to the top portion 130) (see FIG. 10). The angle $\alpha 1$ is equal to the angle (minor angle) between the first obverse surface 11 (and thus the top portion 130) and the outward normal of each of the first inclined portions 131. The first inclined portion 131 is a plane having a narrow rectangular shape that is elongated in the main scanning direction x as viewed in the thickness direction z. The protrusion 13 may have inclined portions (not shown) connected to the pair of first inclined portions 131 and adjacent to the respective ends of the top portion 130 in the main scanning direction x.

The pair of second inclined portions 132 are respectively connected to the pair of first inclined portions 131 at both sides in the sub-scanning direction y. Each of the second inclined portions 132 is inclined by an angle $\alpha 2$, which is larger than the angle $\alpha 1$, relative to the first obverse surface 11 (see FIG. 10). The second inclined portion 132 is a plane having a narrow rectangular shape that is elongated in the main scanning direction x as viewed in the thickness direction z. In the present embodiment, the pair of second inclined portions 132 are connected to the first obverse surface 11. The protrusion 13 may have inclined portions (not shown) that are connected to the pair of second inclined portions 132, and that are located outward in the main scanning direction x at the respective ends of the top portion 130 in the main scanning direction x.

In the present embodiment, the first obverse surface 11 is a (100) surface. According to an example of a manufacturing method described below, the angle $\alpha 1$ between the first inclined portion 131 and the first obverse surface 11 is 30.1 degrees, and the angle $\alpha 2$ between the second inclined portion 132 and the first obverse surface 11 is 54.8 degrees. The protrusion 13 may have a dimension of 150 μm to 300 μm in the thickness direction z.

As shown in FIGS. 5 and 6, the thermal print head A1 has an insulating layer 19. The insulating layer 19 covers the first obverse surface 11 and the protrusion 13 so as to provide reliable insulation at the side of the first obverse surface 11 of the first substrate 1. The insulating layer 19 is made of an insulating material, such as $SiO_2$, SiN, or TEOS (tetraethyl orthosilicate). In the present embodiment, the insulating layer 19 is made of TEOS. The thickness of the insulating layer 19 is not particularly limited. For example, the insulating layer 19 may have a thickness of 5 μm to 15 μm, preferably about 10 μm.

The resistor layer 4 is supported by the first substrate 1. In the present embodiment, the resistor layer 4 is supported by the first substrate 1 via the insulating layer 19. The resistor layer 4 has a plurality of heat generators 41. The plurality of heat generators 41 are individually and selectively energized to locally heat a printing medium. The plurality of heat generators 41 are arranged along the main scanning direction x and are separate from each other in the main scanning direction x. The heat generators 41 are not particularly limited in terms of shape, and each may have a rectangular shape elongated in the sub-scanning direction y as viewed in the thickness direction z. The resistor layer 4 is made of TaN, for example. The thickness of the resistor layer 4 is not particularly limited. For example, the resistor layer 4 may have a thickness of 0.02 μm to 0.1 μm, and preferably about 0.05 μm.

As shown in FIGS. 3 and 6, each of the heat generators 41 has a top portion 410, a pair of first portions 411 and a pair of second portions 412. The top portion 410 of the heat generator 41 is formed on at least a part of the top portion 130 of the protrusion 13 in the sub-scanning direction y. The first portions of the heat generator 41 are formed on at least parts of the first inclined portions 131 of the protrusion 13 in the sub-scanning direction y. The second portions 412 of the heat generator 41 are formed on at least parts of the second inclined portions 132 of the protrusion 13 in the sub-scanning direction y. In the present disclosure, when "a first member is formed (or provided, supported, etc.) on a second member", the first member is not necessarily in direct contact with the second member but may be spaced apart from the second member. For example, in the present embodiment, the insulating layer 19 is interposed between the first substrate 1 and the resistor layer 4. Even in such a case, the description reads "the resistor layer 4 is formed on the first substrate 1". In addition, when the heat generators 41 overlap with the top portion 130, the first inclined portions 131, and the second inclined portions 132 (as viewed in the respective normal directions of the top portion 130, the first inclined portions 131, and the second inclined portions 132, for example), the description reads "the heat generators 41 are formed on the top portion 130, the first inclined portions 131, and the second inclined portions 132".

In the present embodiment, the top portions 410 are formed over the entire length of the top portion 130 in the sub-scanning direction y. Each of the heat generators 41 is formed across the boundaries between the top portion 130 and the pair of first inclined portions 131. The pair of first portions 411 are formed over the entire length of the pair of first inclined portions 131 in the sub-scanning direction y. Each of the heat generators 41 is formed across the boundaries between the pair of first inclined portions 131 and the pair of second inclined portions 132. The pair of second portions 412 are formed on only parts of the second inclined portions 132.

The wiring layer 3 forms an energization path for energizing the plurality of heat generators 41. The wiring layer 3 is supported by the first substrate 1. In the present embodiment, the wiring layer 3 is stacked on the resistor layer 4 as shown in FIGS. 5 and 6. The wiring layer 3 is made of a metallic material having a lower resistance than the resistor layer 4, such as Cu. The wiring layer 3 may include a Cu layer and a Ti layer. The Ti layer is interposed between the Cu layer and the resistor layer 4 and has a thickness of about 100 nm. The thickness of the wiring layer 3 is not particularly limited, and may be 0.3 μm to 2.0 μm.

As shown in FIGS. 1 to 3, FIG. 5, and FIG. 6, in the present embodiment, the wiring layer 3 has a plurality of individual electrodes 31 and a common electrode 32. As shown in FIGS. 3 and 6, the resistor layer 4 includes portions that are exposed from the wiring layer 3 between the plurality of individual electrodes 31 and the common electrode 32, and these exposed portions serve as the heat generators 41.

As shown in FIGS. 3 and 6, each of the plurality of individual electrodes 31 has a substantially band shape extending in the sub-scanning direction y, and is disposed upstream in the sub-scanning direction y relative to the plurality of heat generators 41. In the present embodiment, the downstream ends of the individual electrodes 31 in the sub-scanning direction y overlap the second inclined portion 132 of the protrusion 13 which is located more upstream than the other second inclined portion 132 in the sub-scanning direction y. As shown in FIGS. 2 and 5, the individual electrodes 31 have individual pads 311. The individual pads 311 are connected to wires 61 so as to be electrically conductive with the driver ICs 7.

As shown in FIGS. 2, 3, 5, and 6, the common electrode 32 has a connected portion 323 and a plurality of strip portions 324. The plurality of strip portions 324 are arranged downstream in the sub-scanning direction y relative to the plurality of heat generators 41. The upstream ends of the plurality of strip portions 324 in the sub-scanning direction y face the downstream ends of the plurality of individual electrodes 31 in the sub-scanning direction y with the heat generators 41 therebetween. The upstream ends of the strip portions 324 in the sub-scanning direction y overlap the second inclined portion 132 of the protrusion 13 that is located downstream in the sub-scanning direction y. The connected portion 323 is located downstream in the sub-scanning direction y relative to the plurality of strip portions 324, and is connected to the plurality of strip portions 324. The connected portion 323 is a relatively wide portion that extends in the main scanning direction x and has a larger dimension in the sub-scanning direction y than each of the strip portions 324. As shown in FIG. 1, the connected portion 323 extends from the downstream side of the plurality of heat generators 41 in the sub-scanning direction y, bypasses both sides in the main scanning direction x, and extends toward the upstream side in the sub-scanning direction y.

In the present embodiment, the downstream portions of the plurality of strip portions 324 in the sub-scanning direction y, and the connected portion 323 are formed on the first obverse surface 11 of the first substrate 1.

The protective layer 2 covers the wiring layer 3 and the resistor layer 4. The protective layer 2 is made of an insulating material, and protects the wiring layer 3 and the resistor layer 4. The protective layer 2 may be made of one or more layers of $SiO_2$, SiN, SiC, or AlN. The thickness of the protective layer 2 is not particularly limited, and may be about 1.0 μm to 10 μm.

As shown in FIG. 5, the protective layer 2 has a plurality of pad openings 21 in the present embodiment. The plurality of pad openings 21 penetrate through the protective layer 2 in the thickness direction z. The plurality of pad openings 21 expose the plurality of individual pads 311 of the individual electrodes 31.

As shown in FIGS. 1 and 4, the second substrate 5 is arranged upstream in the sub-scanning direction y relative to the first substrate 1. The second substrate 5 may be a printed circuit board (PCB) on which the driver ICs 7 and a connector 59 (described below) are mounted. The second substrate 5 is not particularly limited in terms of shape, etc., and has a rectangular shape elongated in the main scanning direction x in the present embodiment. The second substrate 5 has a second obverse surface 51 and a second reverse surface 52. The second obverse surface 51 faces the same side as the first obverse surface 11 of the first substrate 1. The second reverse surface 52 faces the same side as the first reverse surface 12 of the first substrate 1. In the present embodiment, the second obverse surface 51 is located lower than the first obverse surface 11 in the thickness direction.

The driver ICs 7 are mounted on the second obverse surface 51 of the second substrate 5, and individually energize the plurality of heat generators 41. In the present embodiment, the driver ICs 7 are connected to the plurality of individual electrodes 31 by the plurality of wires 61. The driver ICs 7 perform energization control according to an instruction signal input from outside the thermal print head A1 via the second substrate 5. The driver ICs 7 are connected to a wiring layer (not shown) of the second substrate 5 via a plurality of wires 62. In the present embodiment, the plurality of driver ICs 7 are provided to correspond to the number of heat generators 41.

The driver ICs 7, the plurality of wires 61, and the plurality of wires 62 are covered with a protective resin 78. The protective resin 78 may be a black insulating resin. The protective resin 78 spans across the first substrate 1 and the second substrate 5.

The connector 59 is used to connect the thermal print head A1 to a printer (not shown). The connector 59 is attached to the second substrate 5 and connected to the wiring layer (not shown) of the second substrate 5.

The heat dissipator 8 supports the first substrate 1 and the second substrate 5, and dissipates some of the heat generated by the plurality of heat generators 41 to the outside via the first substrate 1. The heat dissipator 8 may be a block-like member that is made of a metal such as aluminum. In the present embodiment, the heat dissipator 8 has a first supporting surface 81 and a second supporting surface 82. The first supporting surface 81 and the second supporting surface 82 each face upward in the thickness direction z, and are arranged side by side in the sub-scanning direction y. The first supporting surface 81 is bonded to the first reverse surface 12 of the first substrate 1. The second supporting surface 82 is bonded to the second reverse surface 52 of the second substrate 5.

Next, an example of a method for manufacturing the thermal print head A1 will be described with reference to FIGS. 7 to 15.

Figure 7:
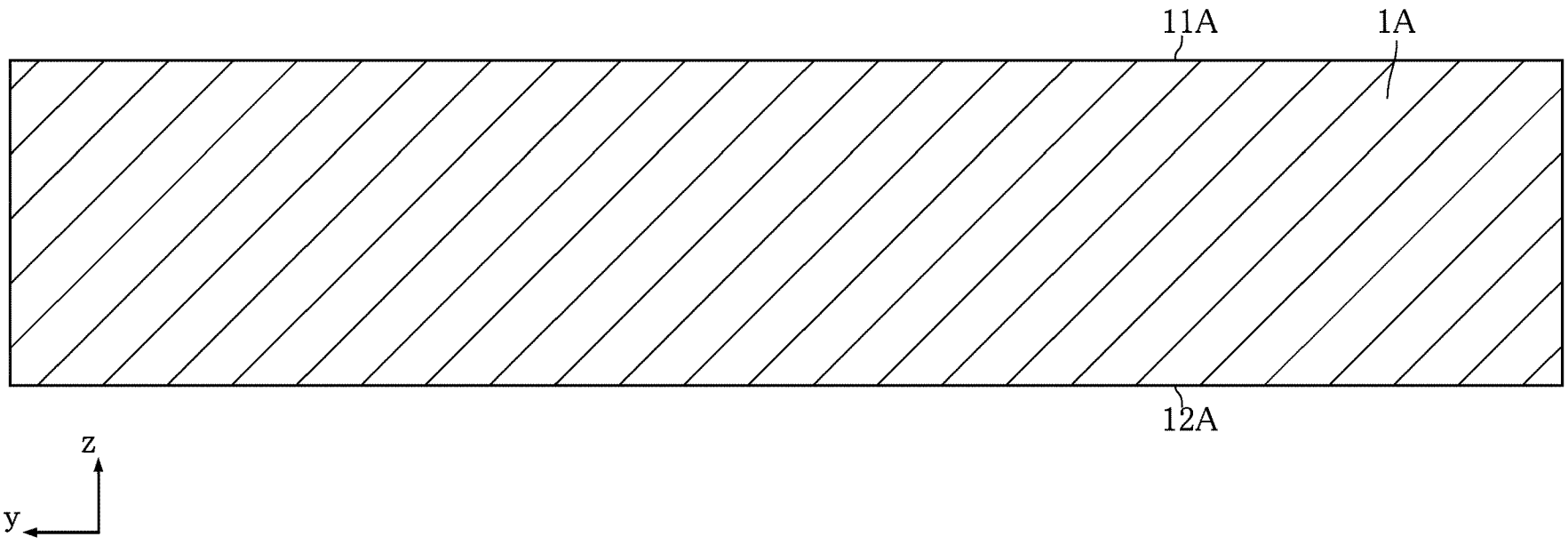
FIG. 7 shows a step of a method for manufacturing the thermal print head according to the first embodiment of the first aspect.

As shown in FIG. 7, a substrate material 1A is prepared. The substrate material 1A is made of a monocrystalline semiconductor, such as a Si wafer. The substrate material 1A is not particularly limited in terms of thickness, and may be 725 μm in the present embodiment. The substrate material 1A has an obverse surface 11A and a reverse surface 12A that face away from each other. The obverse surface 11A is a (100) surface.

Figure 8:
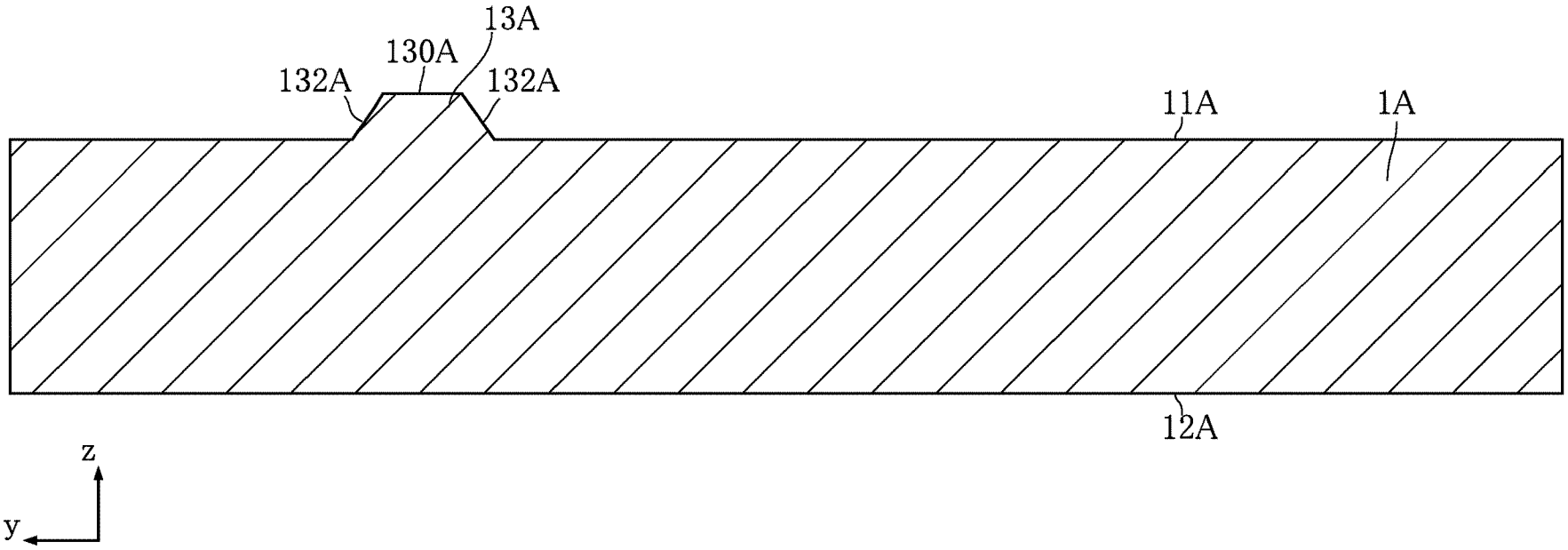
FIG. 8 shows a step of the method for manufacturing the thermal print head according to the first embodiment of the first aspect.

After the obverse surface 11A is covered with a predetermined mask layer, anisotropic etching with KOH is performed, for example. As a result, the substrate material 1A is formed with a protrusion 13A as shown in FIG. 8. The protrusion 13A protrudes from the obverse surface 11A, and is elongated in the main scanning direction x. The protrusion 13A has a top portion 130A and a pair of inclined portions 132A. The top portion 130A is parallel to the obverse surface 11A, and is a (100) surface in the present embodiment. The pair of inclined portions 132A are located at both sides of the top portion 130A in the sub-scanning direction y, between the top portion 130A and the obverse surface 11A. The inclined portions 132A are planes inclined relative to the top portion 130A and the obverse surface 11A. In the present embodiment, the angles between the inclined portions 132A and each of the obverse surface 11A and the top portion 130A are 54.8 degrees.

Figure 9:
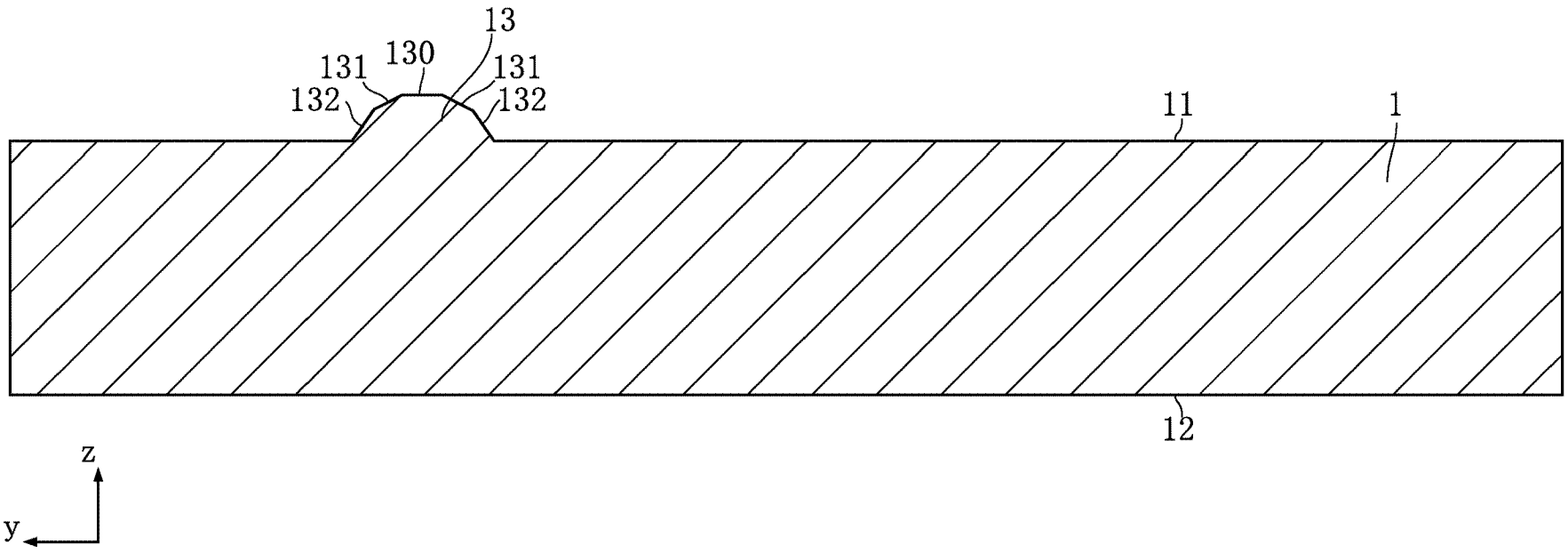
FIG. 9 shows a step of the method for manufacturing the thermal print head according to the first embodiment of the first aspect.
Figure 10:
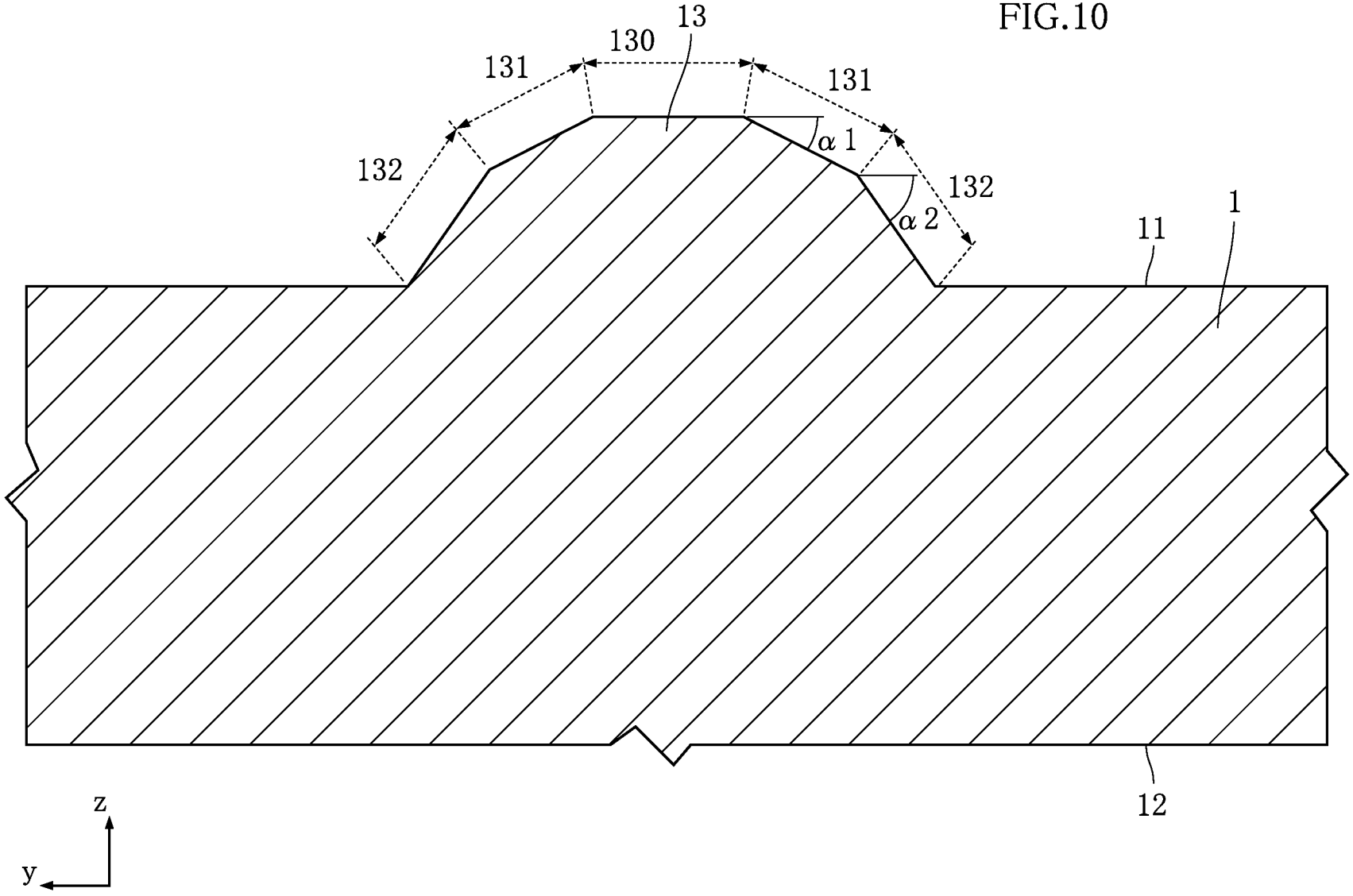
FIG. 10 shows a step of the method for manufacturing the thermal print head according to the first embodiment of the first aspect.

After the mask layer is removed, etching with KOH, for example, may be performed again. As a result, the substrate material 1A is formed into the first substrate 1 having the first obverse surface 11, the first reverse surface 12, and the protrusion 13, as shown in FIGS. 9 and 10. The protrusion 13 has the top portion 130, the pair of first inclined portions 131, and the pair of second inclined portions 132. The top portion 130 corresponds to the top portion 130A, and the pair of second inclined portions 132 correspond to the pair of second inclined portions 132A. The pair of first inclined portions 131 are formed by performing KOH etching on the boundaries between the top portion 130A and the pair of inclined portions 132A. The angles $\alpha 1$ between the pair of first inclined portions 131 and the first obverse surface 11 are 30.1 degrees, and the angles $\alpha 2$ between the pair of second inclined portions 132 and the first obverse surface 11 are 54.8 degrees.

Figure 11:
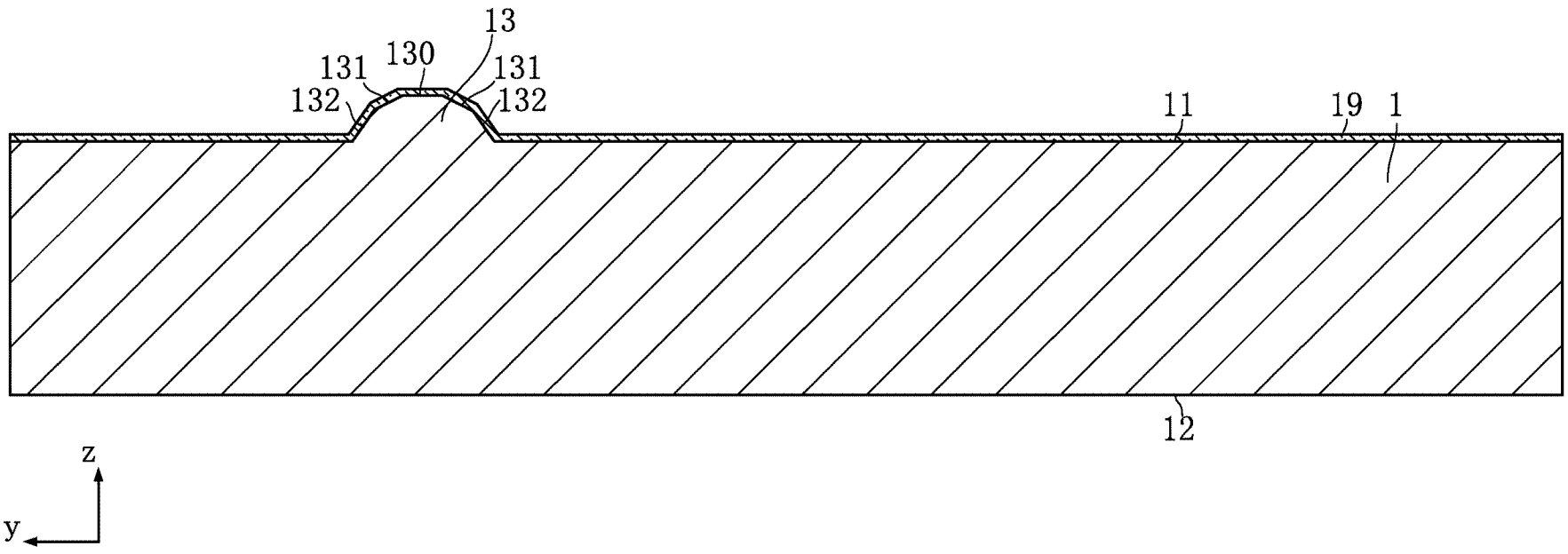
FIG. 11 shows a step of the method for manufacturing the thermal print head according to the first embodiment of the first aspect.

Next, the insulating layer 19 is formed as shown in FIG. 11. The insulating layer 19 may be formed by depositing TEOS on the first substrate 1 by CVD.

Figure 12:
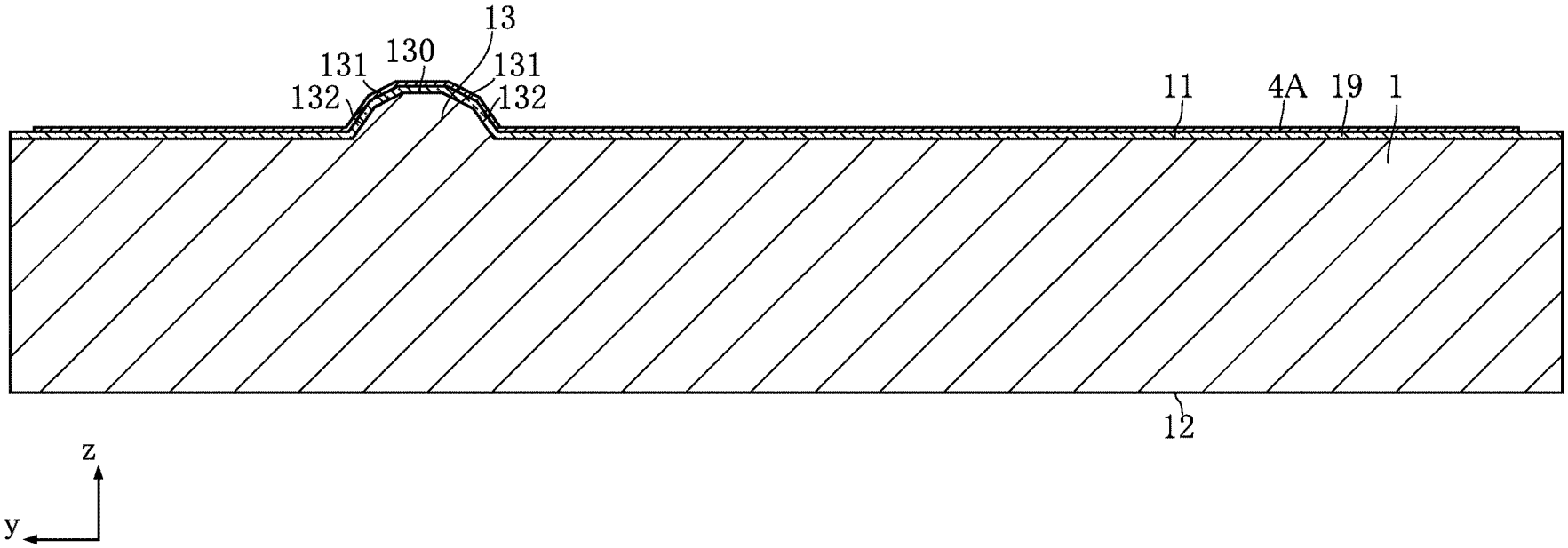
FIG. 12 shows a step of the method for manufacturing the thermal print head according to the first embodiment of the first aspect.
Figure 13:
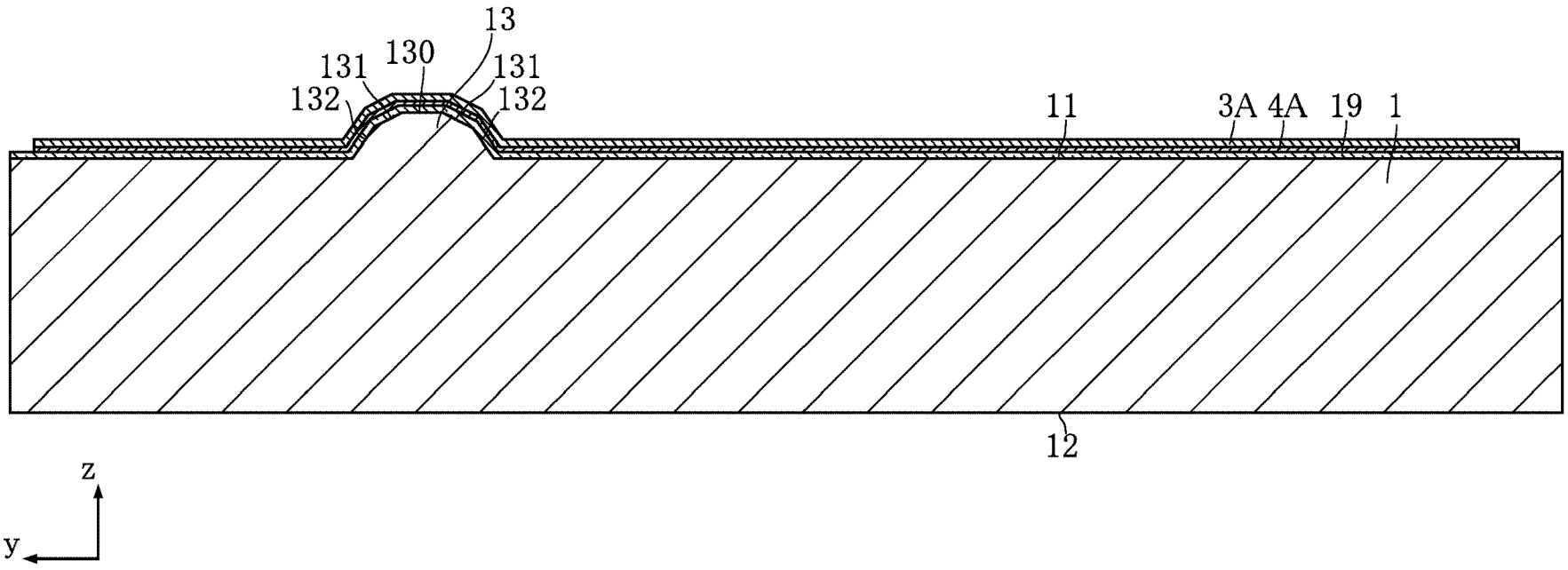
FIG. 13 shows a step of the method for manufacturing the thermal print head according to the first embodiment of the first aspect.

Next, a resistor film 4A is formed as shown in FIG. 12. The resistor film 4A is formed by forming a thin TaN film on the insulating layer 19 by sputtering, for example.

Next, a conductive film 3A is formed to cover the resistor film 4A. The conductive film 3A is formed by forming a Cu layer by plating or sputtering, for example. Note that before forming the Cu layer, a Ti layer may be formed.

Figure 14:
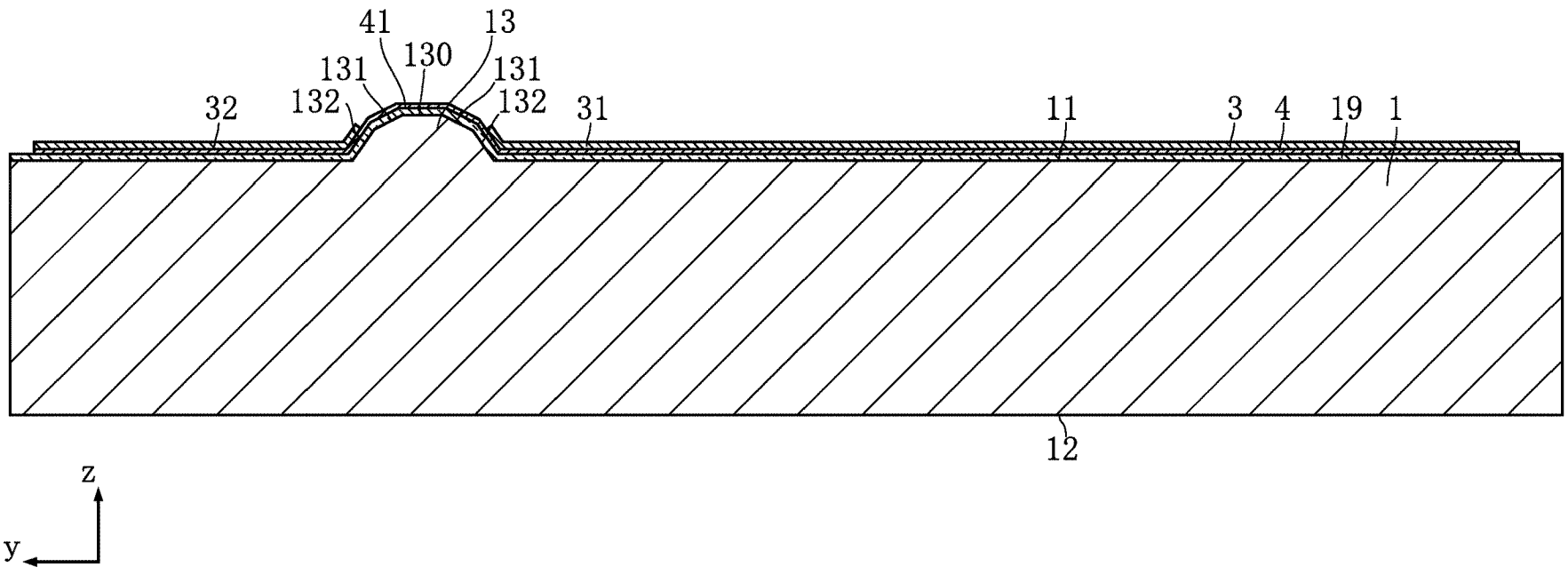
FIG. 14 shows a step of the method for manufacturing the thermal print head according to the first embodiment of the first aspect.
Figure 15:
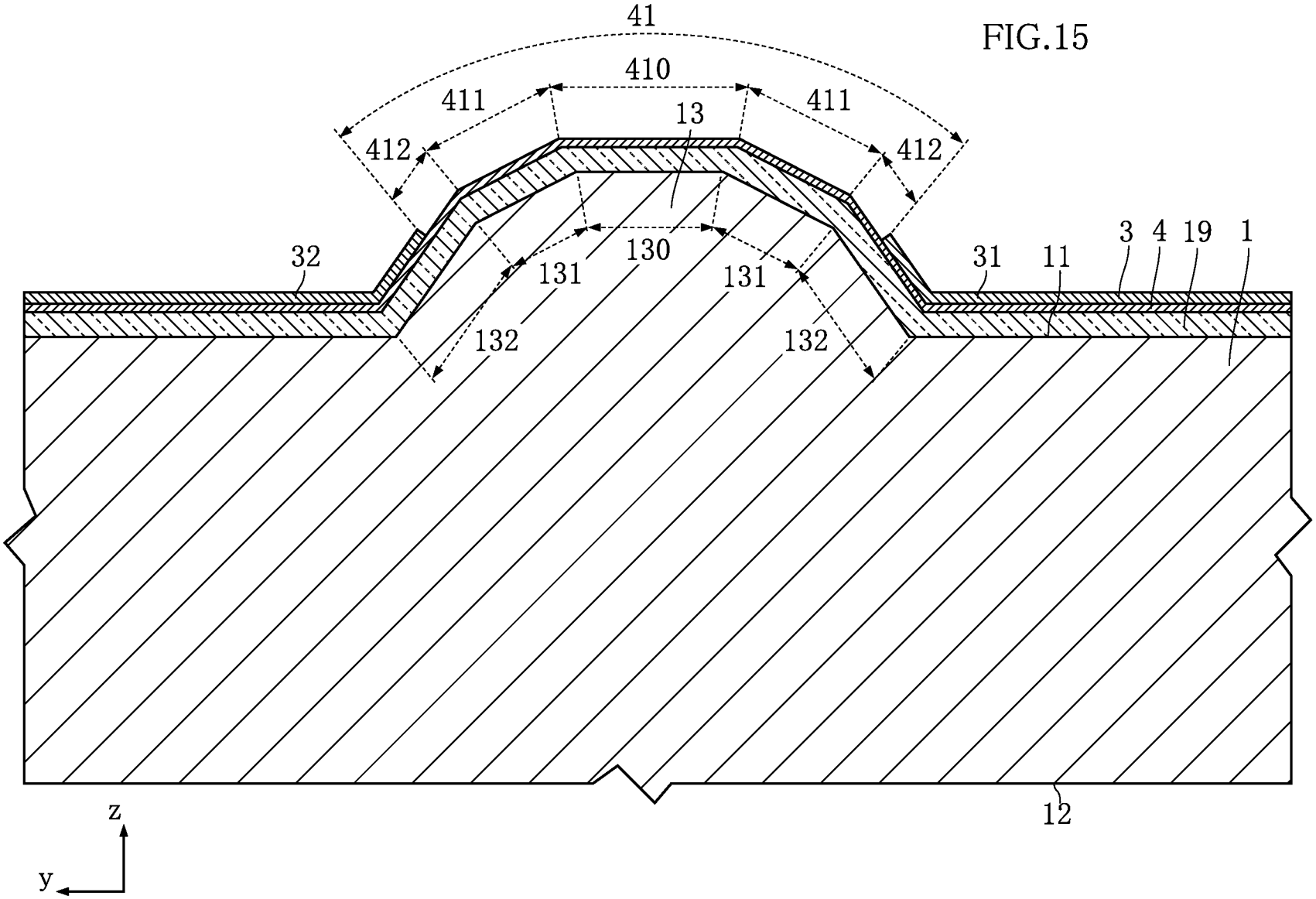
FIG. 15 shows a step of the method for manufacturing the thermal print head according to the first embodiment of the first aspect.

Next, as shown in FIGS. 14 and 15, the conductive film 3A and the resistor film 4A are selectively etched, thereby to form the wiring layer 3 and the resistor layer 4. The wiring layer 3 has the plurality of individual electrodes 31 and the common electrode 32 as described above. The resistor layer 4 has the plurality of heat generators 41.

Next, the protective layer 2 is formed. The protective layer 2 is formed by depositing SiN and SiC over the insulating layer 19, the wiring layer 3, and the resistor layer 4, by CVD, for example. Next, the protective layer 2 is partially removed by etching or the like to form the pad openings 21. Thereafter, steps of attaching the first substrate 1 and the second substrate 5 to the first supporting surface 81, mounting the driver ICs 7 to the second substrate 5, bonding the plurality of wires 61 and the plurality of wires 62, and forming the protective resin 78, etc. are performed so as to provide the above-described thermal print head A1.

Next, the advantages of the thermal print head A1 will be described.

According to the present embodiment, the protrusion 13 of the first substrate 1 has the top portion 130 and the first inclined portions 131. Each of the heat generators 41 has the top portion 410 formed on the top portion 130, and the first portions 411 formed on the first inclined portions 131, and these heat generators 41 are formed across the boundaries between the top portion 130 and the first inclined portions 131. Owing to this structure, when the thermal print head A1 is pressed against the platen roller 91 as shown in FIG. 4, the platen roller 91 comes into contact with either or both of the top portion 410 and the first portions 411 due to the elastic deformation of the platen roller 91. As shown in FIG. 4, when the center 910 of the platen roller 91 coincides with the center of the protrusion 13 in the sub-scanning direction y, the platen roller 91 is firmly pressed against the top portion 410. On the other hand, when the center 910 of the platen roller 91 deviates from the center of the protrusion 13 in the sub-scanning direction y, the pressure between the platen roller 91 and the top portion 410 is lowered. In the present embodiment, the heat generators 41 have the first portions 411. Accordingly, if the platen roller 91 deviates, the ratio at which the platen roller 91 comes into contact with the first portions 411 becomes larger, allowing the platen roller 91 to still be appropriately pressed against the heat generators 41. For this reason, the thermal print head A1 can suppress degradation in printing quality in a situation such as when the platen roller 91 undesirably deviates in position or when a platen roller 91 having a different diameter is used.

Also, in the present embodiment, each of the top portions 410 is formed over the entire length of the top portion 130 in the sub-scanning direction y, and the pair of first portions 411 are formed on both sides of the top portion 410 in the sub-scanning direction y. Accordingly, regardless of whether the platen roller 91 deviates toward the upstream side or the downstream side in the sub-scanning direction y, degradation in printing quality will be suppressed. Also, the pair of first portions 411 are formed over the entire length of the pair of first inclined portions 131 in the sub-scanning direction y. This structure is preferable for suppressing degradation in printing quality when the platen roller 91 undesirably deviates.

Also, in the present embodiment, the protrusion 13 has the pair of second inclined portions 132. In other words, the protrusion 13 has the first inclined portions 131 and the second inclined portions 132 that are inclined in two stages relative to the top portion 130 (first obverse surface 11), and these portions 131 and 132 are positioned side by side in the sub-scanning direction y. Such a structure is preferable for improving printing quality because it reduces the angles between the top portion 130 and the first inclined portions 131 (see FIG. 10). Smaller angles between the top portion 130 and the first inclined portions 131 can better suppress the friction of the protective layer 2 caused by the passage of a printing sheet during printing. Since the first portions 411 are provided over the entire length of the first inclined portions 131 in the sub-scanning direction y, the ends of the individual electrodes 31 and the common electrode 32 in the sub-scanning direction y are not positioned on the pair of first inclined portions 131 but rather on the pair of second inclined portions 132. Such a structure can prevent steps from being formed at positions overlapping with the first inclined portions 131 due to the edges of the wiring layer 3. This is advantageous in letting a printing sheet pass smoothly and preventing the adherence of scraps of paper. Provision of the pairs of second portions 412 is even more preferable for suppressing degradation in printing quality when the platen roller 91 undesirably deviates.

Since the common electrode 32 is positioned downstream in the sub-scanning direction y relative to the plurality of heat generators 41, only the plurality of individual electrodes 31 are provided upstream in the sub-scanning direction y relative to the plurality of heat generators 41. This makes it possible to reduce the array pitch of the plurality of individual electrodes 31 in the main scanning direction x and achieve high definition in printing.

FIGS. 16 to 27 show modifications and other embodiments. In these figures, elements that are the same as or similar to the above embodiment are provided with the same reference signs as the above embodiment.

Figure 16:
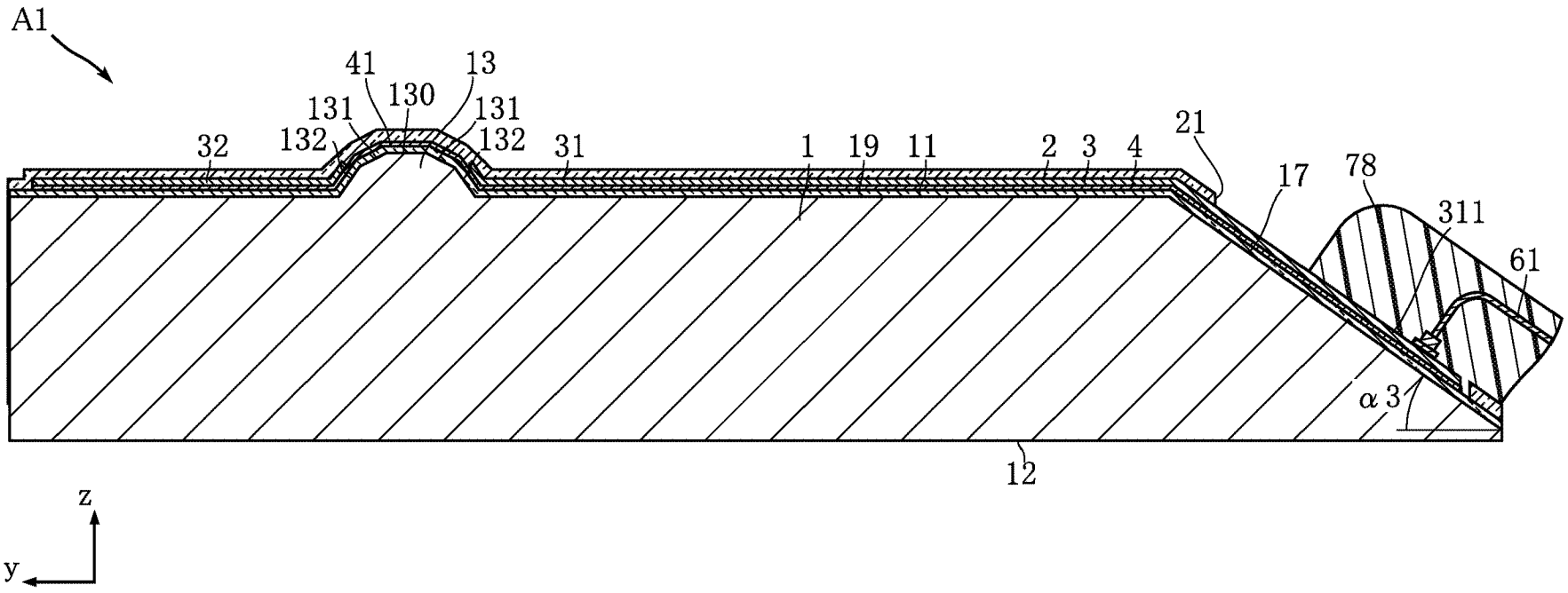
FIG. 16 is a cross-sectional view describing a modification of the thermal print head according to the first embodiment of the first aspect.

FIG. 16 shows a modification of the thermal print head A1. In the present modification, the first substrate 1 is formed with a connecting inclined portion 17. The connecting inclined portion 17 is formed at the upstream end of the first substrate 1 in the sub-scanning direction y. The connecting inclined portion 17 is inclined toward the first reverse surface 12 in the thickness direction z with increasing distance from the protrusion 13 in the sub-scanning direction y. In the illustrated example, the connecting inclined portion 17 is a plane. An angle $\alpha$3 between the connecting inclined portion 17 and the first obverse surface 11 is 35 degrees, for example. Note that the angle $\alpha$3 can be set to various angles, such as the same angle $\alpha$s the angle $\alpha$1 or the angle $\alpha$2, by appropriately changing the etching solution used for etching, for example.

The individual pads 311 of the plurality of individual electrodes 31 are formed on the connecting inclined portion 17. Parts of the wires 61 bonded to the individual pads 311 (e.g., linear parts near the bonding portions) extend in a direction inclined relative to the first obverse surface 11 (normal direction of the connecting inclined portion 17).

Such a modification can improve the printing quality of the thermal print head A1. Owing to the individual pads 311 provided on the connecting inclined portion 17, the wires 61 connected to the individual pads 311 can extend in the normal direction of the connecting inclined portion 17. This makes it possible to prevent the protective resin 78 covering the wires 61 from significantly protruding in the thickness direction z. As a result, interference between the protective resin 78 and the platen roller 91 can be avoided.

Figure 17:
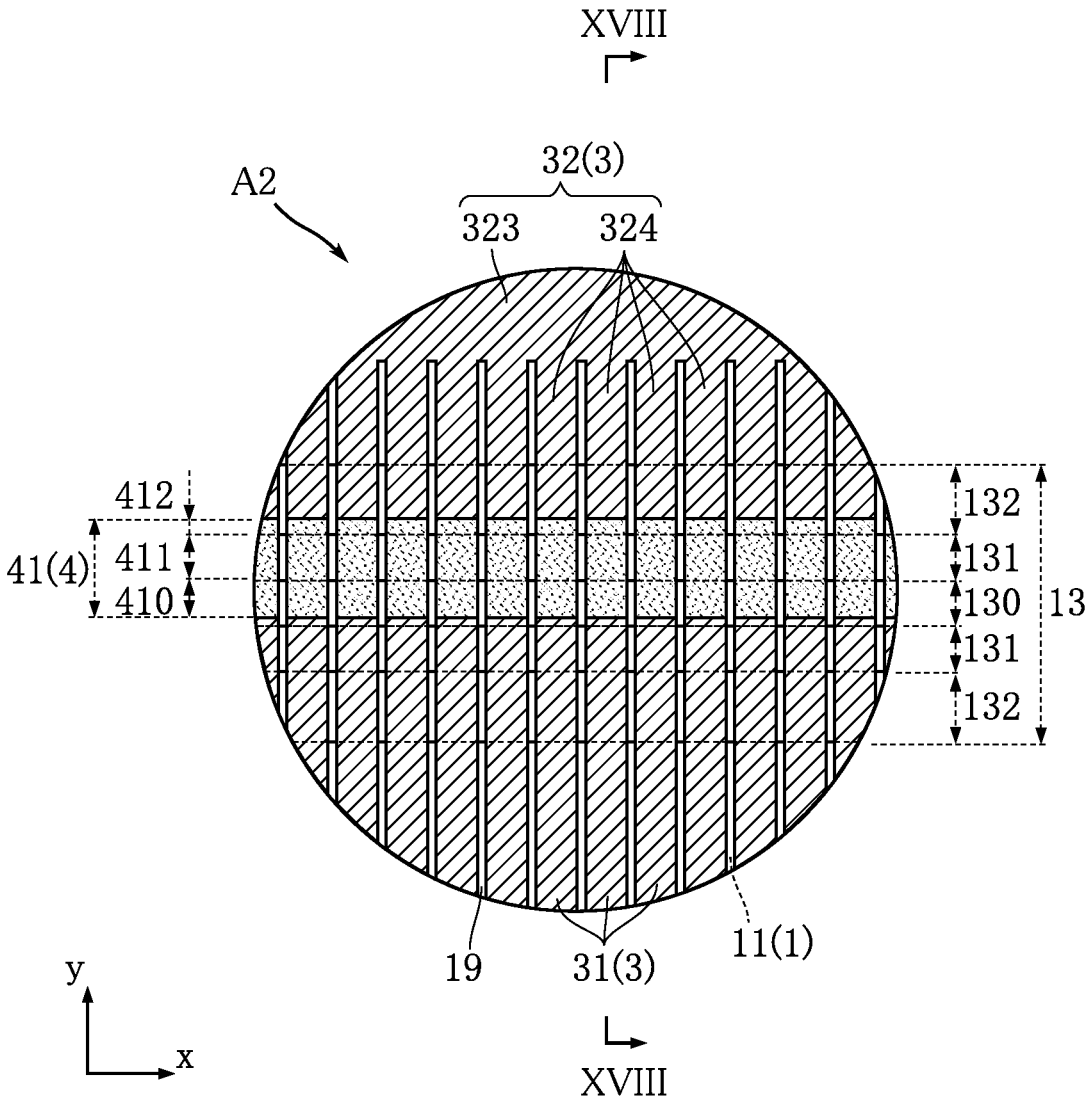
FIG. 17 is a plan view showing a part of a thermal print head according to a second embodiment of the first aspect.
Figure 18:
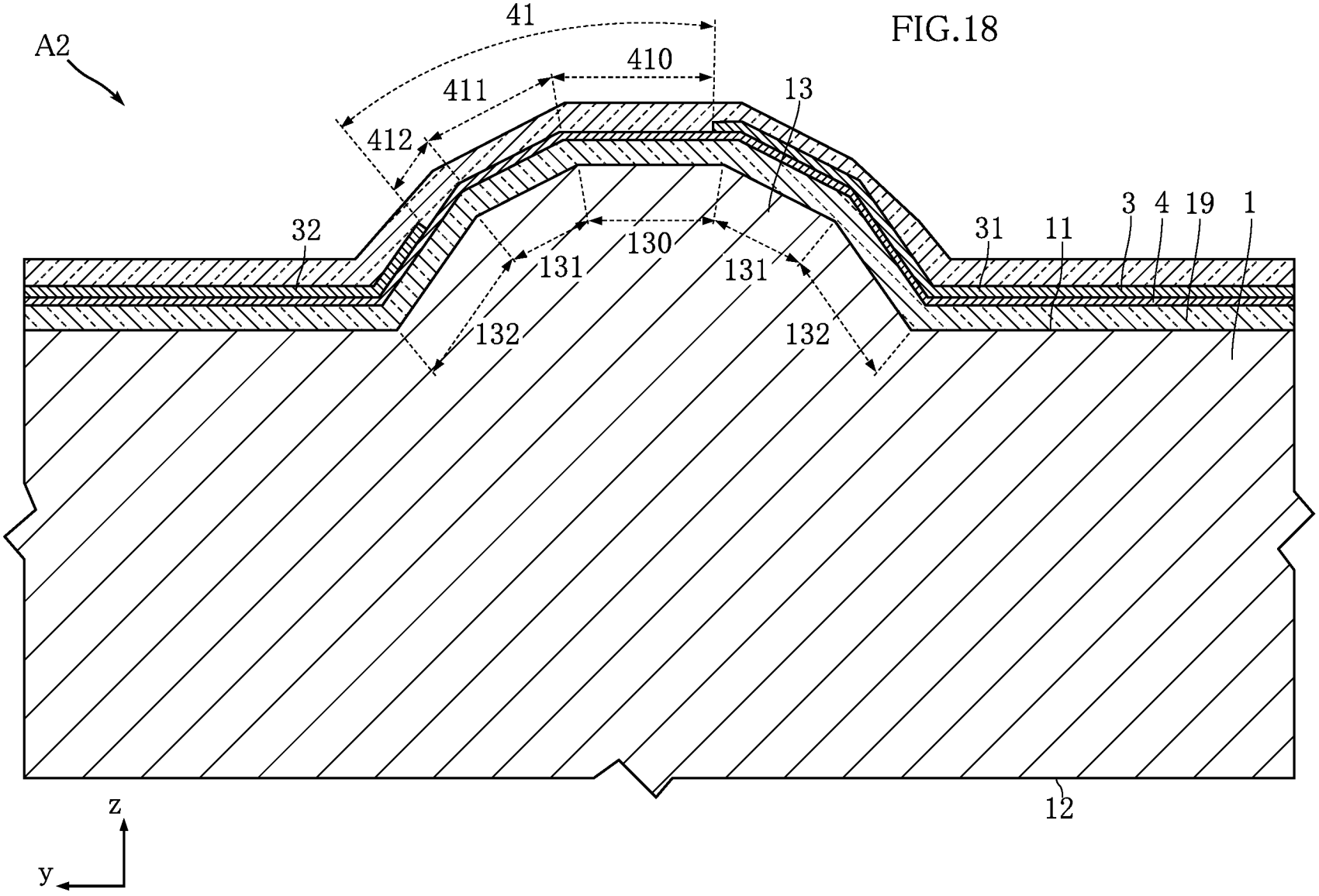
FIG. 18 is a cross-sectional view taken along line XVIII-XVIII in FIG. 17.

FIGS. 17 and 18 show a thermal print head according to a second embodiment of the first aspect. FIG. 17 is a main-part enlarged plan view showing a thermal print head A2 according to the present embodiment, and FIG. 18 is a main-part enlarged cross-sectional view taken along line XVIII-XVIII in FIG. 17.

In the present embodiment, each of the heat generators 41 has a single top portion 410, a single first portion 411, and a single second portion 412. The top portion 410 is formed on only a part of a top portion 130, which is located more downstream than the remaining part of the top portion 130 in the sub-scanning direction y. In other words, in the present embodiment, the downstream end of an individual electrode 31 in the sub-scanning direction y overlaps with the top portion 130. The first portion 411 is formed on an individual pad 311 located downstream in the sub-scanning direction y, specifically over the entire length of the individual pad 311 in the sub-scanning direction y. The heat generator 41 is formed across the boundary between the top portion 130 and a first inclined portion 131. The second portion 412 is formed on only a part of a second inclined portion 132 located downstream in the sub-scanning direction y, where the part is located upstream in the sub-scanning direction y. In other words, the upstream end of a strip portion 324 of a common electrode 32 in the sub-scanning direction y overlaps with the second inclined portion 132 located downstream in the sub-scanning direction y. The heat generator 41 is formed across the boundary between the individual pad 311 located downstream in the sub-scanning direction y and the second inclined portion 132 located downstream in the sub-scanning direction y.

The present embodiment can also improve the printing quality of the thermal print head A2. In the present embodiment, the heat generators 41 are shifted to the downstream side of the protrusion 13 in the sub-scanning direction y. This achieves excellent printing quality when the center 910 of a platen roller 91 is shifted downstream in the sub-scanning direction y relative to the protrusion 13. Such an arrangement is advantageous in preventing interference between the platen roller 91 and a protective resin 78, and can downsize the first substrate 1 in the sub-scanning direction y. Also, since the heat generators 41 are reduced in length in the sub-scanning direction y, heat is intensively generated in smaller areas of the heat generators 41. This is preferable for clearer printing.

Figure 19:
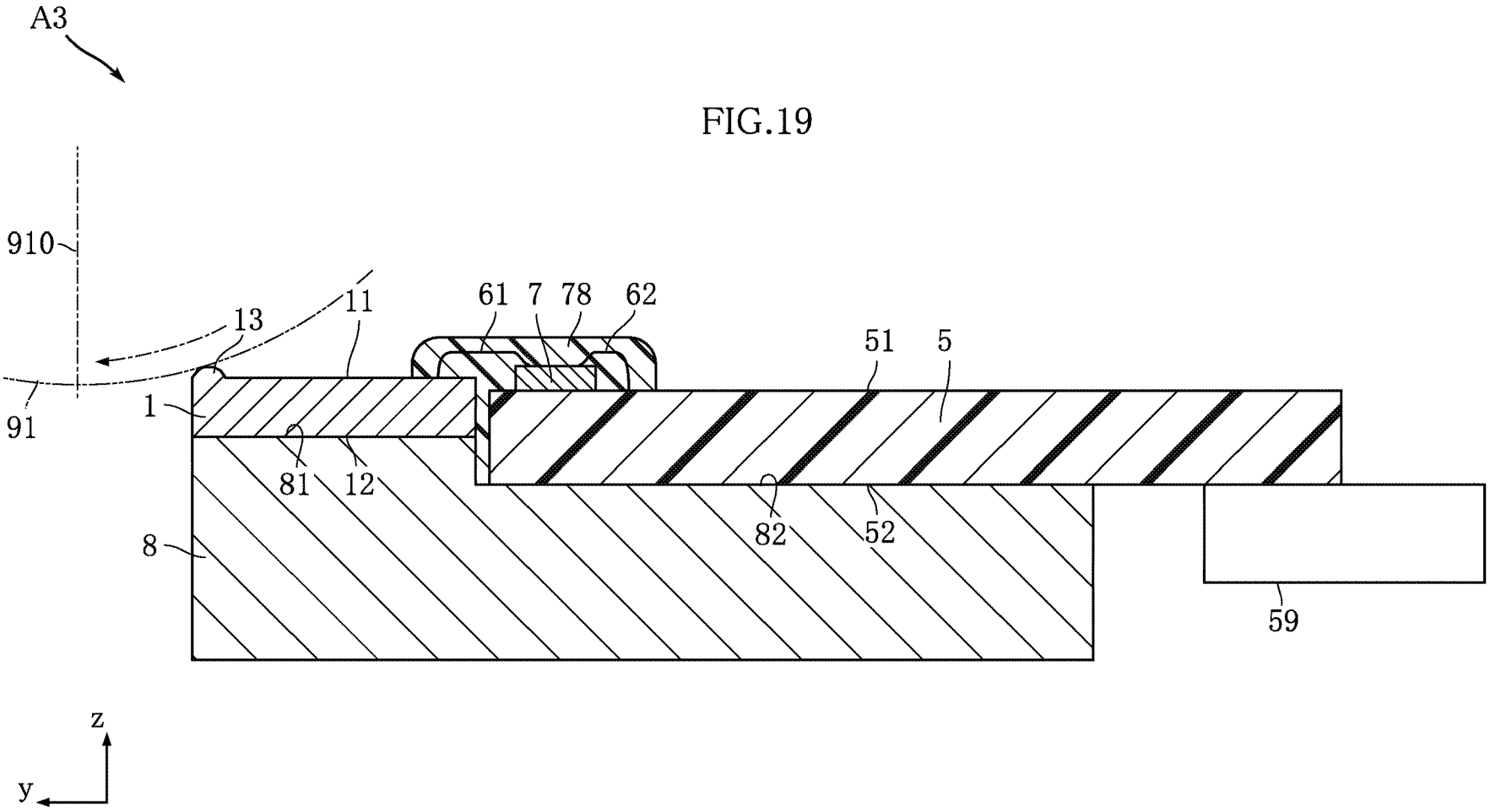
FIG. 19 is a cross-sectional view showing a thermal print head according to a third embodiment of the first aspect.
Figure 20:
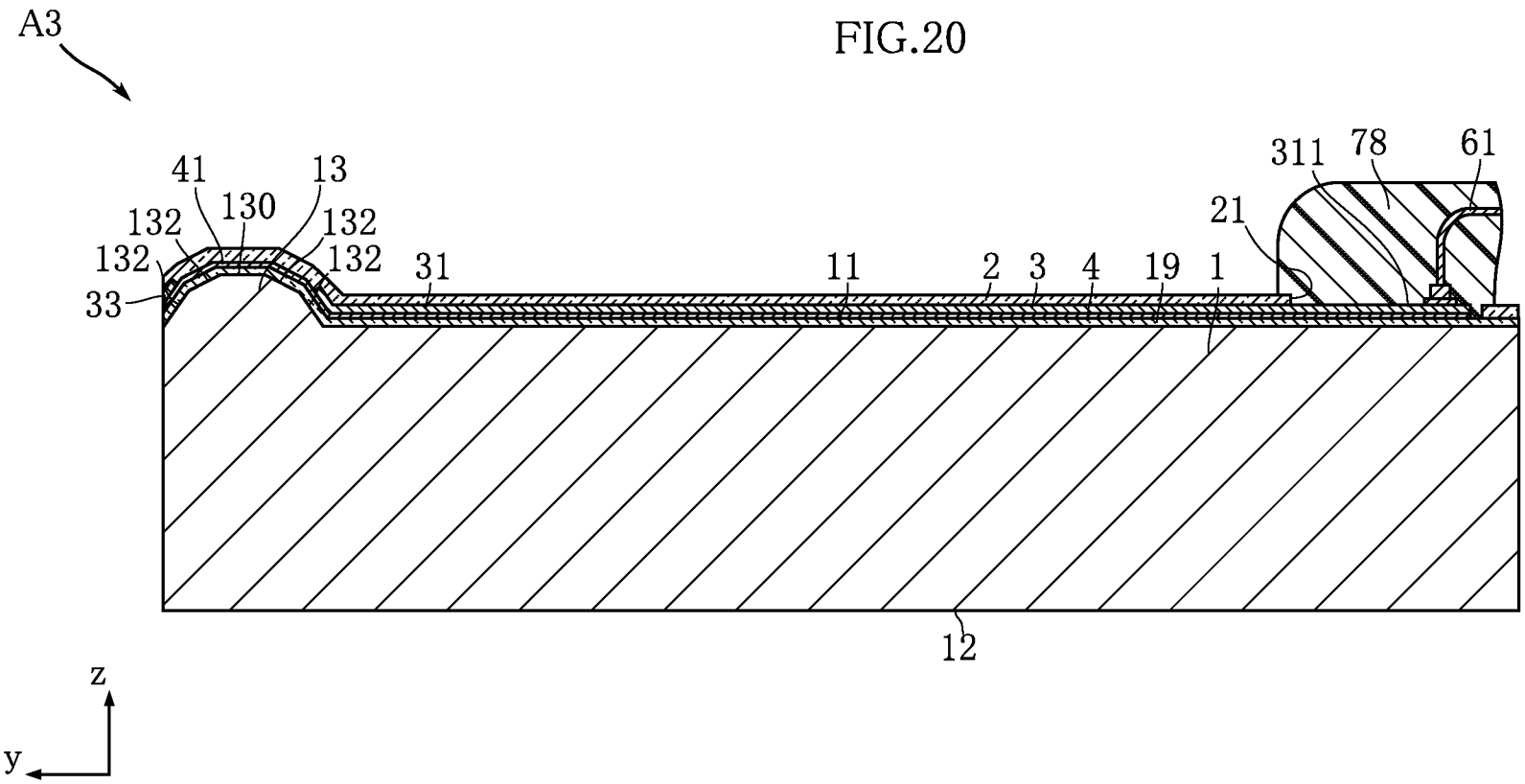
FIG. 20 is a cross-sectional view showing the thermal print head according to the third embodiment of the first aspect.
Figure 21:
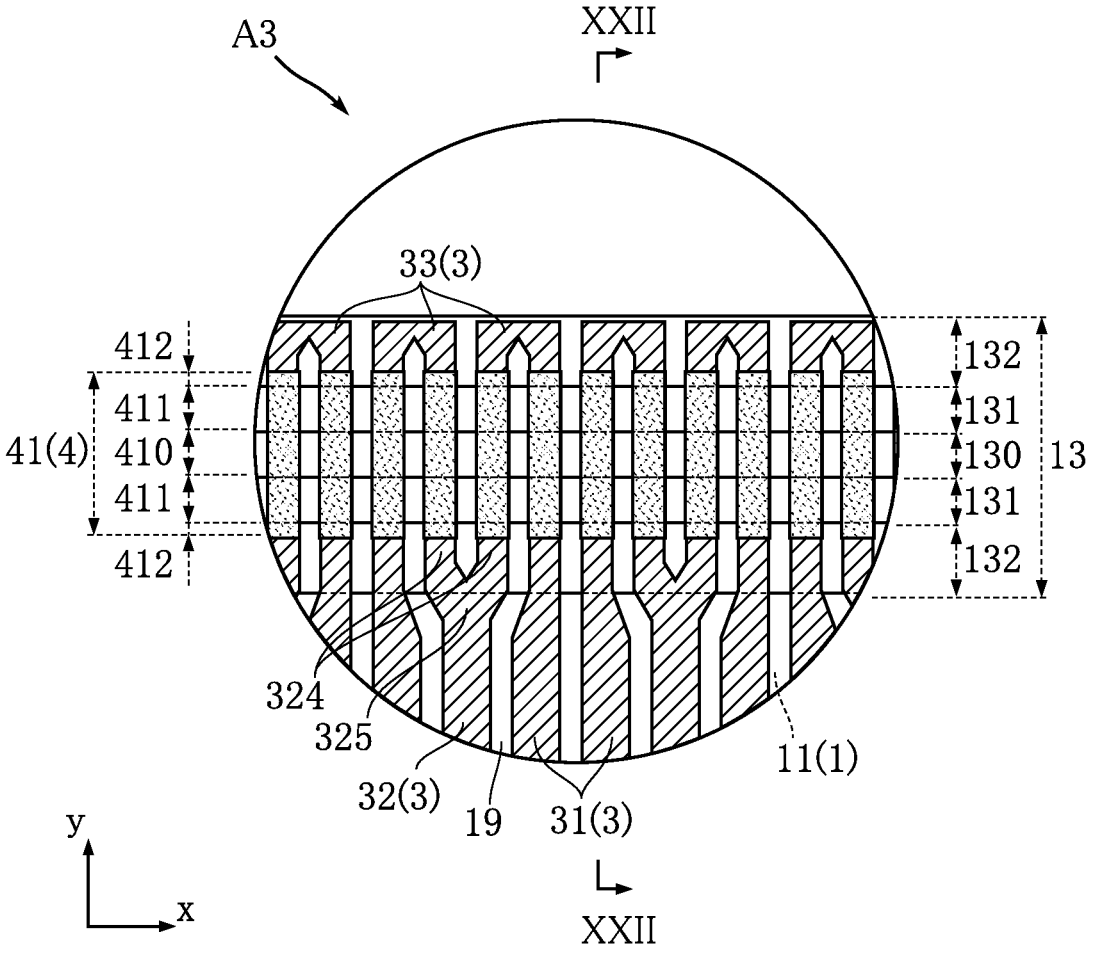
FIG. 21 is a plan view showing a part of the thermal print head according to the third embodiment of the first aspect.
Figure 22:
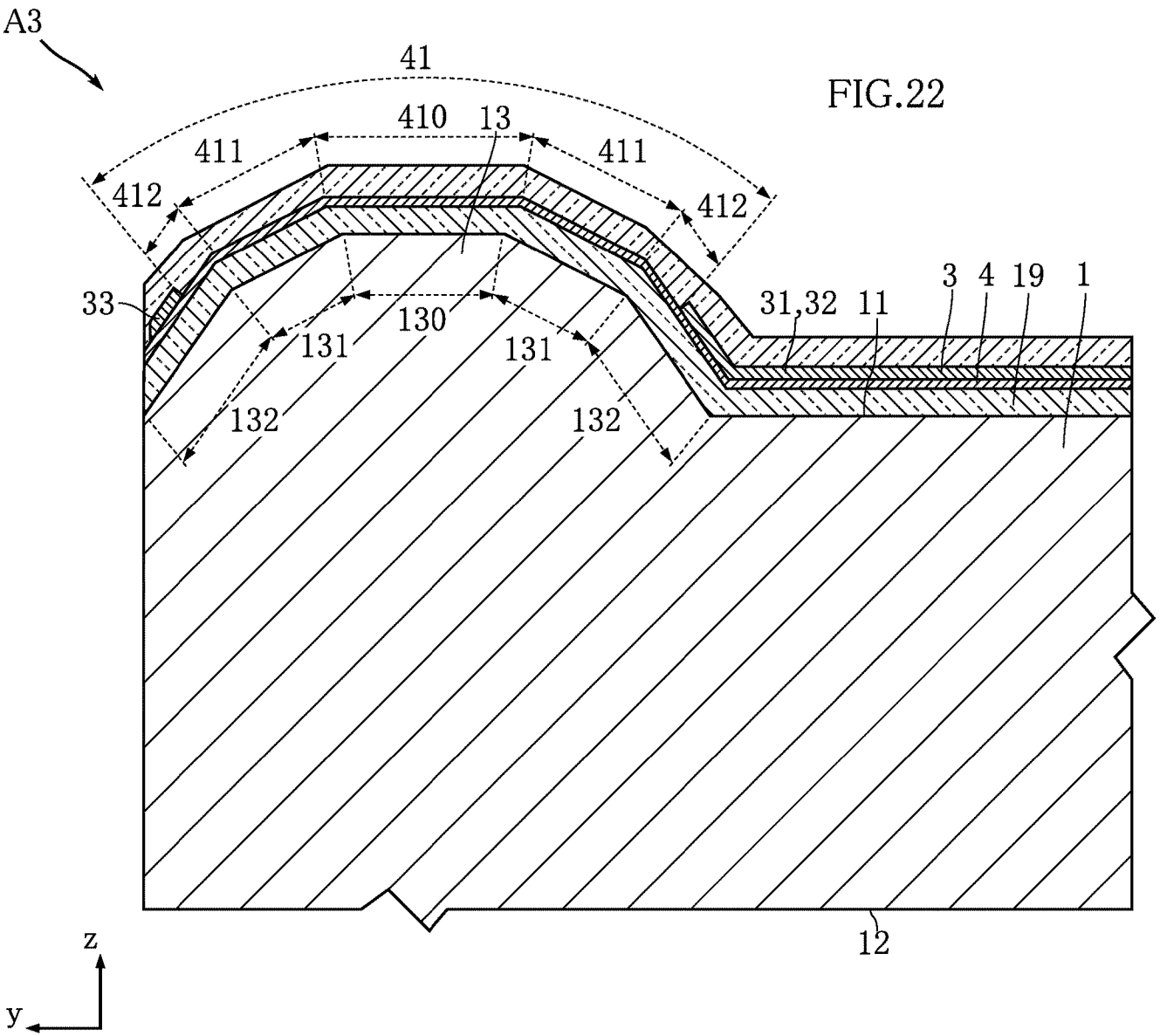
FIG. 22 is across-sectional view taken along line XXII-XXII in FIG. 21.

FIGS. 19 to 22 show a thermal print head according to a third embodiment of the first aspect. FIG. 19 is a cross-sectional view showing a thermal print head A3 according to the present embodiment. FIG. 20 is a main-part cross-sectional view showing the thermal print head A3. FIG. 21 is a main-part enlarged plan view showing the thermal print head A3. FIG. 22 is a main-part enlarged cross-sectional view taken along line XXII-XXII in FIG. 21.

In the present embodiment, a protrusion 13 of a first substrate 1 is in contact with the downstream end of the first substrate 1 in the sub-scanning direction y. That is, in the area more downstream than the protrusion 13 in the sub-scanning direction y, a first obverse surface 11 either does not exist at all or is extremely small as compared to the first obverse surface 11 in the thermal print heads A1 and A2.

As shown in FIG. 21, a wiring layer 3 of the present embodiment has a plurality of individual electrodes 31, a plurality of common electrodes 32, and a plurality of relay electrodes 33.

In the present embodiment, the plurality of individual electrodes 31 and the plurality of common electrodes 32 are arranged upstream in the sub-scanning direction y relative to the plurality of heat generators 41. The plurality of relay electrodes 33 are arranged downstream in the sub-scanning direction y relative to the plurality of heat generators 41. The plurality of individual electrodes 31 and the plurality of common electrodes 32 are arranged substantially in parallel at predetermined pitches in the main scanning direction x. The plurality of relay electrodes 33 are arranged at predetermined pitches in the main scanning direction x. Each of the relay electrodes 33 has a shape constituting an energization path that turns back in the sub-scanning direction y. The relay electrodes 33 overlap with the protrusion 13, but only with the second inclined portions 132 located downstream in the sub-scanning direction y.

In the illustrated example, each of the common electrodes 32 has a branching portion 325 and two strip portions 324. The branching portion 325 is positioned at the downstream end of the common electrode 32 in the sub-scanning direction y, and is connected to two strip portions 324. The branching portion 325 is connected to two heat generators 41 via the two strip portions 324. These two heat generators 41 are adjacent to two relay electrodes 33, respectively. These two relay electrodes 33 are adjacent to another two heat generators 41. In other words, two heat generators 41 are adjacent to the common electrode 32, and on the outer sides of these two heat generators 41 in the main scanning direction x, another two heat generators 41 are arranged. The two heat generators 41 on the outer sides of the other two heat generators 41 are adjacent to two individual electrodes 31, respectively. Such an arrangement provides two energization paths that start from a single common electrode 32, to two heat generators 41, two relay electrodes 33, another two heat generators 41, and two individual electrodes 31. Energizing one of the two individual electrodes 31 can energize and heat the two adjacent heat generators 41 in the main scanning direction x.

In the present embodiment, each of the heat generators 41 has a top portion 410, a pair of first portions 411, and a pair of second portions 412, similarly to the thermal print head A1. The top portion 410 is formed over the entire length of the top portion 130 in the sub-scanning direction y. The heat generator 41 is formed across the boundaries between the top portion 130 and the pair of first inclined portions 131. The pair of first portions 411 are formed over the entire length of the pair of first inclined portions 131 in the sub-scanning direction y. The heat generator 41 is formed across the boundaries between the pair of first inclined portions 131 and the pair of second inclined portions 132. The pair of second portions 412 are formed on only parts of the second inclined portions 132 in the sub-scanning direction y.

As shown in FIG. 19, in the present embodiment, the center 910 of a platen roller 91 is positioned downstream in the sub-scanning direction y relative to the protrusion 13 of the first substrate 1. In this way, the platen roller 91 is pressed against the plurality of heat generators 41 formed on the protrusion 13, via a protective layer 2, in a state of being shifted downstream in the sub-scanning direction y.

The present embodiment can also improve printing quality. Also, since the protrusion 13 is formed at the downstream end of the first substrate 1 in the sub-scanning direction y, the center 910 of the platen roller 91 can be shifted downstream in the sub-scanning direction y relative to the protrusion 13 to avoid interference between the platen roller 91 and the first substrate 1.

Figure 23:
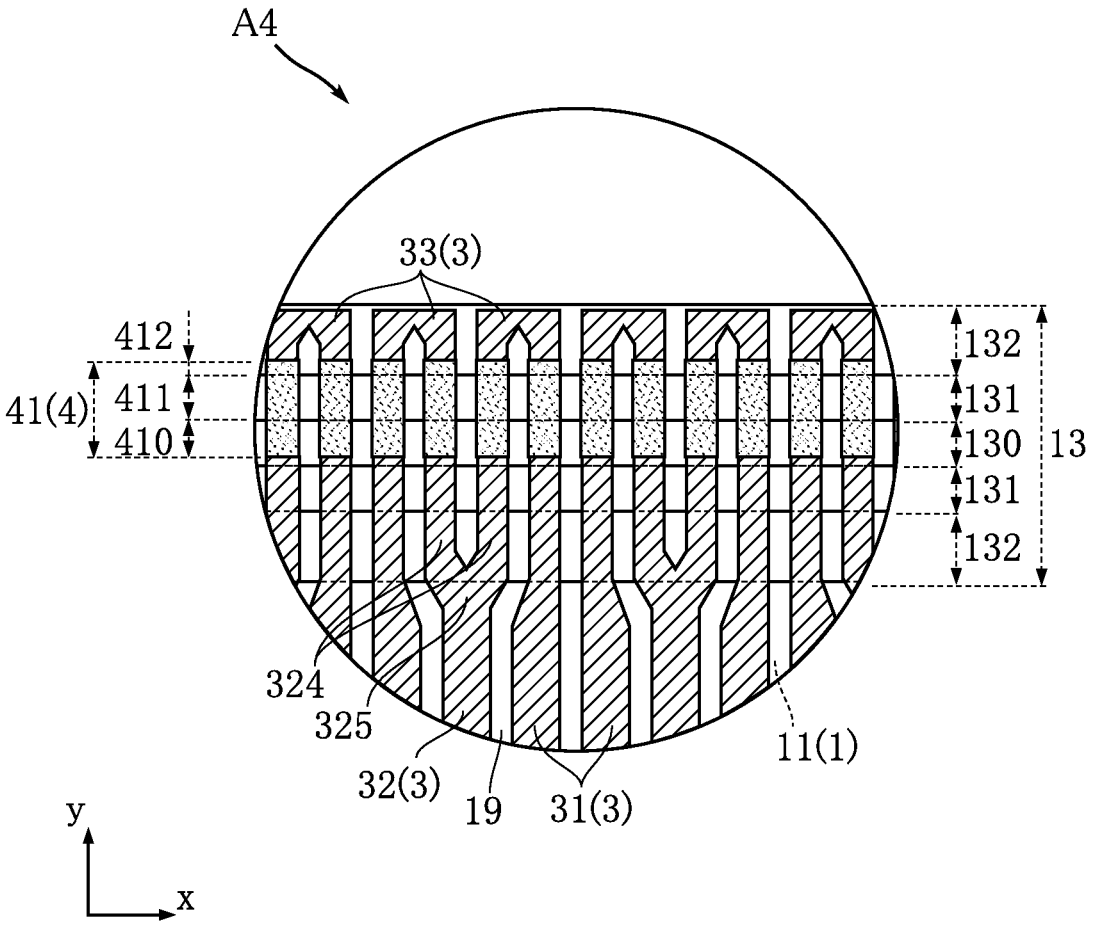
FIG. 23 is a plan view showing a part of a thermal print head according to a fourth embodiment of the first aspect.

FIG. 23 shows a thermal print head according to a fourth embodiment of the first aspect. FIG. 23 is a main-part enlarged plan view showing a thermal print head A4 according to the present embodiment.

In the present embodiment, a wiring layer 3 has a plurality of individual electrodes 31, a plurality of common electrodes 32, and a plurality of relay electrodes 33, similarly to the thermal print head A3. Each of the heat generators 41 has a single top portion 410, a single first portion 411, and a single second portion 412. The top portion 410 is formed on only a part of a top portion 130, which is located more downstream than the remaining part of the top portion 130 in the sub-scanning direction y. In other words, in the present embodiment, the downstream ends of either the individual electrodes 31 or the common electrodes 32 in the sub-scanning direction y overlap with the top portion 130. The first portion 411 is formed on an individual pad 311 located downstream in the sub-scanning direction y, specifically over the entire length of the individual pad 311 in the sub-scanning direction y. The heat generator 41 is formed across the boundary between the top portion 130 and a first inclined portion 131. The second portion 412 is formed on only a part of a second inclined portion 132 located downstream in the sub-scanning direction y, where the part is located upstream in the sub-scanning direction y. In other words, the upstream ends of the relay electrodes 33 in the sub-scanning direction y overlap with the second inclined portions 132 located downstream in the sub-scanning direction y. The heat generator 41 is formed across the boundary between the individual pad 311 located downstream in the sub-scanning direction y and the second inclined portion 132 located downstream in the sub-scanning direction y.

The present embodiment can also improve printing quality. In the present embodiment, the heat generators 41 are shifted to a downstream side of the protrusion 13 in the sub-scanning direction y. This achieves excellent printing quality when the center 910 of a platen roller 91 is shifted downstream in the sub-scanning direction y relative to the protrusion 13. Also, since the heat generators 41 are reduced in length in the sub-scanning direction y, heat is intensively generated in smaller areas of the heat generators 41. This is preferable for clearer printing.

Figure 24:
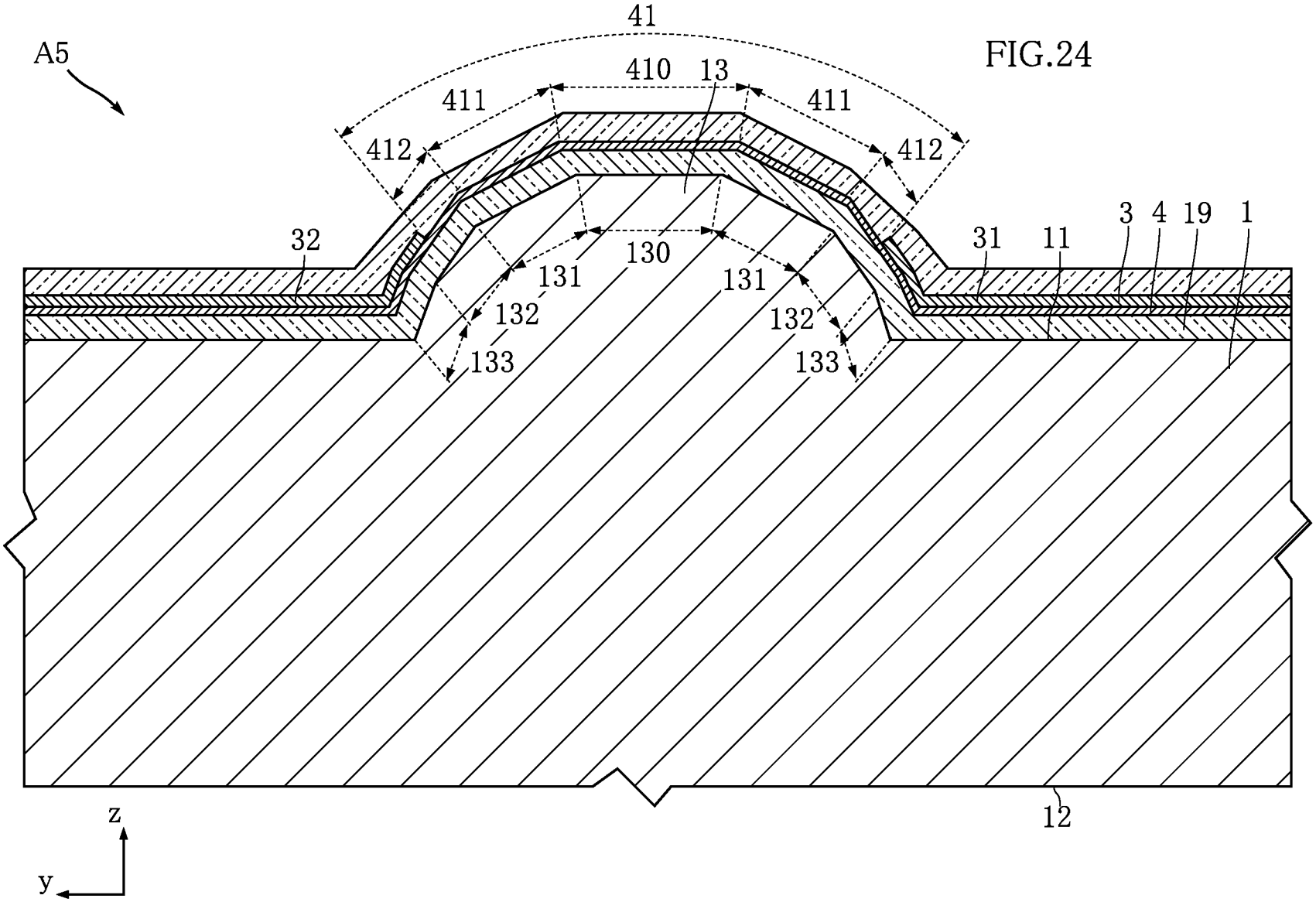
FIG. 24 is a cross-sectional view showing a thermal print head according to a fifth embodiment of the first aspect.

FIG. 24 shows a thermal print head according to a fifth embodiment of the first aspect. FIG. 24 is a main-part enlarged cross-sectional view showing a thermal print head A5 according to the present embodiment.

In the present embodiment, a protrusion 13 of a first substrate 1 has a pair of third inclined portions 133, in addition to a top portion 130, a pair of first inclined portions 131, and a pair of second inclined portions 132. The top portion 130 and the pair of first inclined portions 131 have the same structures as those in the above embodiments. The pair of third inclined portions 133 are interposed between the pair of second inclined portions 132 and the first obverse surface 11. The angles between the pair of third inclined portions 133 and the first obverse surface 11 are larger than the angles between the pair of second inclined portions 132 and the first obverse surface 11.

In the illustrated example, each of the heat generators 41 has a top portion 410, a pair of first portions 411, and a pair of second portions 412. However, the structure of the heat generators 41 is not limited to such. For example, each of the heat generators 41 may have a single top portion 410, a single first portion 411, and a single second portions 412, as seen in the heat generators 41 in thermal print heads A2 and A4.

The present embodiment can also improve the printing quality of the thermal print head A5. As can be understood from the present embodiment, it is possible to employ a structure having other inclined portions, such as the third inclined portions 133, in addition to the top portion 130, the first inclined portions 131, and the second inclined portions 132.

Figure 25:
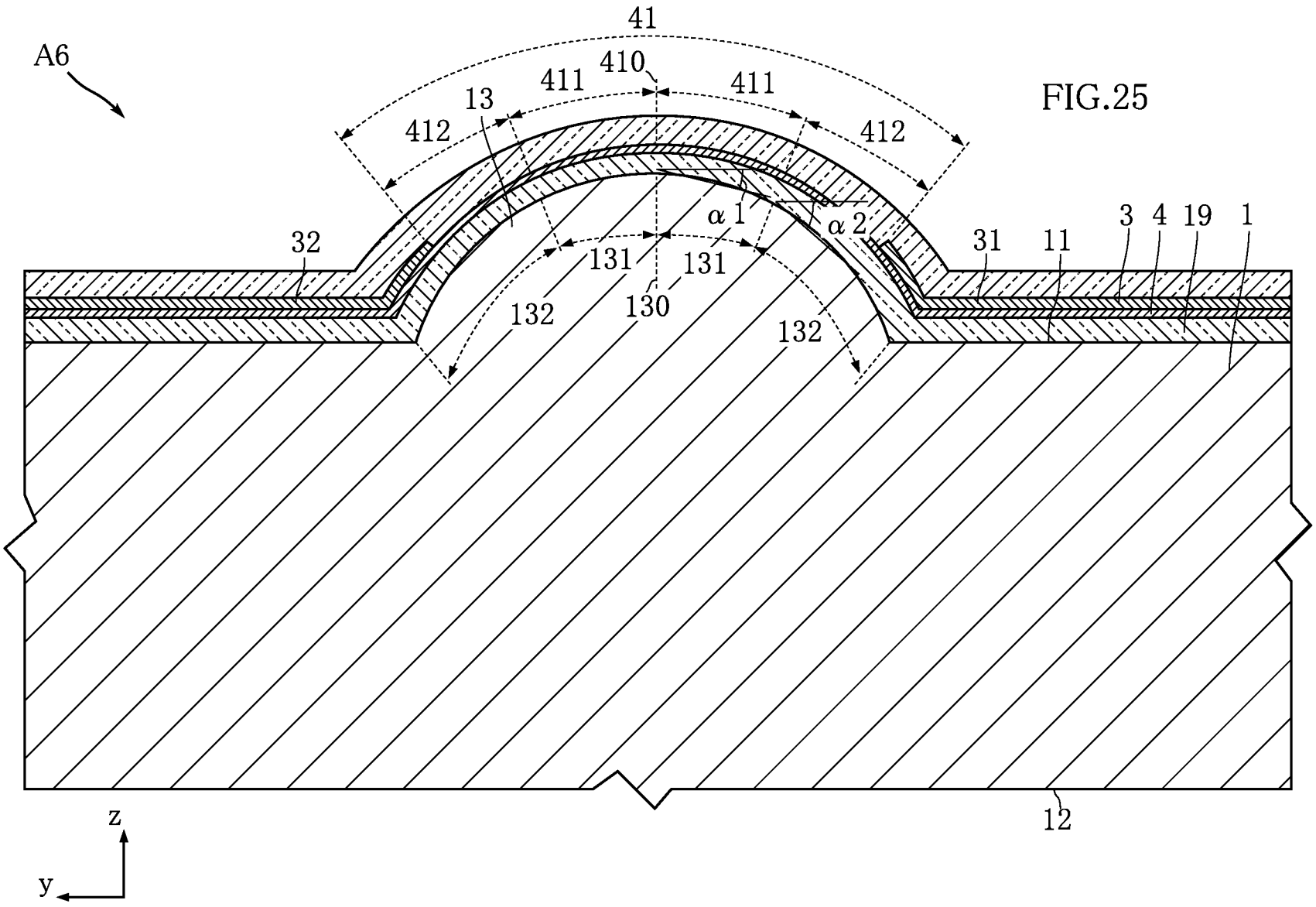
FIG. 25 is a cross-sectional view showing a thermal print head according to a sixth embodiment of the first aspect.

FIG. 25 shows a thermal print head according to a sixth embodiment of the first aspect. FIG. 25 is a main-part enlarged cross-sectional view showing a thermal print head A6 according to the present embodiment.

In the present embodiment, the surface of a protrusion 13 of a first substrate 1 has a curved shape (e.g., circular arc shape) in cross section. The curved protrusion 13 as described above can be approximately configured by a combination of a plurality of planes having different inclination angles, similarly to the above embodiments, or can be configured by a single complete curved plane. Such a protrusion 13 can be formed by, for example, immersing a substrate material 1A made of Si in a mixed acid containing HF, $HNO_3$, and $CH_3COOH$ at a predetermined ratio.

Even in the sixth embodiment, the protrusion 13 can be considered to have a top portion 130, a pair of first inclined portions 131, and a pair of second inclined portions 132. For example, the top portion 130 has the largest distance from the first obverse surface 11 in the thickness direction z, and this top portion corresponds to the apex of the protrusion 13 in the present embodiment. The pair of first inclined portions 131 spread from the top portion 130 to the respective sides in the sub-scanning direction y by a predetermined amount. The pair of second inclined portions 132 are continuous with the pair of first inclined portions 131 and spread to the respective sides in the sub-scanning direction y by a predetermined amount. In the present embodiment, the first inclined portions 131 and the second inclined portions 132 are curved surfaces, such as circular arc surfaces (i.e., non-planar surfaces). In the example shown in FIG. 25, the surface length of each first inclined portion 131 is shorter than the surface length of each second inclined portion 132 in cross section. However, the present disclosure is not limited to such. The angle $\alpha 1$ between each first inclined portion 131 and the first obverse surface 11 is the average inclination angle of the first inclined portion 131 relative to the first obverse surface 11 (e.g., the angle obtained by summing the minimum inclination angle and the maximum inclination angle of the first inclined portion 131 and dividing the summed angle by two, or the angle formed by the straight line connecting the highest point and the lowest point of the first inclined portion 131 and the first obverse surface 11). Similarly, the angle $\alpha 2$ between each second inclined portion 132 and the first obverse surface 11 is the average inclination angle of the second inclined portion 132 relative to the first obverse surface 11. In the present embodiment as well, the angle $\alpha 2$ is larger than the angle $\alpha 1$. Similarly to the above-described protrusion 13, each of the heat generators 41 can be divided into a plurality of portions. In other words, the heat generator 41 can be considered to have a top portion 410, a pair of first portions 411, and a pair of second portions 412. The top portion 410 is formed on the top portion 130 of the protrusion 13. The pair of first portions 411 are formed on the first inclined portions 131, specifically over the entire length of the pair of first inclined portions 131 in the sub-scanning direction y. The pair of second portions 412 are formed on the pair of second inclined portions 132, specifically on only parts of the second inclined portions 132 in the sub-scanning direction y.

The present embodiment can also improve the printing quality of the thermal print head A6. As can be understood from the present embodiment, the protrusion 13 may be constituted of only a curved surface, rather than a plurality of planes.

Figure 26:
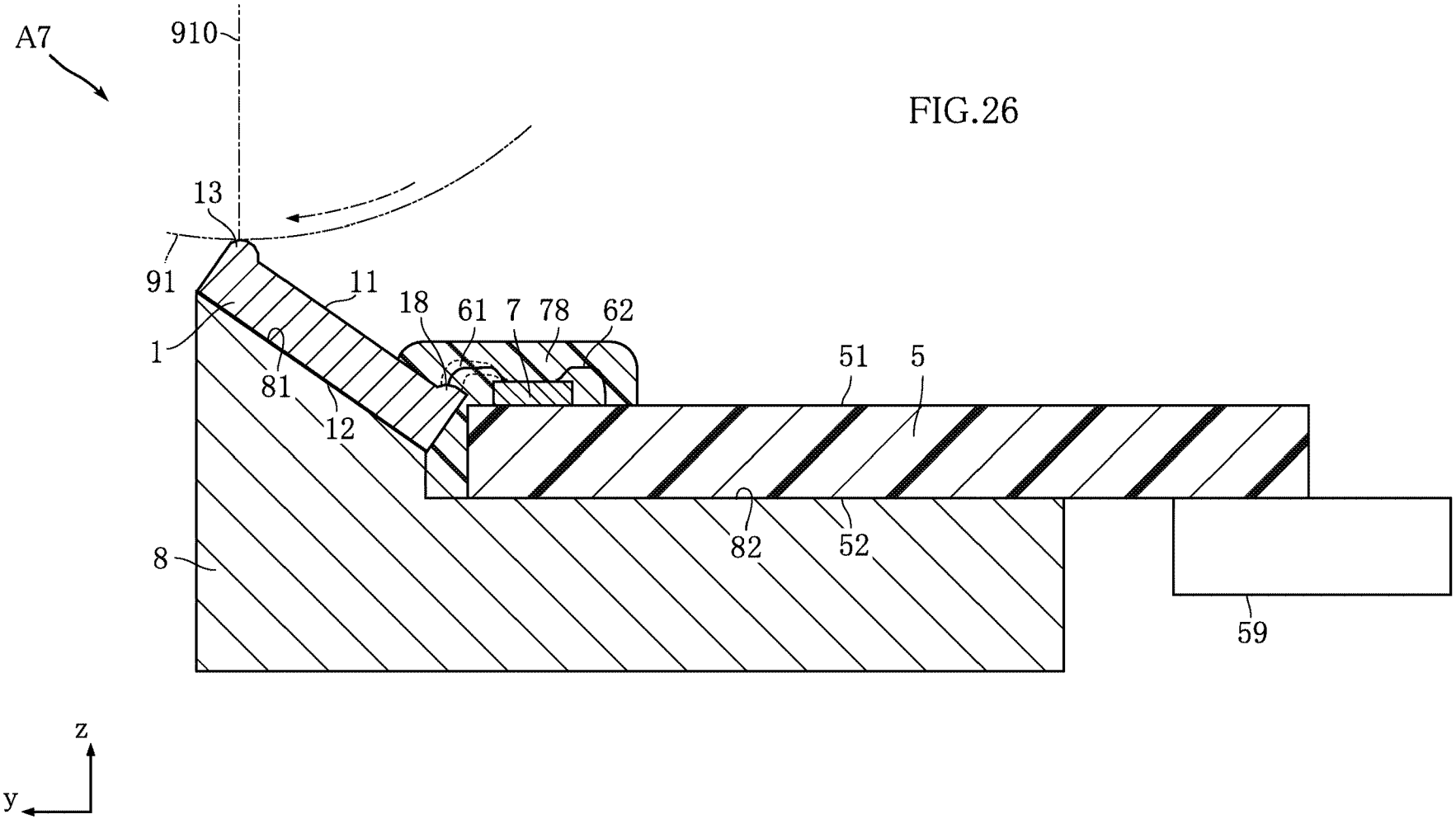
FIG. 26 is a cross-sectional view showing a thermal print head according to a seventh embodiment of the first aspect.
Figure 27:
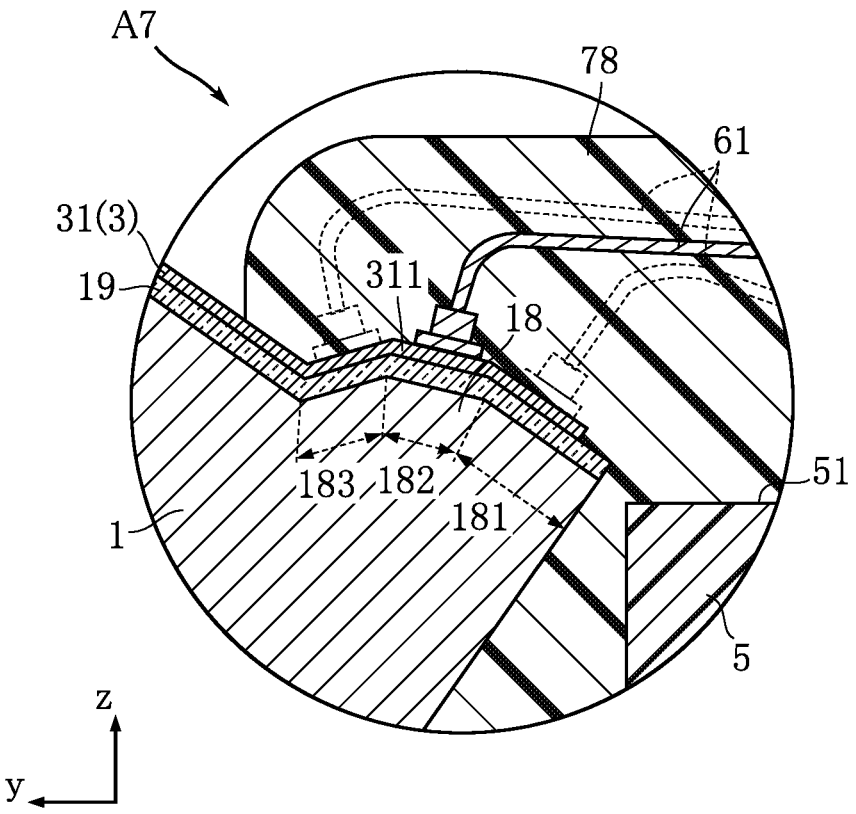
FIG. 27 is a cross-sectional view showing a part of the thermal print head according to the seventh embodiment of the first aspect.
Figure 28:
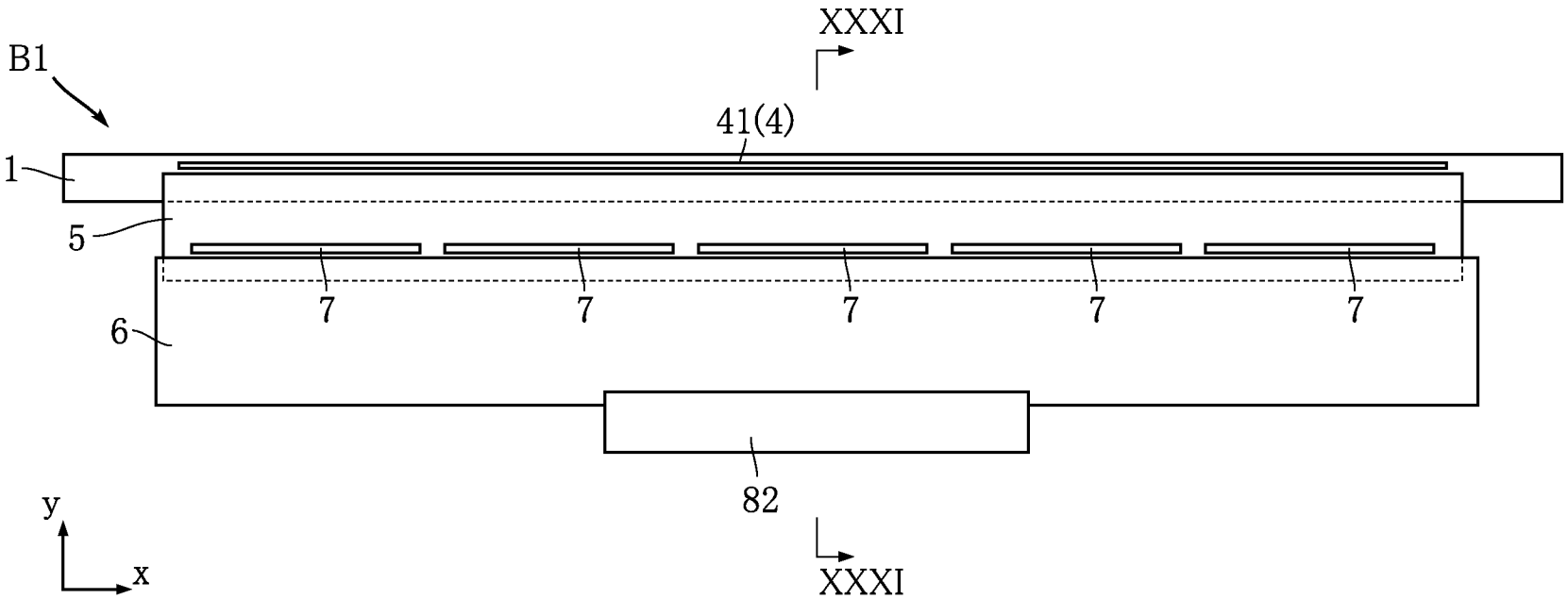
FIG. 28 is a plan view showing a thermal print head according to a first embodiment of a second aspect.
Figure 29:
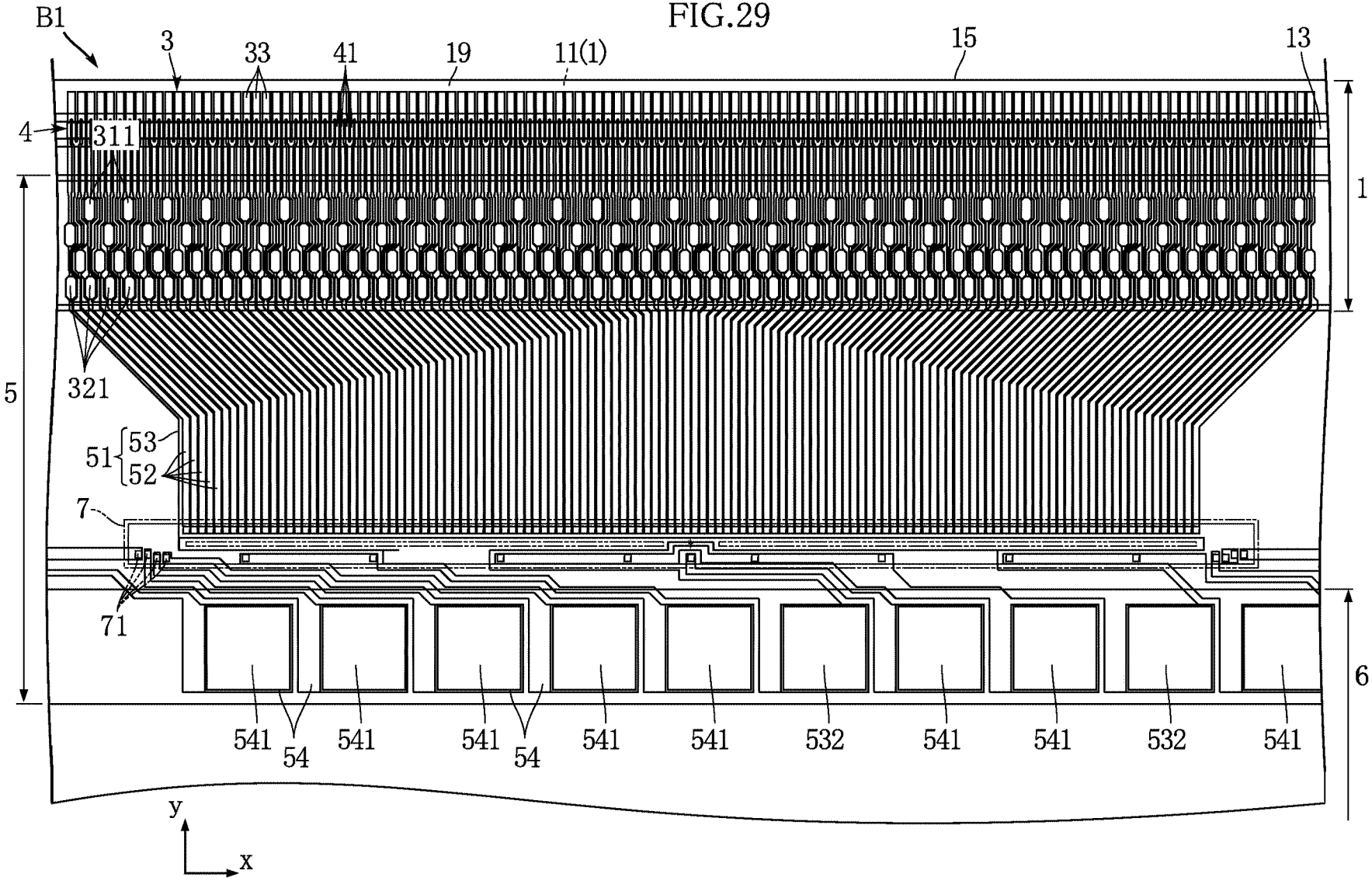
FIG. 29 is a main-part plan view showing the thermal print head according to the first embodiment of the second aspect.

FIGS. 26 and 27 show a thermal print head according to a seventh embodiment of the first aspect. FIG. 26 is a cross-sectional view showing a thermal print head A7 according to the present embodiment, and FIG. 27 is a main-part enlarged cross-sectional view showing the thermal print head A7.

In the present embodiment, the angle between a first obverse surface 11 of a first substrate 1 and a second obverse surface 51 of a second substrate 5 is obtuse. More specifically, the second obverse surface 51 of the second substrate 5 is parallel to the sub-scanning direction y, whereas the first obverse surface 11 of the first substrate 1 is inclined relative to the sub-scanning direction y.

A first supporting surface 81 and a second supporting surface 82 of a heat dissipator 8 form an obtuse angle. The second supporting surface 82 is parallel to the sub-scanning direction y, whereas the first supporting surface 81 is inclined to the sub-scanning direction y.

The first substrate 1 of the present embodiment has the same structure as the first substrates 1 in the above-described thermal print heads A3 and A4. In other words, a protrusion 13 is positioned at the downstream end of the first substrate 1 in the sub-scanning direction y. Since the first substrate 1 is inclined relative to the sub-scanning direction y as described above, the protrusion 13 is located at the highest position on the first substrate 1.

FIG. 27 shows a portion of the first substrate 1 at which individual pads 311 of individual electrodes 31 are formed. In the present example, the first substrate 1 has a pad protrusion 18. The pad protrusion 18 is provided at the upstream end of the first substrate 1 in the sub-scanning direction y. The pad protrusion 18 protrudes from the first obverse surface 11, and has a first plane 181, a second plane 182, and a third plane 183, for example.

The first plane 181 is positioned most upstream among the planes of the pad protrusion 18 in the sub-scanning direction y. The first plane 181 is parallel to the first obverse surface 11, for example. The second plane 182 is connected to the first plane 181 at the downstream side in the sub-scanning direction y. The second plane 182 is inclined relative to the first obverse surface 11 and the first plane 181. The third plane 183 is connected to the second plane 182 at the downstream side in the sub-scanning direction y, and is interposed between the second plane 182 and the first obverse surface 11. The second plane 182 is inclined relative to the first obverse surface 11, the first plane 181, and the second plane 182.

A wiring layer 3 of the present embodiment has a plurality of individual electrodes 31, a plurality of common electrodes 32, and a plurality of relay electrodes 33, similarly to the wiring layers 3 in the thermal print heads A3 and A4. The individual electrodes 31 have the above-described individual pads 311, and the common electrodes 32 also have pads (not shown) similar to the individual pads 311. In the present embodiment, the individual pads 311 of the individual electrodes 31 and the pads of the plurality of common electrodes 32 are arranged on the first plane 181, the second plane 182, and the third plane 183, so that these pads are not arranged along a single straight line (i.e., these pads are arranged alternately). As shown in FIG. 27, a wire 61 indicated by a solid line is connected to the individual pad 311 formed on the second plane 182. On the other hand, wires 61 connected to the pads formed on the first plane 181 and the third plane 183 are indicated by dotted lines. Note that the wires 61 connected to the pads of the common electrodes 32 may be connected to a wiring layer (not shown) of the second substrate 5, instead of driver ICs 7.

The present embodiment can also improve the printing quality of the thermal print head A7. Also, the protrusion 13 on which the heat generators 41 are formed can be arranged at a higher position than the protective resin 78. This makes it possible to avoid interference between a platen roller 91 and the protective resin 78 without shifting the center 910 of the platen roller 91 to the downstream side in the sub-scanning direction y relative to the protrusion 13. In this way, the first substrate 1 can be advantageously downsized in the sub-scanning direction y. Owing to the pad protrusion 18 of the first substrate 1, the entirety of the first substrate 1 can be inclined without causing elements, such as the individual pads 311 to which the wires 61 are bonded, to be excessively inclined relative to the second obverse surface 51. This is preferable for appropriately bonding the wires 61.

Although the thermal print heads according to the first aspect have been described, the thermal print heads according to the present disclosure are not limited to those in the above-described embodiments. Various design changes can be made to the specific structures of the respective components of the thermal print heads.

Next, thermal print heads according to a second aspect will be described with reference to FIGS. 28 to 43.

First, FIGS. 28 to 36 show a thermal print head according to a first embodiment of the second aspect. A thermal print head B1 of the present embodiment includes a main substrate 1, a first wiring layer 3, a resistor layer 4, a flexible wiring substrate 5, a sub-flexible wiring substrate 6, a plurality of driver ICs 7, and a heat dissipator 81. The thermal print head B1 is incorporated in a printer that performs printing on a printing medium (not shown) sandwiched between the thermal print head B1 and a platen roller 91 and conveyed in that state. Examples of such a printing medium include thermal sheets which are used to create barcode sheets and receipts.

The main substrate 1 supports the first wiring layer 3 and the resistor layer 4. The main substrate 1 has a narrow rectangular shape having a length along a main scanning direction x and a width along a sub-scanning direction y. The thickness direction of the main substrate 1 is assumed to be a thickness direction z.

Figure 31:
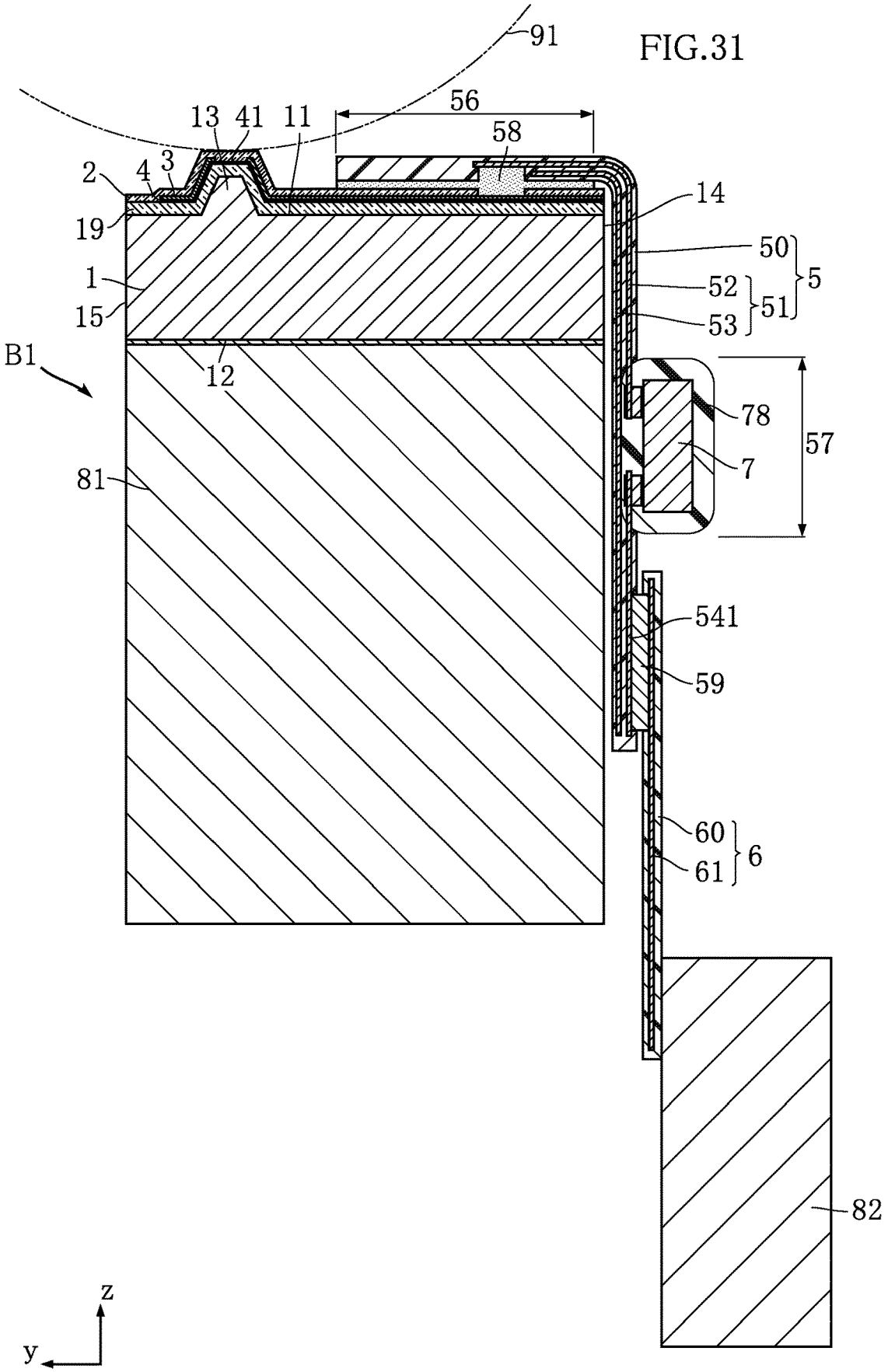
FIG. 31 is across-sectional view taken along line XXXI-XXXI in FIG. 28.
Figure 32:
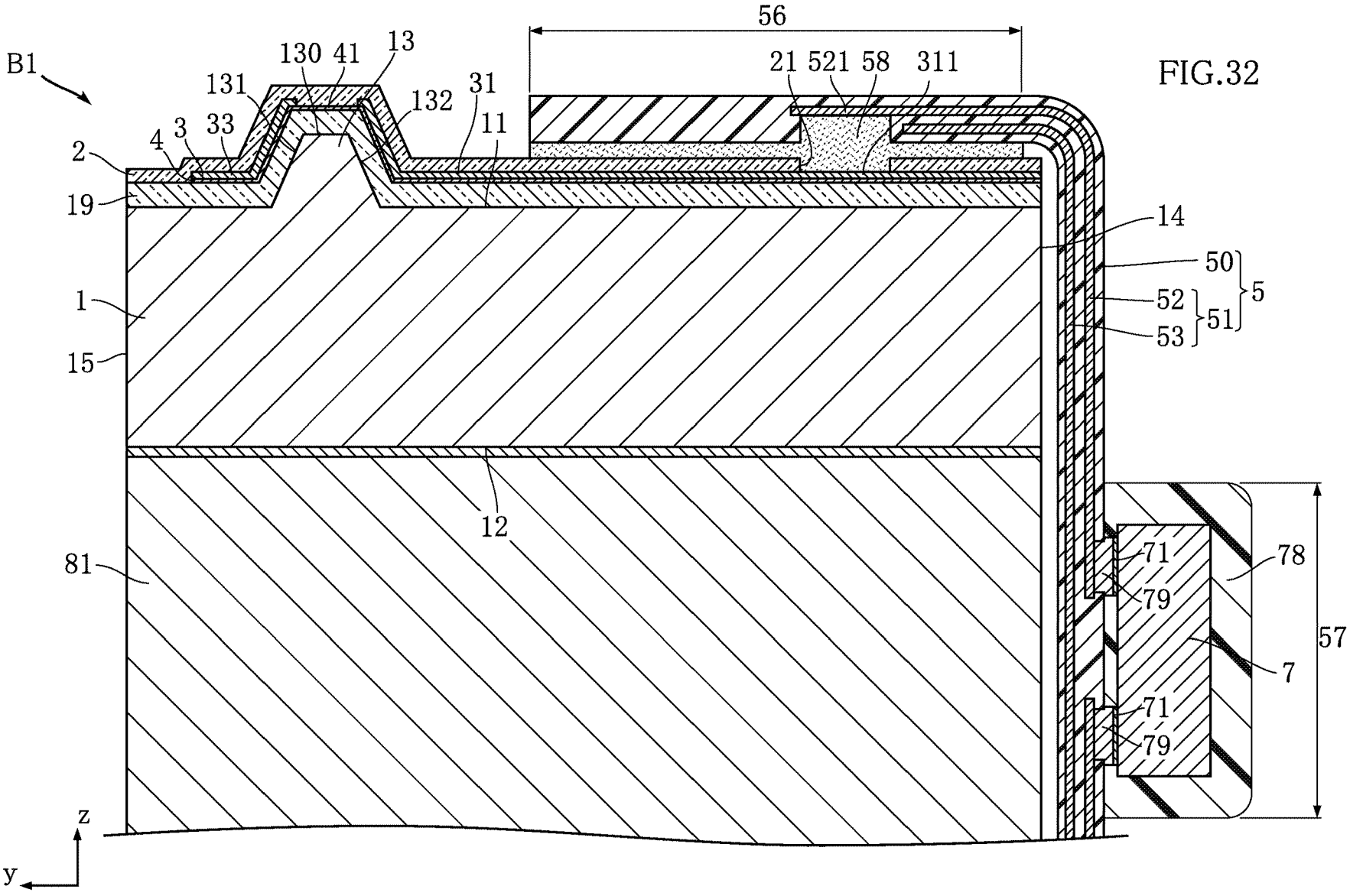
FIG. 32 is a main-part cross-sectional view showing the thermal print head according to the first embodiment of the second aspect.

The main substrate 1 is not particularly limited in terms of material, and is made of Si in the present embodiment. As shown in FIGS. 31 and 32, the main substrate 1 has an obverse surface 11 and a reverse surface 12. The obverse surface 11 and the reverse surface 12 face away from each other in the thickness direction z. The first wiring layer 3 and the resistor layer 4 are formed on the obverse surface 11. In the embodiments of the second aspect, when "a first member is formed (or provided, supported, etc.) on a second member", the first member is not necessarily in direct contact with the second member but may be spaced apart from the second member, similarly to the embodiments according to the first aspect.

Figure 33:
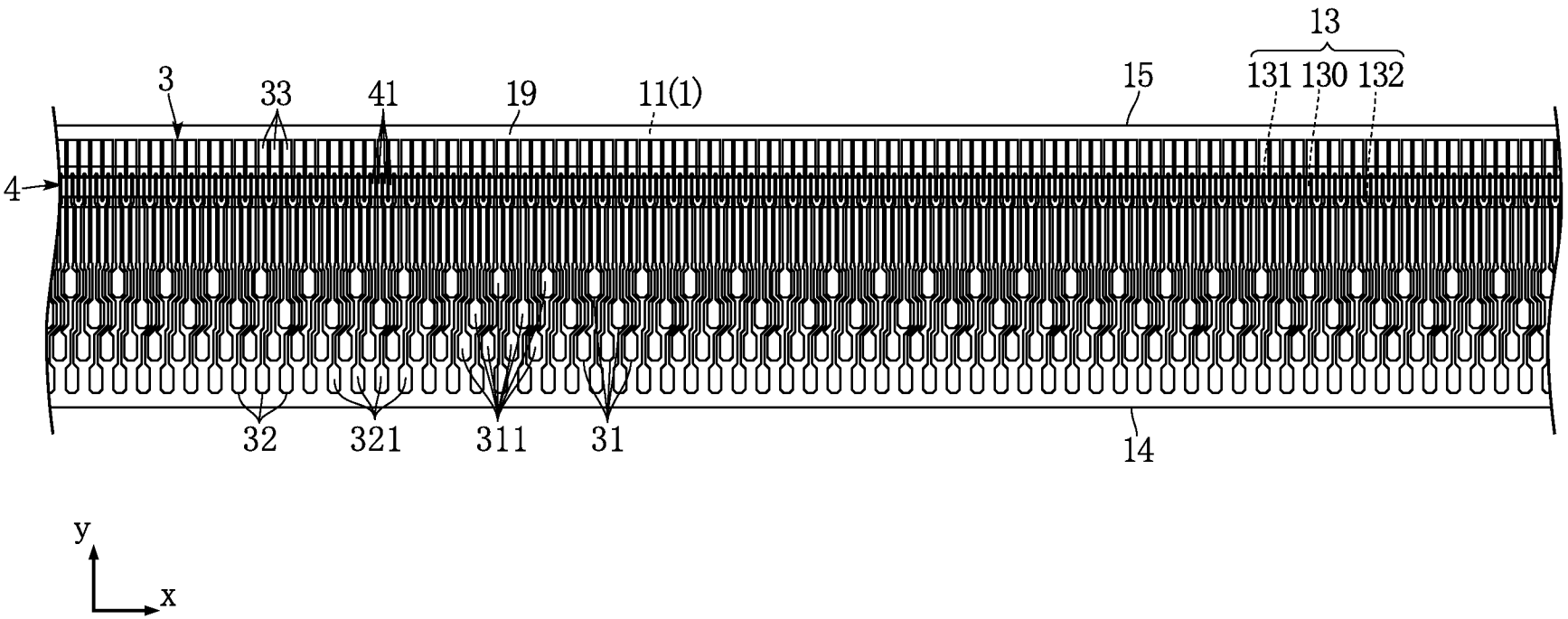
FIG. 33 is a main-part plan view showing a main substrate of the thermal print head according to the first embodiment of the second aspect.

In the present embodiment, the main substrate 1 has a substrate protrusion 13, as shown in FIGS. 31 to 33. The substrate protrusion 13 protrudes from the obverse surface 11 in the thickness direction z, and is elongated in the main scanning direction x. The substrate protrusion 13 has a top surface 130, a first inclined side surface 131, and a second inclined side surface 132, and has a trapezoidal shape in the cross section perpendicular to the main scanning direction x. The top surface 130 faces in the thickness direction, and is parallel to the obverse surface 11 in the illustrated example. The first inclined side surface 131 is interposed between the top surface 130 and the obverse surface 11, and is positioned downstream in the sub-scanning direction y relative to the top surface 130. The first inclined side surface 131 is inclined relative to the top surface 130 and the obverse surface 11. The second inclined side surface 132 is interposed between the top surface 130 and the obverse surface 11, and is positioned upstream in the sub-scanning direction y relative to the top surface 130. The second inclined side surface 132 is inclined relative to the top surface 130 and the obverse surface 11.

As shown in FIGS. 31 and 32, an insulating layer 19 is formed on the main substrate 1, in the present embodiment. The insulating layer 19 covers the obverse surface 11 and the substrate protrusion 13 so as to provide reliable insulation at the side of the obverse surface 11 of the main substrate 1. The insulating layer 19 is made of an insulating material, such as $SiO_2$, SiN or TEOS (tetraethyl orthosilicate). The thickness of the insulating layer 19 is not particularly limited. For example, the insulating layer 19 may have a thickness of 5 μm to 15 μm, preferably about 10 μm.

The dimensions of the main substrate 1 are not particularly limited. As one example, the main substrate 1 may have a dimension of about 2.0 mm to 3.0 mm in the sub-scanning direction y, and a dimension of about 100 mm to 150 mm in the main scanning direction x. The distance between the obverse surface 11 and the reverse surface 12 in the thickness direction z is about 400 μm to 500 μm. The height of the substrate protrusion 13 in the thickness direction z is about 150 μm to 300 μm.

Figure 30:
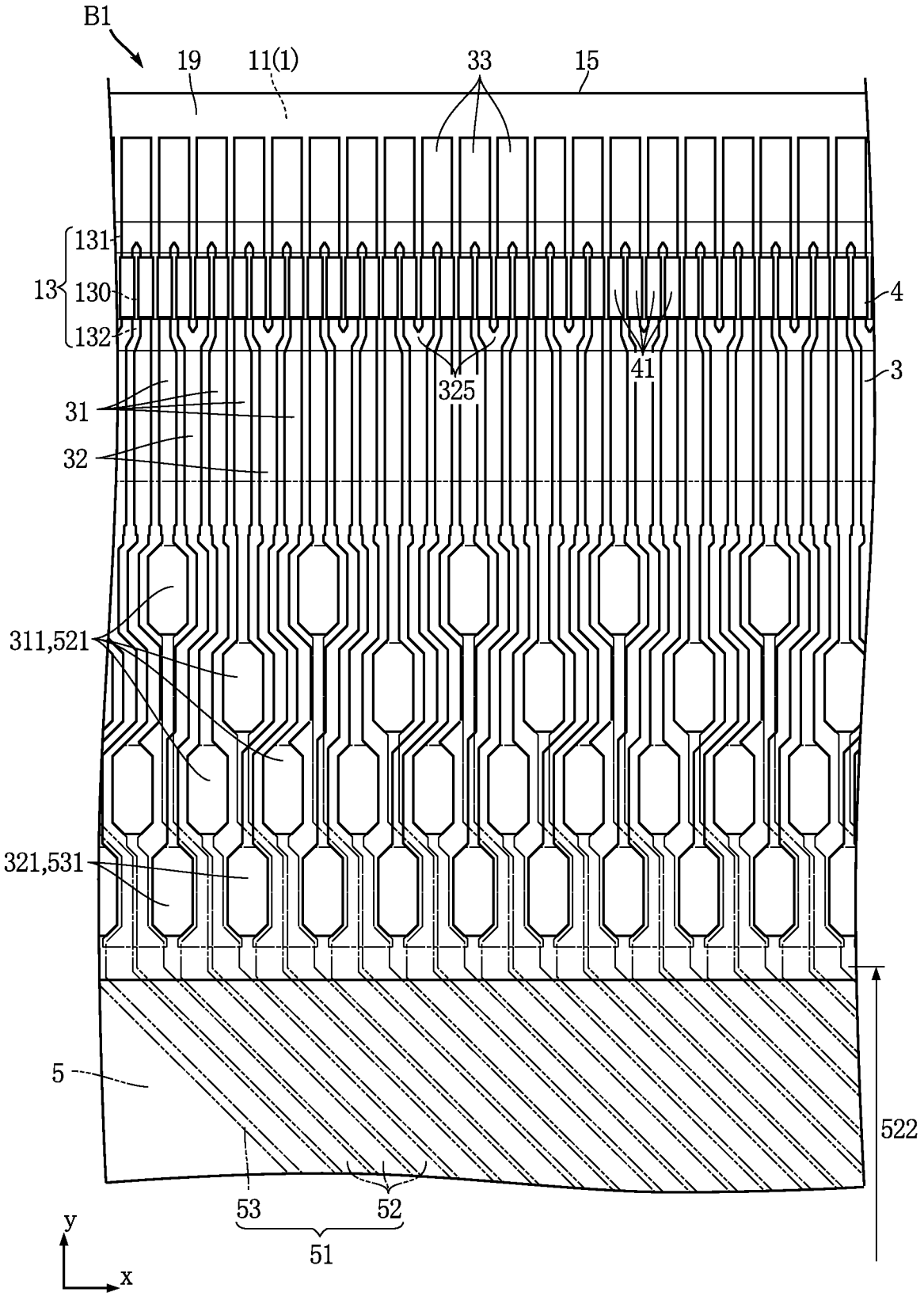
FIG. 30 is a main-part enlarged plan view showing the thermal print head according to the first embodiment of the second aspect.

The resistor layer 4 is supported by the main substrate 1 and stacked on the insulating layer 19. In the present embodiment, the resistor layer 4 is in direct contact with the insulating layer 19. The resistor layer 4 has a plurality of heat generators 41. The plurality of heat generators 41 are individually and selectively energized to locally heat a printing medium. The plurality of heat generators 41 are arranged along the main scanning direction x. The arrangement pitches of the plurality of heat generators 41 are not particularly limited. In the illustrated example, the pitches are in a range of about 70 to 100 μm, such as 84 μm. In the present embodiment, the plurality of heat generators 41 overlap with the substrate protrusion 13 as viewed in the thickness direction z, as shown in FIGS. 30 and 32. More specifically, all of the heat generators 41 overlap with the top surface 130. The resistor layer 4 is made of TaN, for example. The thickness of the resistor layer 4 is not particularly limited. For example, the resistor layer 4 may have a thickness of 0.03 μm to 0.07 μm, and preferably about 0.05 μm.

The heat generators 41 are not particularly limited in terms of shape. In the example shown in FIG. 30, each of the heat generators 41 has a rectangular shape elongated in the sub-scanning direction y.

The first wiring layer 3 forms an energization path for energizing the plurality of heat generators 41. The first wiring layer 3 is supported by the main substrate 1, and is stacked on the resistor layer 4 as shown in FIG. 32. In the present embodiment, the first wiring layer 3 is indirect contact with the resistor layer 4. The first wiring layer 3 is made of a metallic material having a lower resistance than the resistor layer 4, such as Cu. The first wiring layer 3 may include a Cu layer, and a Ti layer interposed between the Cu layer and the resistor layer 4. The thickness of the first wiring layer 3 is not particularly limited, and may be 0.3 μm to 2.0 μm, for example.

As shown in FIGS. 30 and 33, the first wiring layer 3 has a plurality of individual electrodes 31, a plurality of common electrodes 32, and a plurality of relay electrodes 33. In the present embodiment, the resistor layer 4 includes portions exposed from the first wiring layer 3 and located between the plurality of individual electrodes 31 or the common electrodes 32 and the plurality of relay electrodes 33, and these exposed portions serve as the heat generators 41.

In the present embodiment, the plurality of individual electrodes 31 and the plurality of common electrodes 32 are arranged upstream in the sub-scanning direction y relative to the plurality of heat generators 41. The plurality of relay electrodes 33 are arranged downstream in the sub-scanning direction y relative to the plurality of heat generators 41. The plurality of individual electrodes 31 and the plurality of common electrodes 32 are arranged substantially in parallel at predetermined pitches in the main scanning direction x. The plurality of relay electrodes 33 are arranged at predetermined pitches in the main scanning direction x. Each of the relay electrodes 33 has a shape constituting an energization path that turns back in the sub-scanning direction y.

In the illustrated example, each of the common electrodes 32 has a branching portion 325. The branching portion 325 is positioned at the downstream end of the common electrode 32 in the sub-scanning direction y, and is branched into two portions. The branching portion 325 of the common electrode 32 is adjacent to two heat generators 41. These two heat generators 41 are adjacent to two relay electrodes 33, respectively. These two relay electrodes 33 are adjacent to another two heat generators 41. In other words, two heat generators 41 are adjacent to the common electrode 32, and on the outer sides of these two heat generators 41 in the main scanning direction x, another two heat generators 41 are arranged. The two heat generators 41 on the outer sides of the other two heat generators 41 are adjacent to two individual electrodes 31, respectively. Such an arrangement provides two energization paths that start from a single common electrode 32, to two heat generators 41, two relay electrodes 33, and another two heat generators 41. Energizing one of the two individual electrodes 31 can energize and heat the two adjacent heat generators 41 in the main scanning direction x.

The individual electrodes 31 have individual pads 311. The individual pads 311 are formed at the upstream ends of the individual electrodes 31 in the sub-scanning direction y. The individual pads 311 are partially enlarged portions at each of which the dimension in the main scanning direction x is increased. In the illustrated example, each of the individual pads 311 has a substantially octagonal shape. Also, in the illustrated example, each of the individual pads 311 of the plurality of individual electrodes 31 is located at one of three different positions in the sub-scanning direction y.

The common electrodes 32 have common pads 321. The common pads 321 are formed at the upstream ends of the common electrodes 32 in the sub-scanning direction y. The common pads 321 are partially enlarged portions at each of which the dimension in the main scanning direction x is increased. In the illustrated example, each of the individual pads 311 has a substantially octagonal shape. Also, in the illustrated example, the common pads 321 of the plurality of common electrodes 32 are located more upstream in the sub-scanning direction y than the individual pads 311 of the plurality of individual electrodes 31, and the positions of the common pads 321 in the sub-scanning direction y are substantially the same.

The average of the arrangement pitches of the plurality of individual electrodes 31 and the plurality of common electrodes 32 having the above-described structures is substantially the same as the arrangement pitches of the plurality of heat generators 41. Also, the average of the arrangement pitches of the individual pads 311 of the plurality of individual electrodes 31 and the common pads 321 of the plurality of common electrodes 32 is substantially the same as the arrangement pitches of the plurality of heat generators 41.

A protective layer 2 covers the first wiring layer 3 and the resistor layer 4. The protective layer 2 is made of an insulating material, and protects the first wiring layer 3 and the resistor layer 4. The protective layer 2 may be made of $SiO_2$. The thickness of the protective layer 2 is not particularly limited. For example, the protective layer 2 may have a thickness of 0.8 μm to 2.0 μm, and preferably about 1.0 μm. Note that the protective layer 2 is not necessarily a single layer but may be made up of a plurality of layers. For example, the protective layer 2 may include a surface layer that is made of AlN.

As shown in FIG. 32, in the present embodiment, the protective layer 2 has a plurality of pad openings 21. The plurality of pad openings 21 penetrate through the protective layer 2 in the thickness direction z. The plurality of pad openings 21 expose the plurality of individual pads 311 of the individual electrodes 31, and the plurality of common pads 321 of the common electrodes 32. FIG. 32 shows an example of the pad openings 21 that expose the individual pads 311 of the individual electrodes 31. The pad openings 21 that expose the common pads 321 of the common electrodes 32 have the same structure as the pad openings 21 shown in FIG. 32.

The flexible wiring substrate 5 is joined to the main substrate 1 as shown in FIGS. 28 to 32, and has an insulating layer 50 and a second wiring layer 51. The flexible wiring substrate 5 has excellent flexibility with appropriate selection of materials for the insulating layer 50 and the second wiring layer 51.

The insulating layer 50 is made of a highly flexible insulating material, such as polyimide. The insulating layer protects the second wiring layer 51 from unintended conduction.

Figure 34:
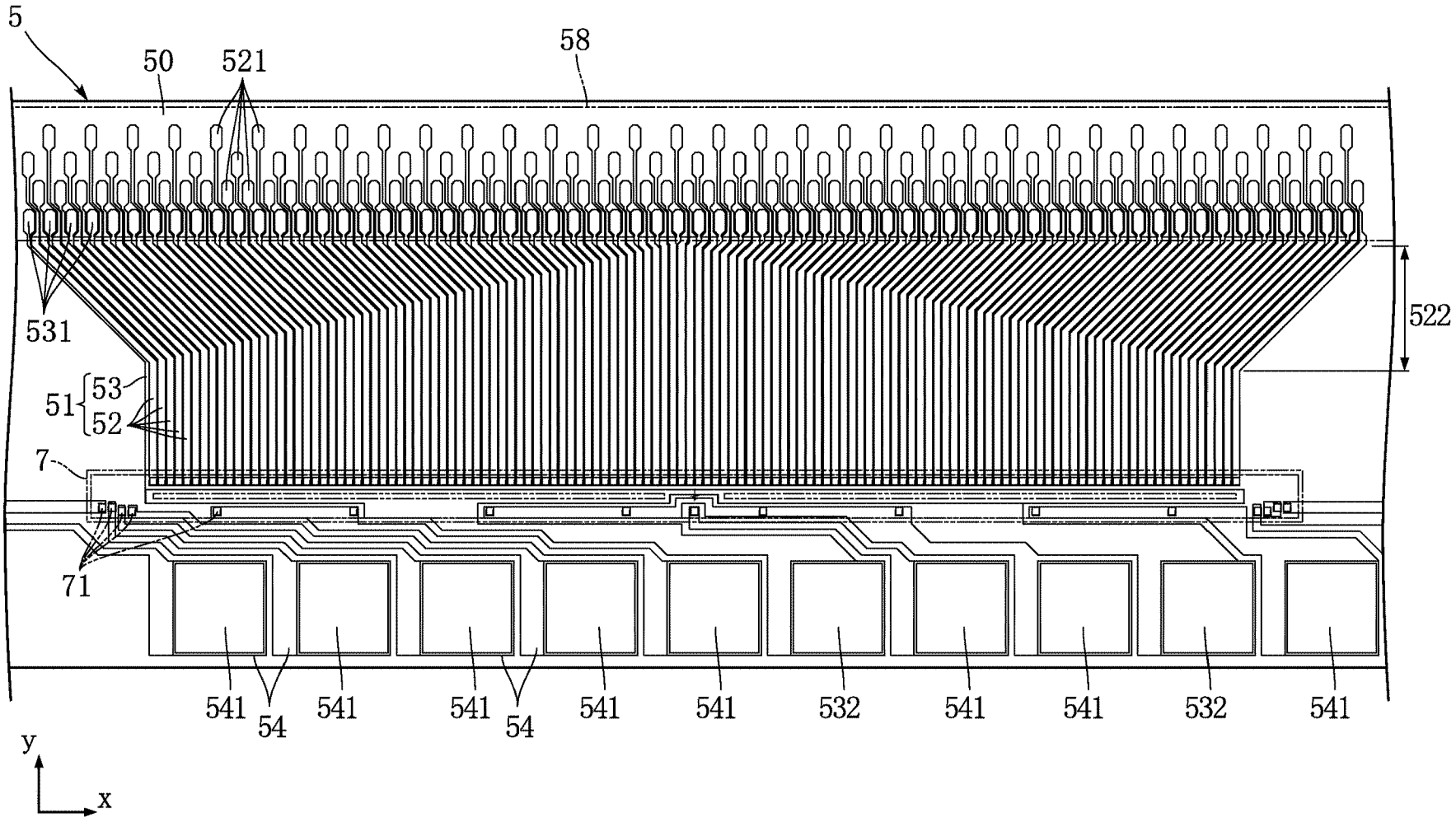
FIG. 34 is a main-part plan view showing a flexible wiring substrate of the thermal print head according to the first embodiment of the second aspect.
Figure 35:
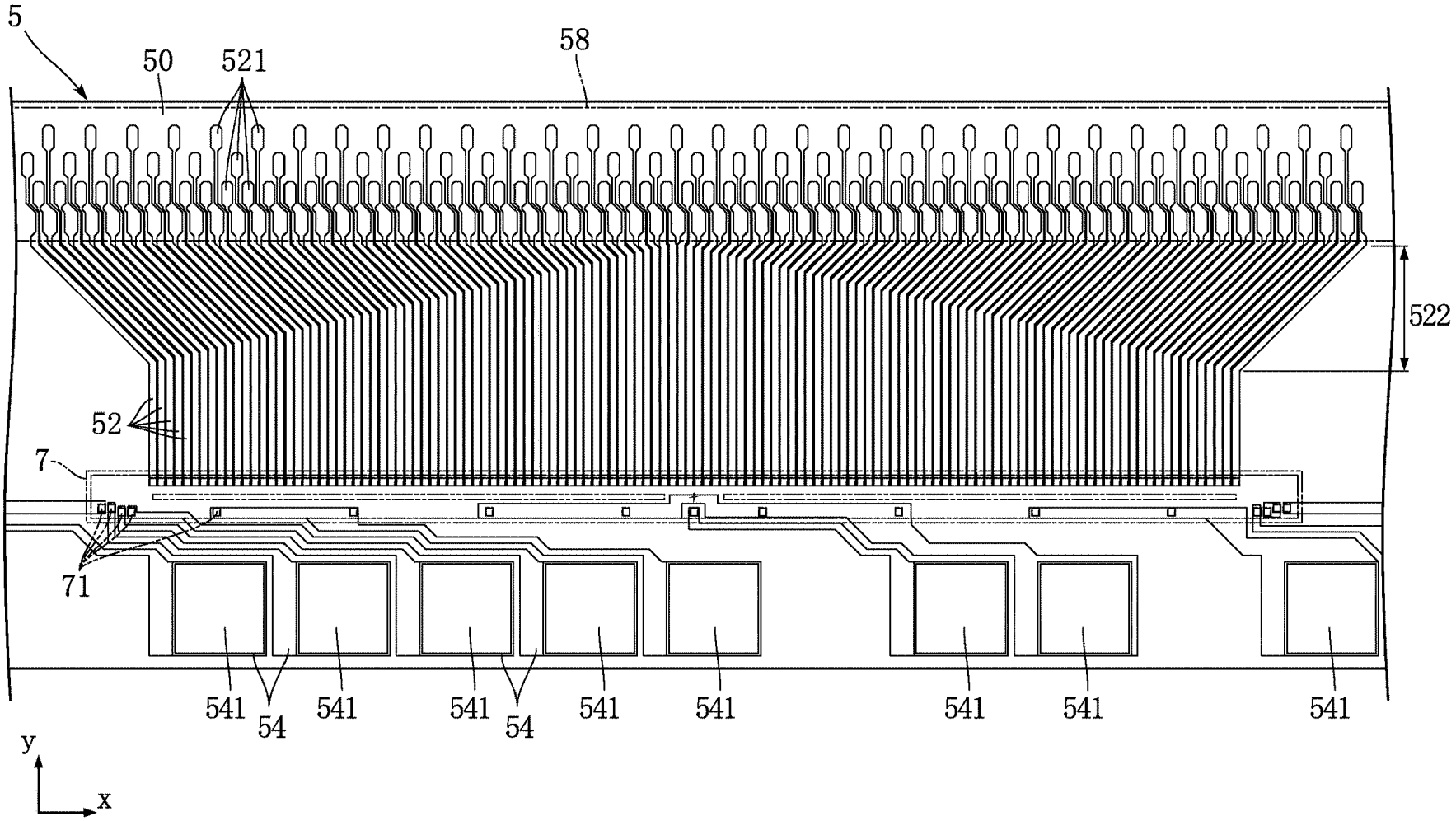
FIG. 35 is a main-part plan view showing individual wires and input/output wires of the flexible wiring substrate of the thermal print head according to the first embodiment of the second aspect.
Figure 36:
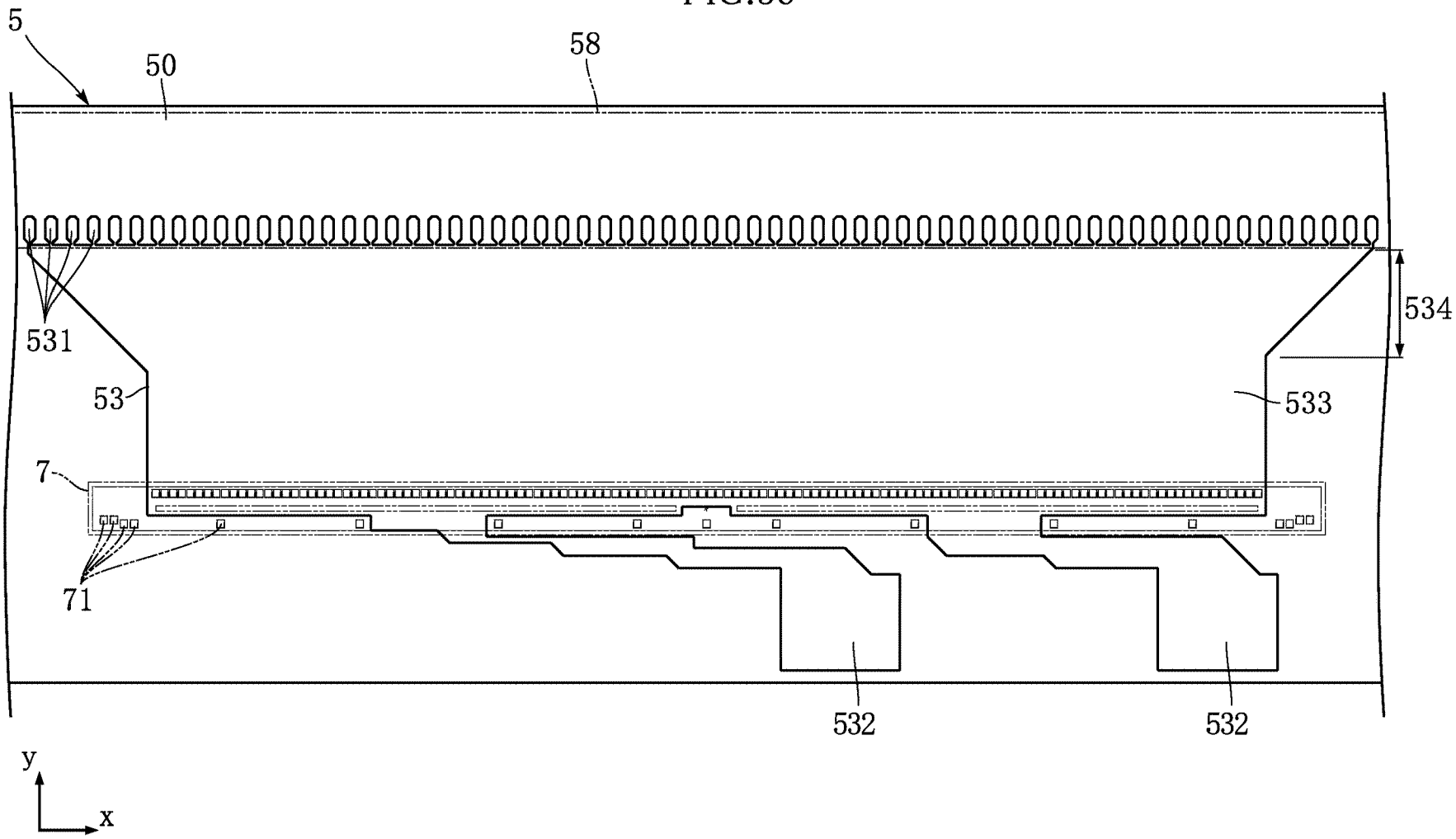
FIG. 36 is a main-part plan view showing a common wire of the flexible wiring substrate of the thermal print head according to the first embodiment of the second aspect.

The second wiring layer 51 and the first wiring layer 3 constitute an energization path to the plurality of heat generators 41. The second wiring layer 51 may be a foil made of metal, such as Cu, patterned into a predetermined shape. As shown in FIG. 32 and FIGS. 34 to 36, the second wiring layer 51 has a plurality of individual wires 52, a common wire 53, and a plurality of input/output wires 54. FIG. 34 shows the entirety of the flexible wiring substrate 5. FIG. 35 shows the insulating layer 50, the plurality of individual wires 52, and the plurality of input/output wires 54. FIG. 36 shows the insulating layer 50 and the common wire 53. In the present embodiment, the plurality of individual wires 52 and the plurality of input/output wires 54 are formed of metal foils located at the same position in the thickness direction of the sub-flexible wiring substrate 6, and the common wire 53 is formed of a metal foil located at a position differing from where the plurality of individual wires 52 and the plurality of input/output wires 54 are located. In other words, the plurality of individual wires 52 and the plurality of input/output wires 54 form the same layer, and the common wire 53 forms a layer differing therefrom.

The plurality of individual wires 52 are electrically connected to the plurality of individual electrodes 31 of the first wiring layer 3, and constitute an energization path between the plurality of heat generators 41 and the driver ICs 7, together with the plurality of individual electrodes 31. As shown in FIGS. 32 and 35, the plurality of individual wires 52 have individual pads 521. The individual pads 521 are provided at the downstream ends of the individual wires 52 in the sub-scanning direction y. The individual pads 521 are partially enlarged portions at each of which the dimension in the main scanning direction x is increased. In the illustrated example, each of the individual pads 521 has a substantially octagonal shape. The individual pads 521 are exposed from the insulating layer 50. Note that the individual pads 521 may be made up of portions of the individual wires 52 exposed from the insulating layer 50 and plating layers appropriately stacked on the exposed portions. As shown in FIGS. 30, 32, and 35, the individual pads 521 of the plurality of individual wires 52 overlap with the individual pads 311 of the individual electrodes 31 as viewed in the thickness direction z.

The upstream ends of the plurality of individual wires 52 in the sub-scanning direction y are exposed from the insulating layer 50. These exposed portions are for joining to the driver ICs 7.

In the present embodiment, a pitch changing portion 522 is provided between the main substrate 1 and the driver ICs 7. In the pitch changing portion 522, the pitches of the plurality of individual wires 52 in the main scanning direction x decrease from the main substrate 1 toward the driver ICs 7. For example, in the pitch changing portion 522, the pitches in the main scanning direction x at the downstream side in the sub-scanning direction y (at the side closer to the main substrate 1) are about 84 μm, and the pitches in the main scanning direction x at the upstream side in the sub-scanning direction y (at the side closer to the driver ICs 7) are about 64 μm.

The plurality of input/output wires 54 constitute an energization path between the driver ICs 7 and the sub-flexible wiring substrate 6. The plurality of input/output wires 54 are located more upstream in the sub-scanning direction y than the plurality of individual wires 52. The number of input/output wires 54 is smaller than the number of individual wires 52. This is because the number of individual wires 52 is set according to the number of heat generators 41, whereas the number of input/output wires 54 is set according to the number of signals input to/output from the driver ICs 7 from/to the outside the thermal print head B1.

The input/output wires 54 have input/output pads 541. The input/output pads 541 are for electrically connecting to the sub-flexible wiring substrate 6, and have partially large dimensions in the main scanning direction x and the sub-scanning direction y. In the illustrated example, each of these pads 541 has a rectangular shape as viewed in the thickness direction z. The input/output pads 541 are larger than the individual pads 521 of the individual wires 52. The plurality of input/output pads 541 are exposed from the insulating layer 50. Note that the plurality of input/output pads 541 may be made up of portions of the input/output wires 54 exposed from the insulating layer 50, and plating layers (not shown) appropriately stacked on the exposed portions.

The common wire 53 is electrically connected to the plurality of common electrodes 32 of the first wiring layer 3, and constitutes an energization path to the plurality of heat generators 41, together with the plurality of common electrodes 32. As shown in FIGS. 32 and 36, the common wire 53 has a plurality of common pads 531, a plurality of common pads 532, and an aggregated portion 533.

The plurality of common pads 531 are provided at the downstream ends of the common wire 53 in the sub-scanning direction y. The plurality of common pads 531 are arranged at predetermined pitches in the main scanning direction x, and in the illustrated example, have the same size and shape as the individual pads 521 of the plurality of individual wires 52. Each of the common pads 531 has a substantially octagonal shape in the illustrated example. The plurality of common pads 531 are exposed from the insulating layer 50. Note that the plurality of common pads 531 may be made up of portions of the common wire 53 exposed from the insulating layer 50, and plating layers (not shown) appropriately stacked on the exposed portions. As shown in FIGS. 30, 32, and 36, the plurality of common pads 531 of the common wire 53 overlap with the common pads 321 of the plurality of common electrodes 32 as viewed in the thickness direction z.

The plurality of common pads 532 are provided at the upstream ends of the common wire 53 in the sub-scanning direction y. The plurality of common pads 532 are arranged in the main scanning direction x at predetermined pitches, along with the input/output pads 541 of the plurality of input/output wires 54. In the illustrated example, the common pads 531 have the same size and shape as the input/output pads 541. The plurality of common pads 531 are exposed from the insulating layer 50. Note that the input/output pads 541 may be made up of portions of the input/output wires 54 exposed from the insulating layer 50, and plating layers (not shown) appropriately stacked on the exposed portions.

The aggregated portion 533 connects the plurality of common pads 531 and the plurality of common pads 532. At this aggregated portion 533, energization paths connecting the plurality of common pads 531 and the plurality of common pads 532 are aggregated. In the present embodiment, the aggregated portion 533 has a shape that overlaps with the plurality of individual wires 52. The aggregated portion 533 has a tapered portion 534. The tapered portion 534 is where the dimension in the main scanning direction x decreases from the plurality of common pads 531 toward the plurality of common pads 532. The tapered portion 534 overlaps with the pitch changing portion 522 of the individual wires 52.

As shown in FIGS. 31, 32, and 34, the flexible wiring substrate 5 is joined to the main substrate 1 with an anisotropic conductive joint material 58. The anisotropic conductive joint material 58 may be formed by mixing conductive microparticles into an insulating material (main material). The anisotropic conductive joint material 58 exhibits a joining force for joining multiple objects, and also exhibits conductivity in a limited direction (in the present embodiment, in a direction pressed during joining). In the illustrated example, portions at which the flexible wiring substrate 5 overlaps with the main substrate 1 are joined by the anisotropic conductive joint material 58. A portion of the flexible wiring substrate 5 that is bonded to the main substrate 1 is referred to as a fixed portion 56. Also, in the illustrated example, a portion of the flexible wiring substrate 5 is located more upstream in the sub-scanning direction y than the fixed portion 56, and this portion is bent to lie along the thickness direction z. In order for the flexible wiring substrate 5 to have the posture depicted in figures, the flexible wiring substrate 5 and either a substrate end surface 14 of the main substrate 1 or the heat dissipator 81 may be bonded together with an adhesive or the like. Since the flexible wiring substrate 5 has flexibility, it can take postures other than the depicted posture as necessary. For example, the flexible wiring substrate 5 may lie along the main scanning direction x and the sub-scanning direction y.

The individual pads 311 of the plurality of the individual electrodes 31 at the first wiring layer 3 are electrically connected to the respective individual pads 521 of the plurality of individual wires 52 at the flexible wiring substrate 5 via the anisotropic conductive joint material 58. Also, the common pads 321 of the plurality of common electrodes 32 at the first wiring layer 3 are electrically connected to the respective common pads 531 of the common wire 53 at the flexible wiring substrate 5 via the anisotropic conductive joint material 58.

The driver ICs 7 are electrically connected to the first wiring layer 3 so as to individually energize the plurality of heat generators 41 via the plurality of individual electrodes 31. The driver ICs 7 perform energization control according to an instruction signal input from outside the thermal print head B1, via the flexible wiring substrate 5 and the sub-flexible wiring substrate 6. The driver ICs 7 are mounted on the sub-flexible wiring substrate 6. As shown in FIG. 31, the portion of the flexible wiring substrate 5 on which the driver ICs 7 are mounted is referred to as a mount portion 57. The mount portion 57 extends along a direction intersecting the obverse surface 11 of the main substrate 1, and in the illustrated example, extends along the thickness direction z.

Each of the driver ICs 7 has a plurality of electrodes 71. The plurality of electrodes 71 are electrically joined to the plurality of common wires 53 and the plurality of input/output wires 54 via a conductive joint material 79. The conductive joint material 79 may be solder but is not limited thereto. For example, the conductive joint material 79 may be the same joint material as the anisotropic conductive joint material 58.

The driver ICs 7 are covered with a protective resin 78. The protective resin 78 may be a black insulating resin.

The sub-flexible wiring substrate 6 is joined to the flexible wiring substrate 5, and is used for inputting and outputting signals between the outside of the thermal print head B1 and the driver ICs 7 and for electrically connecting the common wire 53 and an element outside the thermal print head B1.

The sub-flexible wiring substrate 6 includes an insulating layer 60 and a third wiring layer 61, and has flexibility similarly to the flexible wiring substrate 5.

As with the insulating layer 50, the insulating layer 60 is made of a highly flexible insulating material, such as polyimide. The insulating layer 60 protects the third wiring layer 61 from unintended conduction. The third wiring layer 61 is electrically connected to the second wiring layer 51 of the flexible wiring substrate 5.

In the present embodiment, a connector 82 is attached to the sub-flexible wiring substrate 6. The connector 82 is used to connect the thermal print head B1 to a printer. The connector 82 has a plurality of terminals (not shown) electrically connected to the third wiring layer 61.

Figure 37:
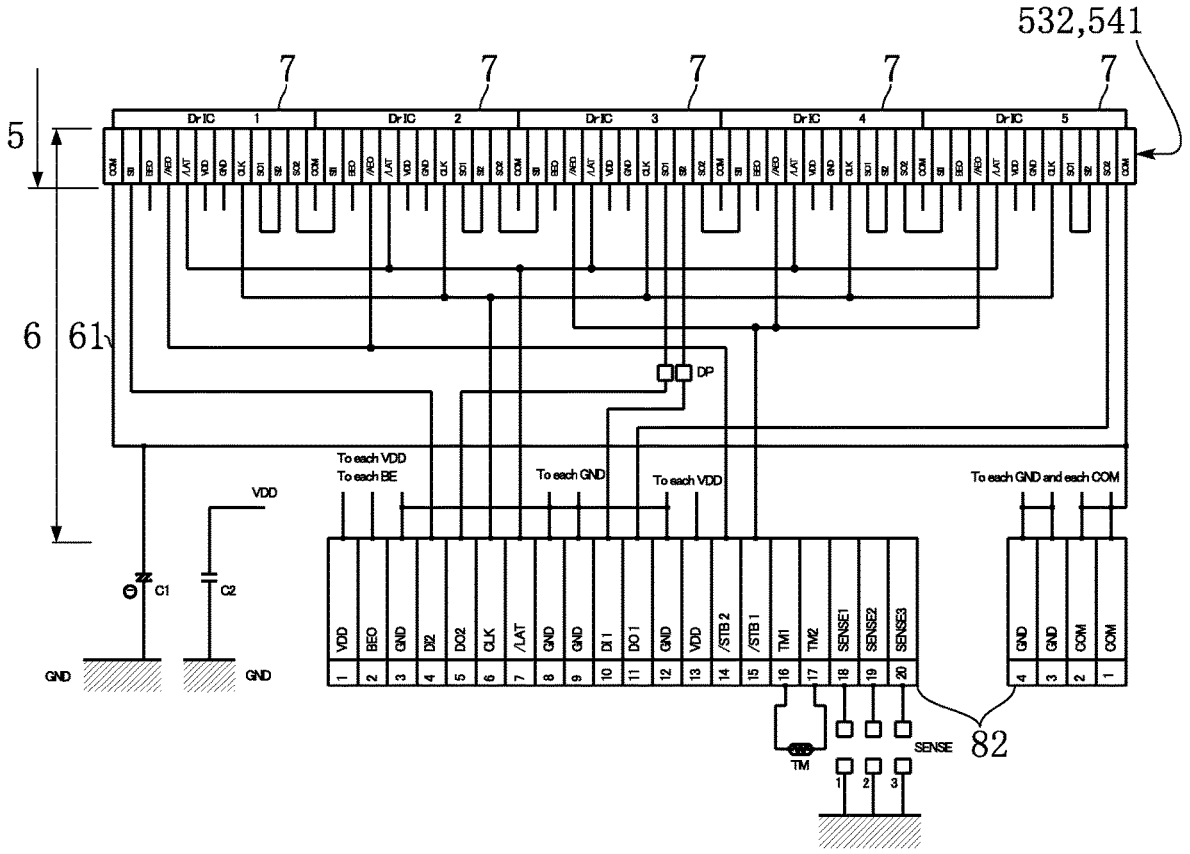
FIG. 37 is a circuit diagram showing a sub-flexible wiring substrate of the thermal print head according to the first embodiment of the second aspect.

In the present embodiment, the third wiring layer 61 of the sub-flexible wiring substrate 6 and the connector 82 constitute the circuit shown in FIG. 37. In the illustrated example, the plurality of electrodes 71 of five driver ICs 7 are electrically connected to the respective wiring paths of the third wiring layer 61. Regarding the third wiring layer 61, the wiring paths connected to the plurality of electrodes 71 are appropriately aggregated so as to be electrically connected to the plurality of terminals of the connector 82 in an appropriate fashion. As can be understood from the figure, the number of terminals of the connector 82 is smaller than the total sum of electrodes 71 of the plurality of driver ICs 7.

The heat dissipator 81 dissipates some of the heat generated by the plurality of heat generators 41 of the main substrate 1 to the outside. The heat dissipator 81 may be a block-like member that is made of a metal such as aluminum. In the present embodiment, the heat dissipator 81 is joined to the reverse surface 12 of the main substrate 1. The heat dissipator 81 has substantially the same dimension as the main substrate 1 in the sub-scanning direction y. In the present embodiment, the driver ICs 7 overlap with the heat dissipator 81 in the thickness direction z, i.e., as viewed in the sub-scanning direction y, in the state where the flexible wiring substrate 5 is bent, as shown in FIGS. 31 and 32.

Next, the advantages of the thermal print head B1 will be described.

According to the present embodiment, the flexible wiring substrate 5 is joined to the main substrate 1 with the anisotropic conductive joint material 58, as shown in FIG. 31. The driver ICs 7 are mounted on the flexible wiring substrate 5. Accordingly, the main substrate 1 does not need to include any wires for electrically connecting the first wiring layer 3 and the driver ICs 7, for example. In addition, the driver ICs 7 are spaced apart from the main substrate 1. This makes it possible to avoid interference between the platen roller 91 and each of the said wires, the driver ICs 7, and the protective resin 78 covering the driver ICs 7. Accordingly, the above-described interference can still be prevented even if the main substrate 1 is downsized in the sub-scanning direction y, which allows the downsizing of the thermal print head B1.

As shown in FIG. 34, the pitch changing portion 522 is provided for the plurality of individual wires 52 of the flexible wiring substrate 5. If the pitches of the plurality of heat generators 41 in the main scanning direction x differ from the pitches for connecting to the driver ICs 7, an adjustment portion is required to adjust the pitches. The adjustment of the pitches is made by the pitch changing portion 522 of the flexible wiring substrate 5. In this way, the main substrate 1 does not need to include any portions for matching the pitches, thus allowing the downsizing of the main substrate 1.

As shown in FIGS. 31 and 32, the mount portion 57 of the flexible wiring substrate 5 on which the driver ICs 7 are mounted extends along the direction intersecting the obverse surface 11 of the main substrate 1, and in the present embodiment, extends along the thickness direction z. This makes it possible to more reliably prevent the driver ICs 7 and the protective resin 78 from interfering with the platen roller 91. Also, the thermal print head B1 can be more downsized in the sub-scanning direction y.

Regarding the flexible wiring substrate 5, the plurality of individual wires 52 and the input/output wires 54 are provided on a layer differing from the layer on which the common wire 53 is provided. This makes it possible to prevent the plurality of individual wires 52 and the plurality of input/output wires 54 from interfering with the common wire 53 while increasing the area of the common wire 53, particularly of the aggregated portion 533. This contributes to lowering the resistance of the energization path of the plurality of heat generators 41. It is also possible to increase the widths of the plurality of individual wires 52 and the plurality of input/output wires 54.

The number of common pads 532 and input/output pads 541 of the flexible wiring substrate 5 is smaller than the number of individual electrodes 31 and individual wires 52. The third wiring layer 61 of the sub-flexible wiring substrate 6, which is connected to the plurality of common pads 532 and the plurality of input/output pads 541, provides a simpler wiring path than the plurality of individual wires 52. This makes it possible to increase the width of the third wiring layer 61. As a result, the metal foil used for the third wiring layer 61 of the sub-flexible wiring substrate 6 does not need to be machined as accurately as the metal foil used in the flexible wiring substrate 5.

Figure 38:
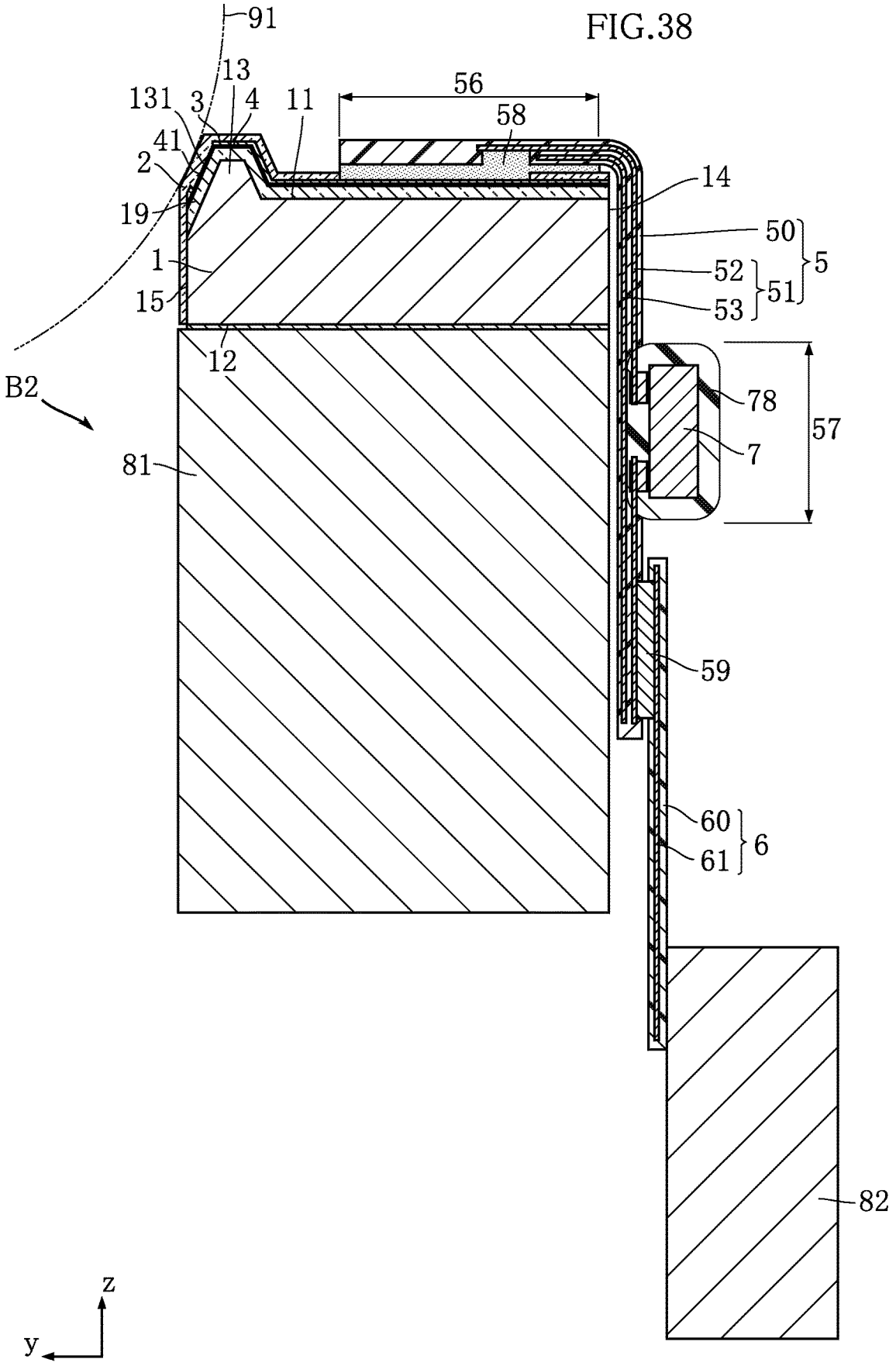
FIG. 38 is a cross-sectional view showing a thermal print head according to a second embodiment of the second aspect.

FIG. 38 shows a thermal print head according to a second embodiment of the second aspect. The thermal print head B2 according to the present embodiment differs from the thermal print head B1 described above in terms of the arrangement of the plurality of heat generators 41.

In the present embodiment, a plurality of heat generators 41 are arranged on a first inclined side surface 131 of a substrate protrusion 13 at a main substrate 1. At the main substrate 1, the first inclined side surface 131 of the substrate protrusion 13 is connected to a substrate end surface 15. Accordingly, the distance between the plurality of heat generators 41 and the substrate end surface 15 is shortened.

Such an embodiment as described above can also downsize the thermal print head B2. Since the plurality of heat generators 41 are provided on the first inclined side surface 131, a platen roller 91 can be arranged more downstream in the sub-scanning direction y to advantageously avoid interference. This structure can also be used as appropriate in other embodiments as described below.

Figure 39:
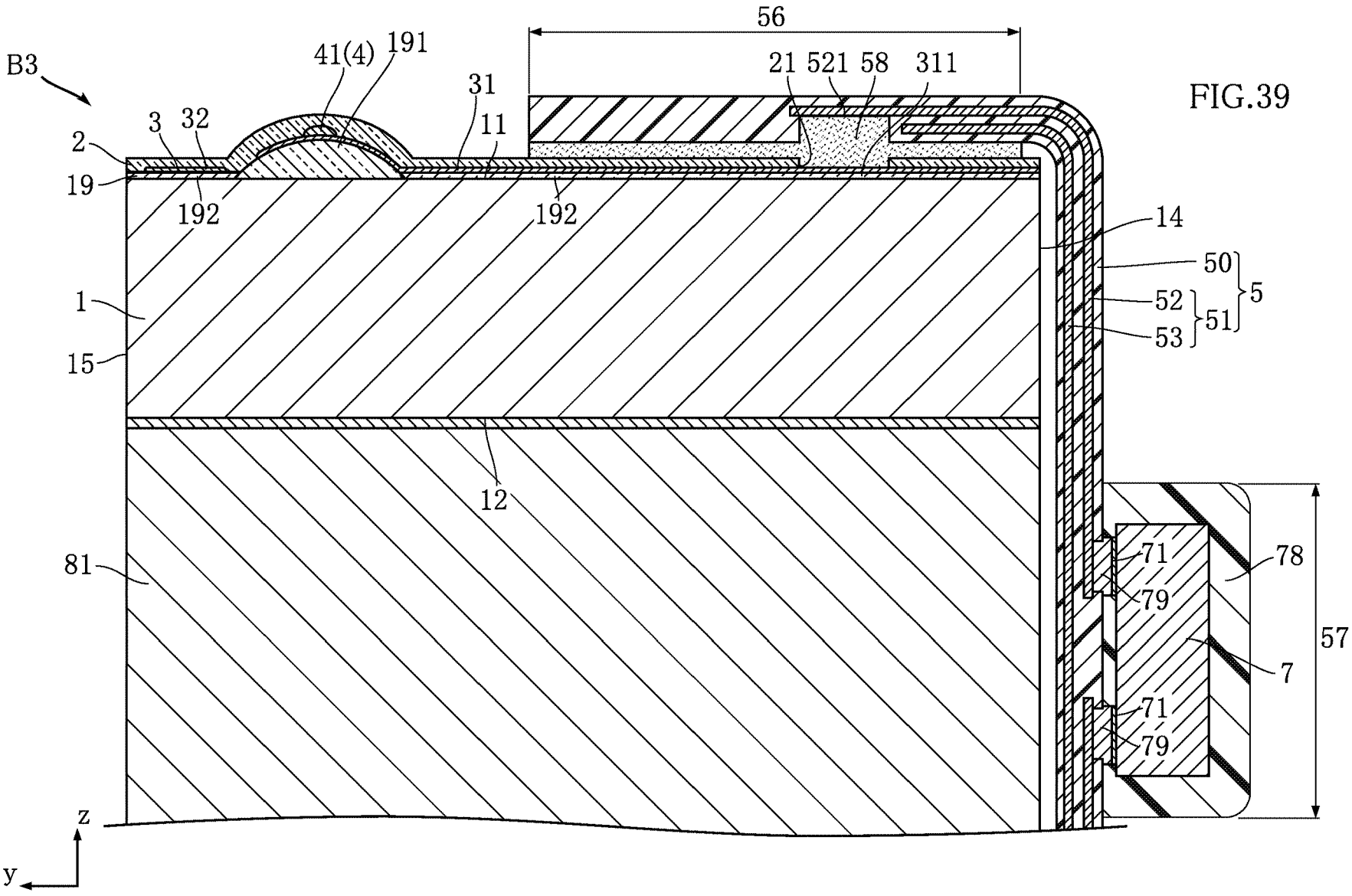
FIG. 39 is a main-part cross-sectional view showing a thermal print head according to a third embodiment of the second aspect.

FIG. 39 shows a thermal print head according to a third embodiment of the second aspect. A thermal print head B3 according to the present embodiment is a so-called thick-film thermal print head, and differs from those in the above-described embodiments in terms of the main substrate 1, the first wiring layer 3, and the resistor layer 4 among others.

In the present embodiment, a main substrate 1 is made of ceramic, for example. An insulating layer 19 is made of glass, for example, and has a bulging portion 191 and a flat portion 192. The bulging portion 191 bulges from an obverse surface 11 of the main substrate 1 in the thickness direction z, and is elongated in the main scanning direction x. In the example shown in FIG. 39, the outline of the cross section (y-z cross section) of the bulging portion 191 is made up of a single line segment and a curved line that gently curves to connect both ends of the line segment (e.g., a circular arc having a relatively small curvature). The flat portion 192 covers most of the obverse surface 11 of the main substrate 1. Note that the insulating layer 19 may be entirely flat without the bulging portion 191.

A first wiring layer 3 is formed by printing a conductive paste (e.g., Au resinate) on the insulating layer 19 through thick-film printing, and baking the paste. A resistor layer 4 is formed by printing a paste containing a resistor material through thick-film printing, and baking the paste. The resistor layer 4 is formed in a strip-like shape in the main scanning direction x on the bulging portion 191 of the insulating layer 19, and has a plurality of heat generators 41 arranged in the main scanning direction x.

Such an embodiment as described above can also downsize the thermal print head.

Figure 40:
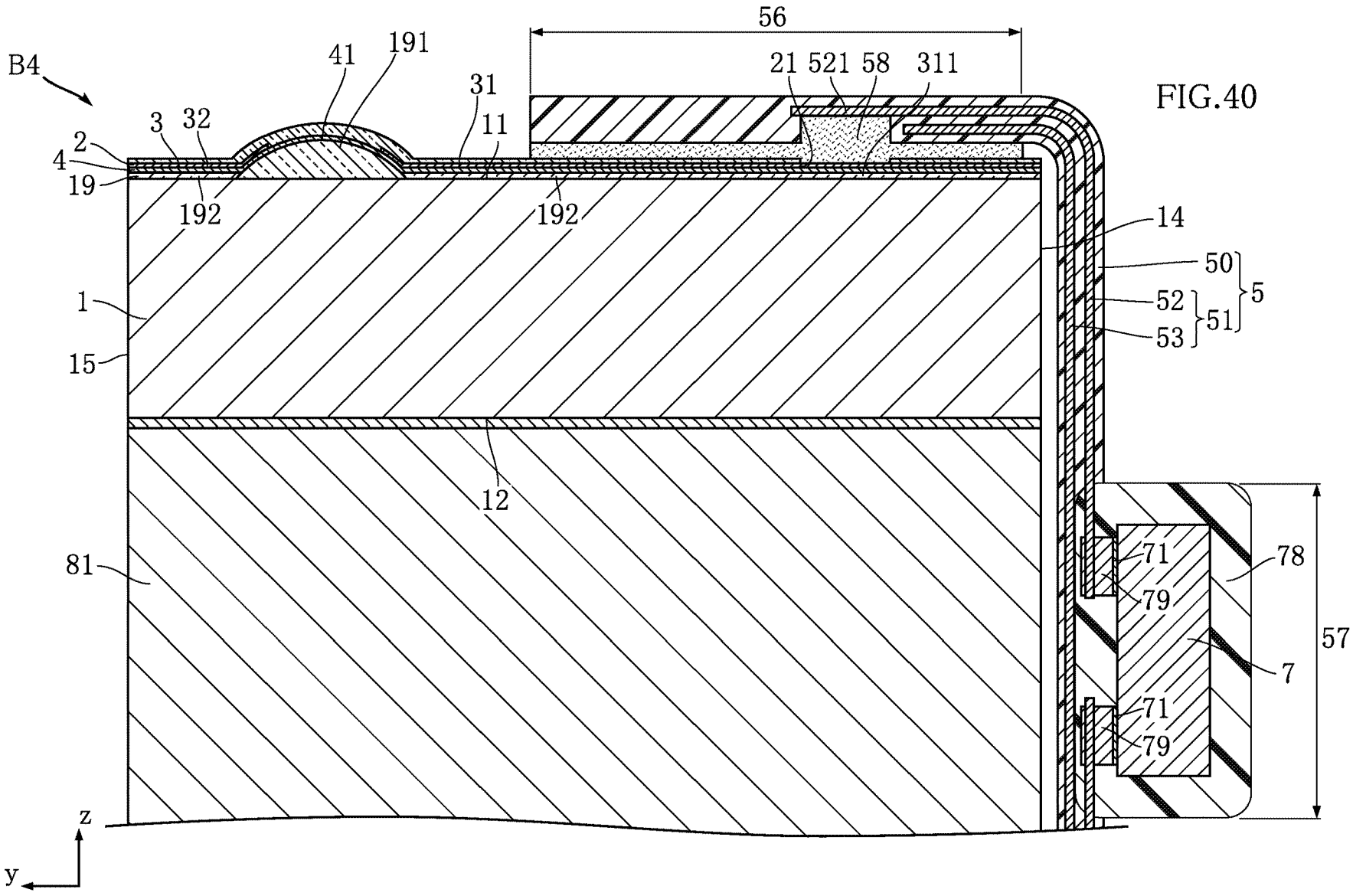
FIG. 40 is a main-part cross-sectional view showing a thermal print head according to a fourth embodiment of the second aspect.

FIG. 40 shows a thermal print head according to a fourth embodiment of the second aspect. A thermal print head B4 according to the present embodiment is a so-called thin-film thermal print head, and differs from those in the above-described embodiments in terms of the main substrate 1, the first wiring layer 3, and the resistor layer 4 among others.

In the present embodiment, a main substrate 1 is made of ceramic, for example. An insulating layer 19 is made of glass, for example, and has a bulging portion 191 and a flat portion 192. As with the case of the thermal head B3, the bulging portion 191 moderately bulges from an obverse surface 11 of the main substrate 1 in the thickness direction z, and is elongated in the main scanning direction x. The flat portion 192 covers most of the obverse surface 11 of the main substrate 1. Note that the insulating layer 19 may be entirely flat without the bulging portion 191.

A resistor layer 4 is made of a resistor material, and is formed on the insulating layer 19 by a thin-film forming method, such as CVD or sputtering. A first wiring layer 3 is made of a metal such as aluminum, and is formed on the resistor layer 4 by a thin-film forming method, such as CVD or sputtering. The resistor layer 4 has a plurality of heat generators 41 arranged in the main scanning direction x.

Such an embodiment as described above can also downsize the thermal print head.

Figure 41:
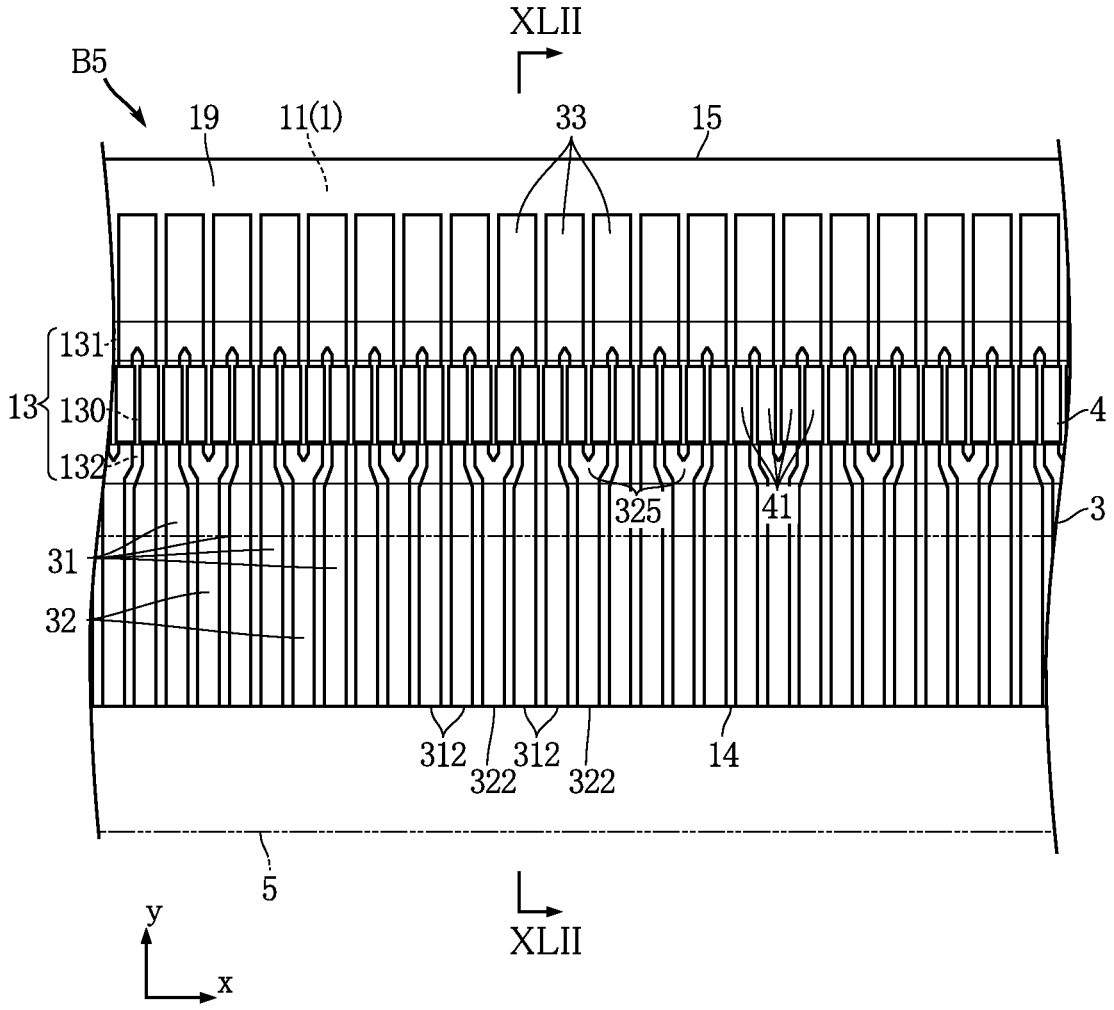
FIG. 41 is a main-part enlarged plan view showing a thermal print head according to a fifth embodiment of the second aspect.
Figure 42:
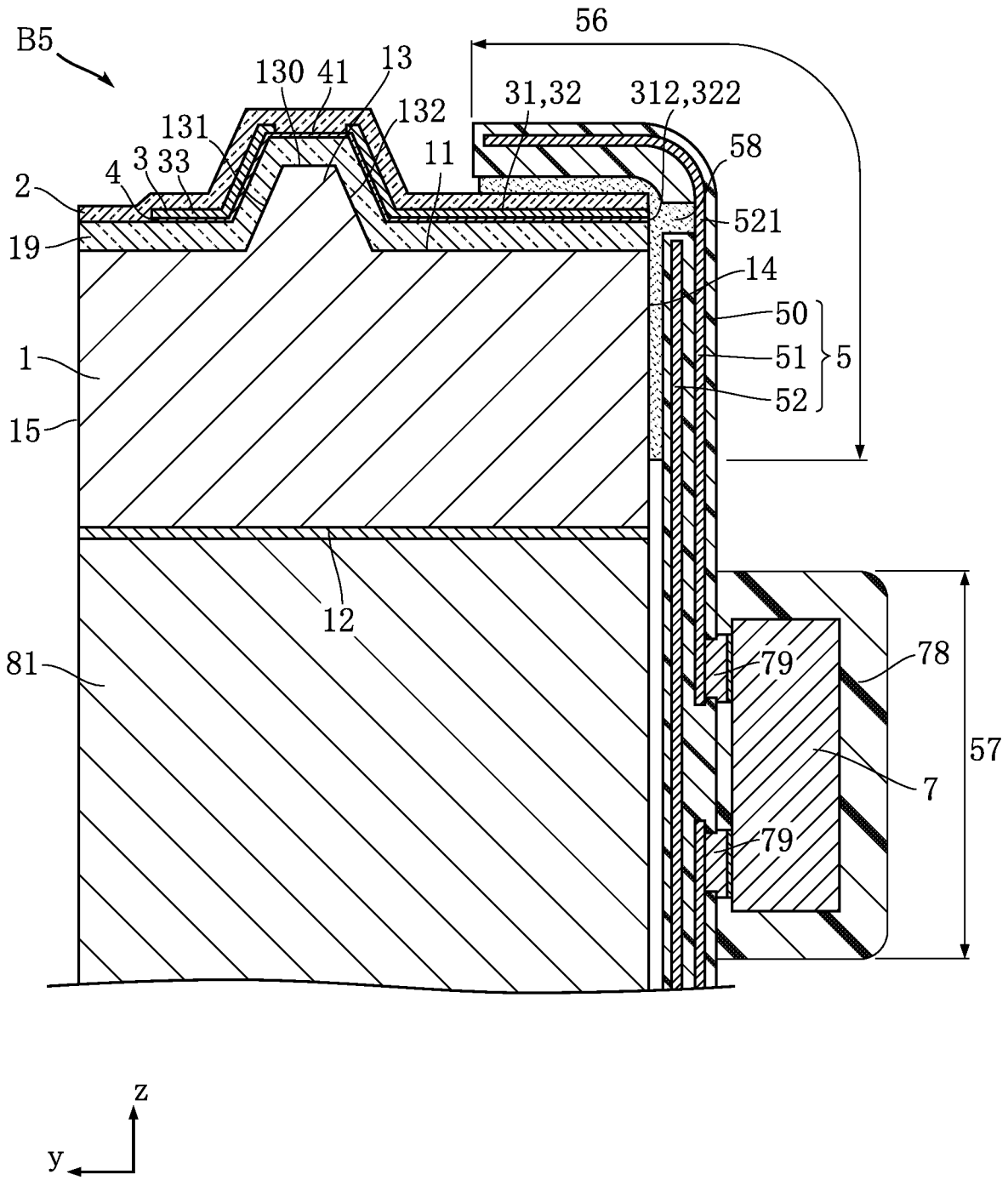
FIG. 42 is a main-part cross-sectional view taken along line XLII-XLII in FIG. 41.
Figure 43:
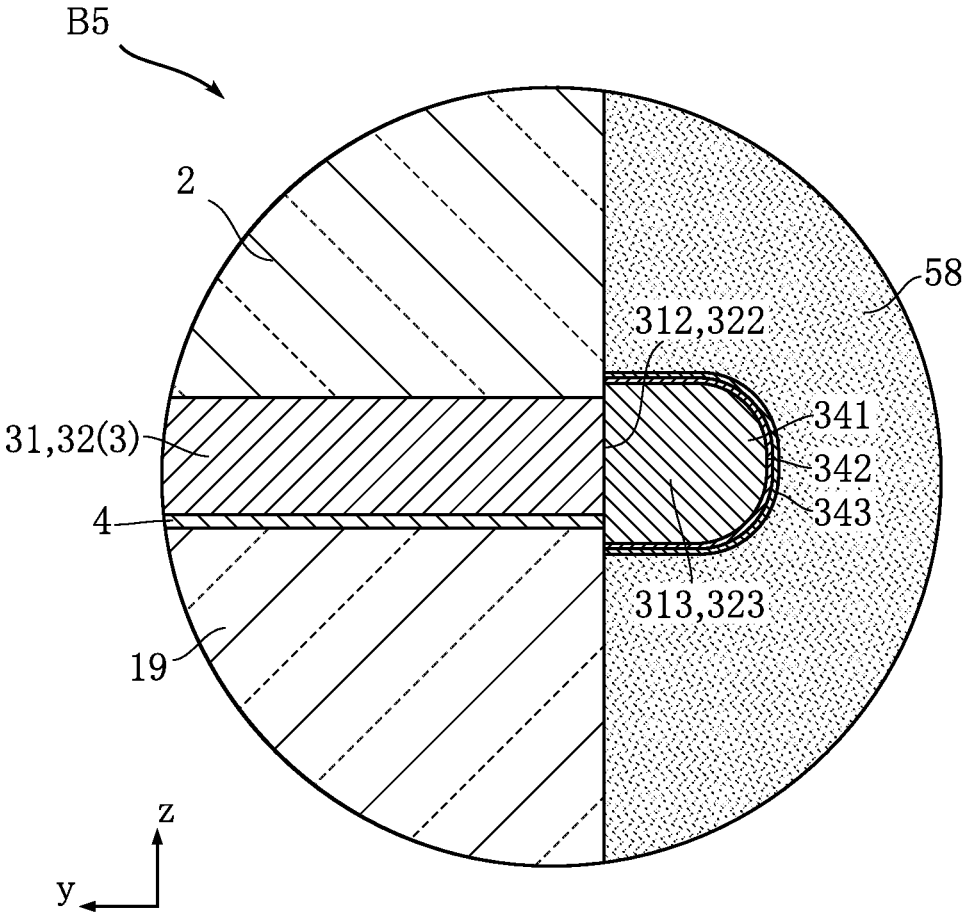
FIG. 43 is a main-part enlarged cross-sectional view showing the thermal print head according to the fifth embodiment of the second aspect.

FIGS. 41 to 43 show a thermal print head according to a fifth embodiment of the second aspect. A thermal print head B5 according to the present embodiment differs from those in the above-described embodiments in terms of the joint between the main substrate 1 and the flexible wiring substrate 5.

In the present embodiment, a first wiring layer 3 is entirely covered by a protective layer 2 as viewed in the thickness direction z. As shown in FIGS. 42 and 43, individual electrodes 31 of a first wiring layer 3 have individual end surfaces 312, and common electrodes 32 have common end surfaces 322. The individual end surfaces 312 and the common end surfaces 322 are exposed at the side of a substrate end surface 14 of a main substrate 1, between the main substrate 1 (insulating layer 19) and the protective layer 2. In the structure where the individual end surfaces 312 and the common end surfaces 322 are exposed at the side of the substrate end surface 14, the thickness of the first wiring layer 3 is approximately 1.5 μm, for example.

In the present embodiment, the individual end surfaces 312 and the common end surfaces 322 are provided with individual protrusions 313 and common protrusions 323, respectively. The individual protrusions 313 and the common protrusions 323 are formed by plating the individual end surfaces 312 and the common end surfaces 322. Although the individual protrusions 313 and the common protrusions 323 are formed by plating, they protrude in the sub-scanning direction y. This is because the individual end surfaces 312 and the common end surfaces 322 have the aforementioned dimension in the thickness direction z. Specifically, the individual protrusions 313 and the common protrusions 323 are made of first plating layers 341, second plating layers 342, and third plating layers 343. Each of the first plating layers 341 is an Ni plating layer having a dimension of approximately 3 μm in the sub-scanning direction y, for example. Each of the second plating layers 342 is a Pd plating layer having a thickness of approximately 0.05 μm, for example. Each of the third plating layers 343 is a Au plating layer having a thickness of approximately 0.03 to 0.1 μm, for example.

In the present embodiment, the plurality of individual electrodes 31 and the plurality of common electrodes 32 each have a shape that extends along the sub-scanning direction y, and do not include any enlarged portions such as the individual pads 311 or the common pads 321 as described above. In correspondence to this, a plurality of individual wires 52 and a common wire 53, which are included in a second wiring layer 51 of a flexible wiring substrate 5, have joints that correspond to the arrangement pitches of the plurality of individual electrodes 31 and the plurality of common electrodes 32. The pitch between each pair of these joints in the main scanning direction x is approximately 84 μm, for example. As shown in FIG. 42, the individual end surfaces 312 and the common end surfaces 322 of the first wiring layer 3 face the flexible wiring substrate 5, and these surfaces 312 and 322 are joined to the flexible wiring substrate 5 in this state with an anisotropic conductive joint material 58. In this way, the plurality of individual end surfaces 312 and the plurality of common end surfaces 322 are joined to the anisotropic conductive joint material 58 via the individual protrusions 313 and the common protrusions 323, and are electrically connected to the second wiring layer 51 of the flexible wiring substrate 5 in an appropriate manner.

Also, in the illustrated example, an end portion of the flexible wiring substrate 5 faces an obverse surface 11 of the main substrate 1, and is joined to the obverse surface 11 in this state with the anisotropic conductive joint material 58. As a result, in the present embodiment, a fixed portion 56 has a bent shape including portions that lie along the sub-scanning direction y and the thickness direction z.

Such an embodiment as described above can also downsize the thermal print head. Also, as shown in FIG. 41, the present embodiment eliminates the need to provide the main substrate 1 with a space for arranging individual pads 311 of the plurality of individual electrodes 31 and common pads 321 of the plurality of common electrodes 32. This makes it possible to further downsize the thermal print head.

The thermal print heads according to the second aspect can be defined in the following clauses.

Clause 1. A thermal print head comprising: a main substrate having an obverse surface; a resistor layer supported by the main substrate and having a plurality of heat generators arranged in a main scanning direction; a first wiring layer supported by the main substrate and constituting an energization path to the plurality of heat generators; at least one driver IC that performs energization control on the plurality of heat generators; and a flexible wiring substrate having a second wiring layer joined to the first wiring layer via an anisotropic conductive joint material, wherein the driver IC is mounted on the flexible wiring substrate.

Clause 2. The thermal print head according to clause 1, wherein the first wiring layer includes a plurality of individual electrodes and a common electrode, and the plurality of individual electrodes are electrically connected to the common electrode via the plurality of heat generators.

Clause 3. The thermal print head according to clause 2, wherein the flexible wiring substrate has a plurality of individual wires electrically connected to the plurality of individual electrodes, and a common wire electrically connected to the common electrode.

Clause 4. The thermal print head according to clause 3, wherein in a pitch changing portion between the main substrate and the driver IC, pitches of the plurality of individual wires in the main scanning direction decrease from the main substrate toward the driver IC.

Clause 5. The thermal print head according to clause 3 or 4, wherein the plurality of individual electrodes have a plurality of individual pads facing in a thickness direction of the main substrate, and the plurality of individual wires of the flexible wiring substrate are joined to the plurality of individual pads via the anisotropic conductive joint material.

Clause 6. The thermal print head according to clause 5, wherein the common electrode has a common pad facing in the thickness direction of the main substrate, and the common wire of the flexible wiring substrate is joined to the common pad via the anisotropic conductive joint material.

Clause 7. The thermal print head according to clause 3 or 4, wherein each of the plurality of individual electrodes has an individual end surface exposed in a sub-scanning direction, and the plurality of individual wires of the flexible wiring substrate are joined to the plurality of individual end surfaces via the anisotropic conductive joint material.

Clause 8. The thermal print head according to clause 7, wherein the plurality of individual electrodes have individual protrusions, the individual protrusions being interposed between the individual end surfaces and the anisotropic conductive joint material and protruding from the individual end surfaces in the sub-scanning direction.

Clause 9. The thermal print head according to clause 7 or 8, wherein the common electrode has a common end surface exposed in the sub-scanning direction, and the common wire of the flexible wiring substrate is connected to the common end surface via the anisotropic conductive joint material.

Clause 10. The thermal print head according to clause 9, wherein the common electrode has a common protrusion, the common protrusion being interposed between the common end surface and the anisotropic conductive joint material and protruding from the common end surface in the sub-scanning direction.

Clause 11. The thermal print head according to any of clauses 3 to 10, wherein the flexible wiring substrate has a fixed portion fixed to the obverse surface of the main substrate.

Clause 12. The thermal print head according to any of clauses 3 to 11, wherein the flexible wiring substrate has a mount portion to which the driver IC is joined, and the mount portion extends along a direction intersecting the obverse surface.

Clause 13. The thermal print head according to any of clauses 3 to 12, wherein the plurality of individual wires are provided on a layer differing from a layer on which the common wire is provided in the thickness direction of the flexible wiring substrate.

Clause 14. The thermal print head according to any of clauses 1 to 13, wherein the main substrate is made of Si.

Clause 15. The thermal print head according to clause 14, wherein the main substrate has a substrate protrusion extending in the main scanning direction and protruding from the obverse surface.

Clause 16. The thermal print head according to clause 15, wherein the plurality of heat generators are provided on the substrate protrusion.

Clause 17. The thermal print head according to any of clauses 1 to 16, further comprising an additional flexible wiring substrate, wherein the additional flexible wiring substrate has a third wiring layer electrically connected to the second wiring layer.

Although the thermal print heads according to the second aspect have been described, the thermal print heads according to the present disclosure are not limited to those in the above-described embodiments. Various design changes can be made to the specific structures of the respective components of the thermal print heads.

The invention claimed is:

1. A thermal print head comprising:

a main substrate having an obverse surface;

a resistor layer supported by the main substrate and having a plurality of heat generators arranged in a main scanning direction;

a first wiring layer supported by the main substrate and constituting an energization path to the plurality of heat generators;

at least one driver IC that performs energization control on the plurality of heat generators; and a flexible wiring substrate having a second wiring layer jointed to the first wiring layer via an anisotropic conductive joint material, wherein the driver IC is mounted on the flexible wiring substrate.

2. The thermal print head according to claim 1, wherein the first wiring layer includes a plurality of individual electrodes and a common electrode, and the plurality of individual electrodes are electrically connected to the common electrode via the plurality of heat generators.

3. The thermal print head according to claim 2, wherein the flexible wiring substrate has a plurality of individual wires electrically connected to the plurality of individual electrodes, and a common wire electrically connected to the common electrode.

4. The thermal print head according to claim 3, further comprising a pitch changing portion between the main substrate and the driver IC, in which pitches of the plurality of individual wires in the main scanning direction decreases from the main substrate toward the driver IC.

5. The thermal print head according to claim 3, wherein the plurality of individual electrodes comprise a plurality of individual pads facing in a thickness direction of the main substrate, and the plurality of individual wires of the flexible wiring substrate are joined to the plurality of individual pads via the anisotropic conductive joint material.

6. The thermal print head according to claim 5, wherein the common electrode includes a common pad facing in the thickness direction of the main substrate, and the common wire of the flexible wiring substrate is joined to the common pad via the anisotropic conductive joint material.

7. The thermal print head according to claim 3, wherein each of the plurality of individual electrodes comprise an individual end surface exposed in a sub-scanning direction, and the plurality of individual wires of the flexible wiring substrate are joined to the plurality of individual end surfaces via the anisotropic conductive joint material.

8. The thermal print head according to claim 7, wherein the plurality of individual electrodes comprise individual protrusions interposed between the individual end surfaces and the anisotropic conductive joint material, the individual protrusions protruding from the individual end surfaces in the sub-scanning direction.

9. The thermal print head according to claim 7, wherein the common electrode includes a common end surface exposed in the sub-scanning direction, and the common wire of the flexible wiring substrate is connected to the common end surface via the anisotropic conductive joint material.

10. The thermal print head according to claim 9, wherein the common electrode includes a common protrusion interposed between the common end surface and the anisotropic conductive joint material, the common protrusion protruding from the common end surface in the sub-scanning direction.

11. The thermal print head according to claim 3, wherein the flexible wiring substrate includes a fixed portion fixed to the obverse surface of the main substrate.

12. The thermal print head according to claim 3, wherein the flexible wiring substrate includes a mount portion to which the driver IC is joined, and the mount portion extends along a direction intersecting the obverse surface.

13. The thermal print head according to claim 3, wherein the plurality of individual wires are provided on a layer differing from a layer on which the common wire is provided in the thickness direction of the flexible wiring substrate.

14. The thermal print head according to claim 1, wherein the main substrate is made of Si.

15. The thermal print head according to claim 14, wherein the main substrate includes a substrate portion extending in the main scanning direction and protruding from the obverse surface.

16. The thermal print head according to claim 15, wherein the plurality of heat generators are provided on the substrate protrusion.

17. The thermal print head according to claim 1, further comprising an additional wiring substrate, wherein the additional flexible wiring substrate includes a third wiring layer electrically connected to the second wiring layer.

18. The thermal print head according to claim 1, wherein the resistor layer is made of a resistor material provided by thin-film forming, and the first wiring layer is made of a metal provided by thin-film forming.

19. The thermal print head according to claim 1, wherein the resistor layer is made of a baked paste containing a resistor material, and the first wiring layer is made of a baked conductive paste.

* * * * *